US011719435B2

(12) United States Patent
Carroll et al.

(10) Patent No.: US 11,719,435 B2
(45) Date of Patent: Aug. 8, 2023

(54) COMBUSTION HEATER CONTROL SYSTEM WITH DYNAMIC SAFETY SETTINGS AND ASSOCIATED METHODS

(71) Applicant: ONPOINT TECHNOLOGIES, LLC, Wichita, KS (US)

(72) Inventors: Chad Carroll, Tulsa, OK (US); Thomas Korb, Tulsa, OK (US); Ryan Morgan, Tulsa, OK (US); Kevin Anderson, Davis, CA (US); Mark Vaccari, Broken Arrow, OK (US)

(73) Assignee: Onpoint Technologies, LLC, Wichita, KS (US)

( * ) Notice: Subject to any disclaimer, the term of this patent is extended or adjusted under 35 U.S.C. 154(b) by 0 days.

(21) Appl. No.: 17/624,324

(22) PCT Filed: Jun. 19, 2020

(86) PCT No.: PCT/IB2020/055822
§ 371 (c)(1),
(2) Date: Dec. 31, 2021

(87) PCT Pub. No.: WO2020/255091
PCT Pub. Date: Dec. 24, 2020

(65) Prior Publication Data

US 2022/0349579 A1 Nov. 3, 2022

Related U.S. Application Data

(60) Provisional application No. 62/864,992, filed on Jun. 21, 2019, provisional application No. 62/865,007, filed on Jun. 21, 2019.

(51) Int. Cl.
*F23N 5/24* (2006.01)

(52) U.S. Cl.
CPC ..... *F23N 5/242* (2013.01); *F23N 2225/10* (2020.01); *F23N 2235/12* (2020.01); *F23N 2900/05003* (2013.01)

(58) Field of Classification Search
CPC ..... F23N 5/242; F23N 2225/10; F23N 2900/05003
(Continued)

(56) References Cited

U.S. PATENT DOCUMENTS 4,241,869 A 12/1980 Cratin, Jr.
4,927,351 A 5/1990 Hagar et al.
(Continued)

FOREIGN PATENT DOCUMENTS

CN 205317749 U 6/2016
CN 107525066 B 1/2019
(Continued)

OTHER PUBLICATIONS

International Preliminary Report on Patentability received for PCT Application No. PCT/IB2020/055819, dated Dec. 30, 2021, 07 Pages.
(Continued)

*Primary Examiner* — Vivek K Shirsat

(57) ABSTRACT

Combustion heater control systems and methods that include dynamic safety settings. Current operating parameters of the combustion heater are sensed at a plurality of time intervals and converted into a time-varying signal. The time-varying signal is compared to a burner stability envelope indicating when a burner is likely to enter an unstable state. The unstable state may include huffing, flashback, and/or liftoff. When the burner is likely to enter an unstable state, the combustion heater is controlled to prevent the unstable state.

56 Claims, 29 Drawing Sheets

(58) Field of Classification Search
USPC ..... 431/12
See application file for complete search history.

(56) References Cited

U.S. PATENT DOCUMENTS

| | | | | |
|---|---|---|---|---|
| 8,727,767 | B2 | 5/2014 | Watson et al. | |
| 9,506,649 | B2 | 11/2016 | Rennie et al. | |
| 2003/0136318 | A1 | 7/2003 | Brown et al. | |
| 2004/0224268 | A1 | 11/2004 | Keller et al. | |
| 2006/0015298 | A1* | 1/2006 | Daw | F23N 5/16 700/274 |
| 2012/0102967 | A1 | 5/2012 | Kirzhner et al. | |
| 2013/0173074 | A1 | 7/2013 | Chandler | |
| 2013/0302738 | A1 | 11/2013 | Rennie et al. | |
| 2014/0011148 | A1 | 1/2014 | Hemmann et al. | |
| 2015/0152791 | A1 | 6/2015 | White | |
| 2015/0337741 | A1* | 11/2015 | Gassner | F23R 3/36 60/734 |
| 2016/0209031 | A1 | 7/2016 | Lou et al. | |
| 2017/0167727 | A1 | 6/2017 | Benum et al. | |
| 2020/0408154 | A1* | 12/2020 | Geipel | F23R 3/28 |

FOREIGN PATENT DOCUMENTS

| | | | |
|---|---|---|---|
| DE | 4032347 | A1 | 4/1992 |
| DE | 102014118190 | A1 | 6/2016 |
| DE | 102019101190 | A1 | 7/2020 |
| EP | 2216386 | A1 | 8/2010 |
| EP | 2920515 | A1 | 9/2015 |
| EP | 2993401 | A1 | 3/2016 |
| WO | 2010092080 | A1 | 8/2010 |
| WO | 2020255089 | A1 | 12/2020 |
| WO | 2020255090 | A1 | 12/2020 |
| WO | 2020255091 | A1 | 12/2020 |
| WO | 2020255092 | A1 | 12/2020 |
| WO | 2020255093 | A1 | 12/2020 |

OTHER PUBLICATIONS

International Preliminary Report on Patentability received for PCT Application No. PCT/IB2020/055821, dated Dec. 30, 2021, 10 Pages.

International Preliminary Report on Patentability received for PCT Application No. PCT/IB2020/055822, dated Dec. 30, 2021, 09 Pages.

International Preliminary Report on Patentability received for PCT Application No. PCT/IB2020/055823, dated Dec. 30, 2021, 08 Pages.

International Preliminary Report on Patentability received for PCT Application No. PCT/IB2020/055824, dated Dec. 30, 2021, 13 Pages.

International Search Report and Written Opinion received for PCT Application No. PCT/IB2020/055819, dated Nov. 4, 2020, 08 Pages.

International Search Report and Written Opinion received for PCT Application No. PCT/IB2020/055821, dated Oct. 26, 2020, 14 Pages.

International Search Report and Written Opinion received for PCT Application No. PCT/IB2020/055822, dated Oct. 16, 2020, 12 Pages.

International Search Report and Written Opinion received for PCT Application No. PCT/IB2020/055823, dated Sep. 2, 2020, 10 Pages.

International Search Report and Written Opinion received for PCT Application No. PCT/IB2020/055824, dated Oct. 13, 2020, 15 Pages.

Liu Xingrang et al."Integrating multi-objective optimization with computational fluid dynamics to optimize boiler combustion process of a coal fired power plant", Applied Energy, Elsevier Sciencepublishers, vol. 130, Oct. 1, 2014, pp. 658-669. (Abstract).

Notice of Allowance received for EP Application No. 20743798.9, dated Oct. 1, 2021, 07 Pages.

Notice of Allowance received for EP Application No. 20744106.4, dated Nov. 3, 2021, 08 Pages.

Office Action received for EP Application No. 20743798.9, dated Jun. 16, 2021, 04 Pages.

Office Action received for EP Application No. 20744105.6, dated Jun. 16, 2021, 04 Pages.

Office Action received for EP Application No. 20744105.6, dated Sep. 30, 2021, 04 Pages.

Office Action received for EP Application No. 20744106.4, dated Jun. 17, 2021, 04 Pages.

Extended European search report and Opinion received for EP Application No. 21212579.3, dated May 30, 2022, 6 pages.

Extended European Search Report received for EP Application No. 21212594.2, dated Mar. 25, 2022, 6 pages.

Non-Final Rejection received for U.S. Appl. No. 17/624,322, dated Jan. 24, 2023, 8 pages.

* cited by examiner

COMBUSTION HEATER CONTROL SYSTEM WITH DYNAMIC SAFETY SETTINGS AND ASSOCIATED METHODS

CROSS-REFERENCE TO RELATED APPLICATIONS

This application is a national phase application under 35 U.S.C. § 371 of International Application No. PCT/IB2020/055822 filed Jun. 19, 2020, which claims the benefit of and priority to, and benefits from each of U.S. Provisional Application Ser. No. 62/864,992, filed Jun. 21, 2019, and U.S. Provisional Application Ser. No. 62/865,007, filed Jun. 21, 2019. This application is also related to each of: U.S. Provisional Application Ser. No. 62/864,954, filed Jun. 21, 2019; U.S. Provisional Application Ser. No. 62/864,967, filed Jun. 21, 2019; U.S. Provisional Application Ser. No. 62/864,997, filed Jun. 21, 2019; U.S. Provisional Application Ser. No. 62/865,021, filed Jun. 21, 2019; and U.S. Provisional Application Ser. No. 62/865,031, filed Jun. 21, 2019. The entire contents of each of the aforementioned applications are incorporated herein as if fully set forth.

BACKGROUND

Process heaters operate by injecting fuel and air into the heater via a plurality of burners. The fuel and air is combusted and converted into thermal energy. Currently in industry, a single high and low fuel-pressure trip setting (often referred to as a part of the Safety Instrumented Systems SIS) is utilized as a "broad safety" in attempts to ensure the that burners do not run in an operating condition "beyond" what the equipment was designed. During design, the customer tells the process heater designer a range of expected fuels. Regarding the safety settings, each company uses their own philosophy. For example, one company may choose the average high-pressure trip setting of various potential input fuels. Another company may choose the maximum of the fuels, plus or minus 10 percent to give the operator control cushion (such as the high and low fuel-pressure trip settings). During design of the system, customers typically chose a low fuel-pressure trip setting near the lowest pressure demanding fuel, and a high fuel-pressure trip setting(s) within a few PSIG of the highest pressure demanding fuel. For example, they may choose a high-pressure trip setting of 25 PSIG. The low and high fuel-pressure trip settings typically remain constant during the lifetime of the process heater.

Additional details go into the burner fuel-pressure maximum and minimum rates that are set during the design of the burner. Historically, a specification of available draft (that draws air through the burner) and air composition in the process heater is provided. The specification is made conservatively in attempts to prevent the burner of running out of air (and causing a dangerous condition inside the process heater where there is more fuel being injected than what can combust). Because of this conservative specification of the available draft, the burner is not typically able to be rated to achieve higher firing rates because the specified draft would indicate that the burner would essentially run out of air.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

DETAILED DESCRIPTION

Figure 1:
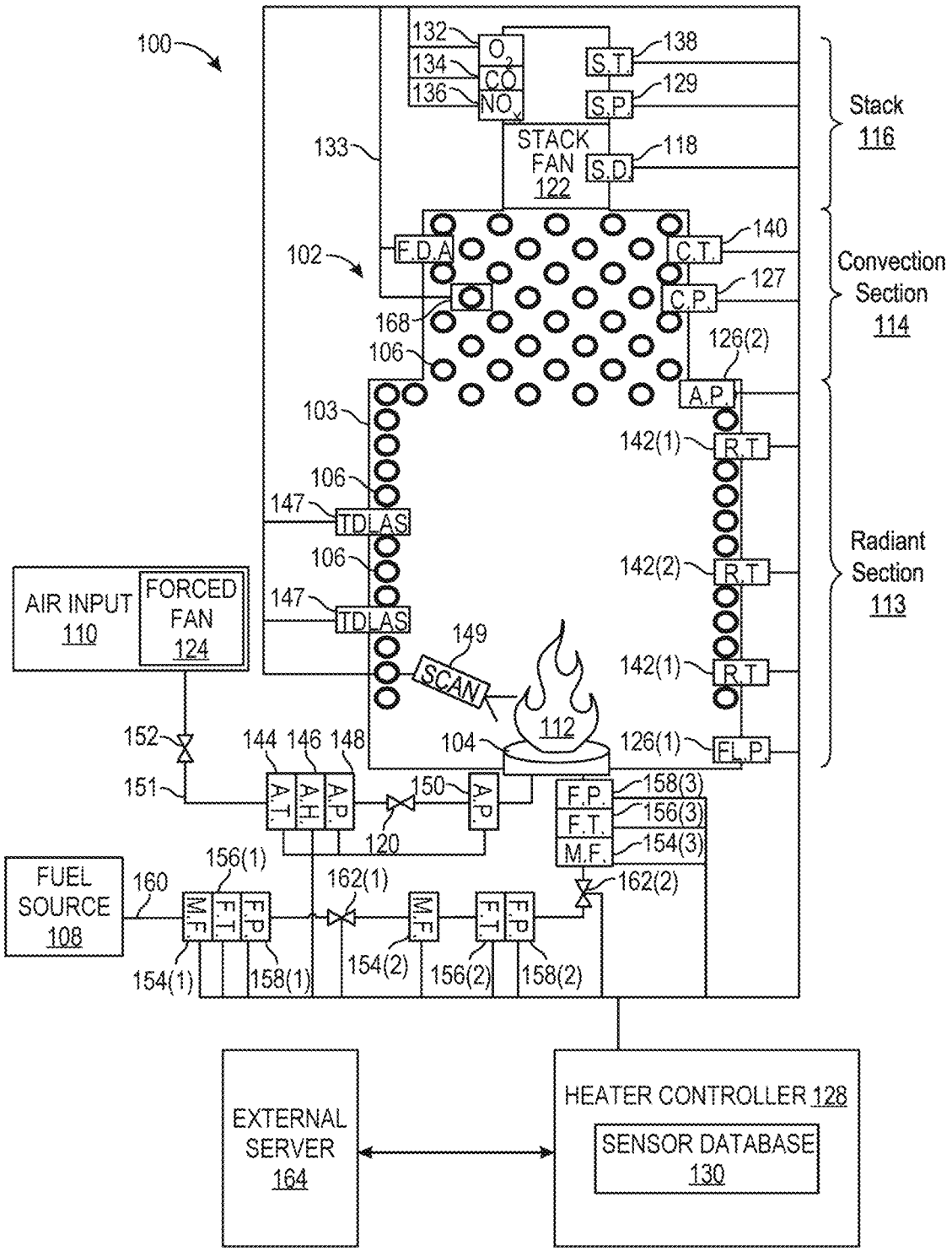
FIG. 1 depicts an example system of a process heater with automatic air register setting determination, in embodiments.

FIG. 1 depicts an example system 100 of a process heater with intelligent monitoring system, in embodiments. The system 100 includes a heater 102 that is heated by one or more burners 104 located in the housing 103 thereof. Heater 102 can have any number of burners 104 therein, each operating under different operating conditions (as discussed in further detail below). Moreover, although FIG. 1 shows a burner located on the floor of the heater 102, one or more burners may also be located on the walls and/or ceiling of the heater 102 without departing from the scope hereof (indeed, heaters in the industry often have over 100 burners). Further, the heater 102 may have different configurations, for example a box heater, a cylindrical heater, a cabin heater, and other shapes, sizes, etc. as known in the art.

Burner 104 provides heat necessary to perform chemical reactions or heat up process fluid in one or more process tubes 106 (not all of which are labeled in FIG. 1. Any number of process tubes 106 may be located within the heater 102, and in any configuration (e.g., horizontal, vertical, curved, off-set, slanted, or any configuration thereof). Burner 104 is configured to combust a fuel source 108 with an oxidizer such as air input 110 to convert the chemical energy in the fuel into thermal energy 112 (e.g., a flame). This thermal energy 112 then radiates to the process tubes 106 and is transferred through the process tubes 106 into a material therein that is being processed. Accordingly, the heater 102 typically has a radiant section 113, a convection section 114, and a stack 116. Heat transfer from the thermal energy 112 to the process tubes 106 primarily occurs in the radiant section 113 and the convection section 114.

Airflow into the heater 102 (through the burner 104) typically occurs in one of four ways natural, induced, forced, and balanced.

A natural induced airflow draft occurs via a difference in density of the flue gas inside the heater 102 caused by the combustion. There are no fans associated in a natural induced system. However, the stack 116 includes a stack damper 118 and the burner includes a burner air register 120 that are adjustable to change the amount of naturally induced airflow draft within the heater 102.

An induced airflow draft system includes a stack fan (or blower) 122 located in the stack (or connected to the stack) 116. In other or additional embodiments, other motive forces than a fan are be used to create the induced draft, such as steam injection to educts flue gas flow through the heater. The stack fan 122 operates to pull air through the burner air register 120 creating the induced-draft airflow within the heater 102. The stack fan 122 operating parameters (such as the stack fan 122 speed and the stack damper 118 settings) and the burner air register 120 impact the draft airflow. The stack damper 118 may be a component of the stack fan 122, or separate therefrom.

A forced-draft system includes an air input forced fan 124 that forces air input 110 into the heater 102 via the burner 104. The forced fan 124 operating parameters (such as the forced fan 124 speed and the burner air register 120 settings) and the stack damper 118 impact the draft airflow. The burner air register 120 may be a component of the forced fan 124, but is commonly separate therefrom and a component of the burner 104.

A balanced-draft system includes both the air input forced fan 124 and the stack fan 122. Each fan 122, 124 operate in concert, along with the burner air register 120 and stack damper 118 to control the airflow and draft throughout the heater 102.

Figure 2:
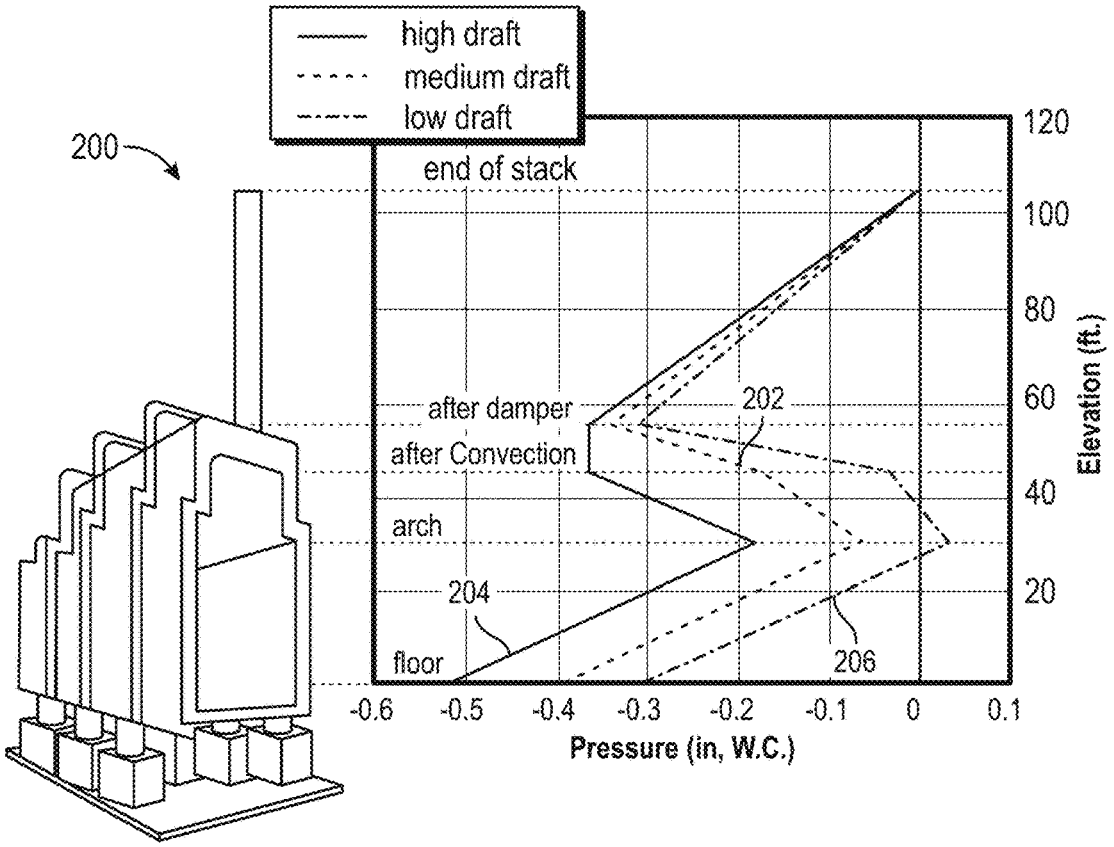
FIG. 2 depicts a typical draft profile throughout a heater (e.g., the heater of FIG. 1).

Draft throughout the heater 102 varies depending on the location within the heater 102. FIG. 2 depicts a typical draft profile 200 throughout a heater (e.g., heater 102). Line 202 depicts a desired draft that is consistent with the design of the heater and components therein. Line 204 depicts a high draft situation where pressure in the heater is more negative than desired (and thus further negative compared to atmospheric pressure outside of the heater). Line 206 depicts a low draft situation where pressure in the heater is more positive than desired (and thus closer to or greater than atmospheric pressure outside of the heater). As shown, by line 202, heaters are often designed to have a −0.1 pressure at the arch of the heater.

Figure 3:
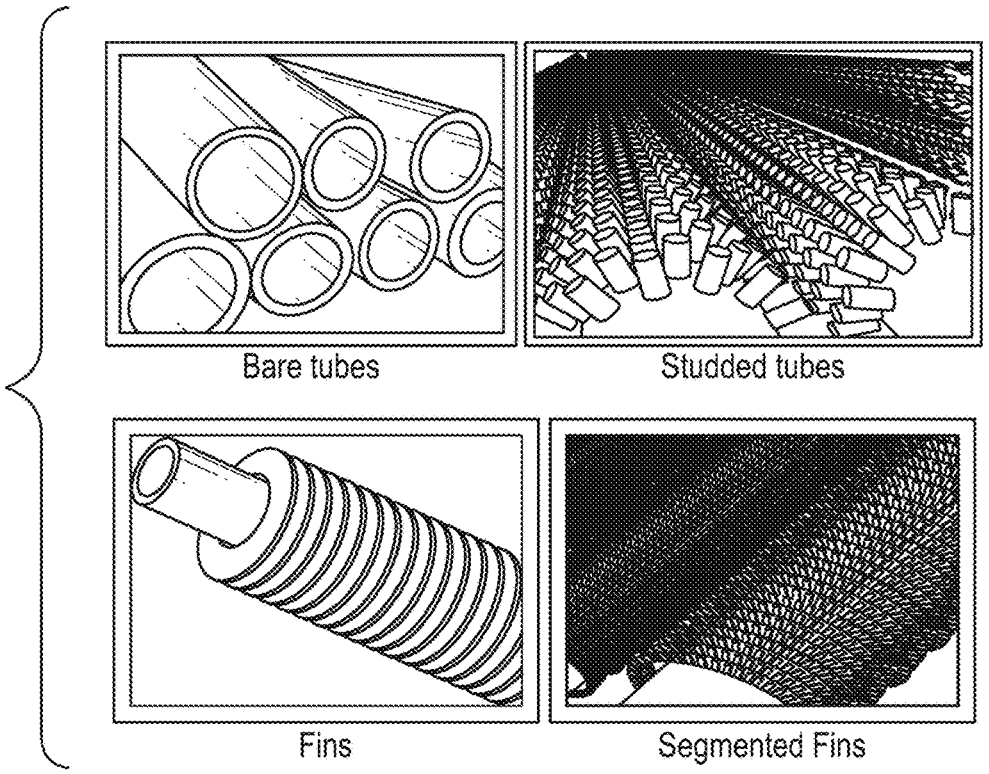
FIG. 3 depicts a plurality of example process tube types.

Draft throughout the heater 102 is also be impacted based on the geometry of the heater and components thereon. For example, draft is strongly a function of heater 102 height. The taller the heater 102, the more negative the draft will be at the floor of the heater 102 to maintain the same draft level at the top of the heater 102 (normally −0.1 in $H_2O$). The components greatly impact the draft. For example, FIG. 3 depicts a plurality of process tube types. The convection section process tubes 106 may or may not have heat sink fins thereon to manage the heat transfer from the thermal energy 112 to the process tube 106. These convection section fins may plug or corrode overtime-varying the required draft within a heater as compared to the designed draft for the same heater with the same components. As the convection section flue gas channel open area begins to decrease, a greater pressure differential is required to pull the same quantity of flue gas through the convection section.

Referring to FIG. 1, pressure (indicating draft) within the heater 102 is measured at a variety of locations in the heater respectively via one of a plurality of pressure sensors. Floor pressure sensor 126(1) measures the pressure at the floor of the heater 102. Arch pressure sensor 126(2) measures the pressure at the arch of the heater 102 where the radiant section 113 transitions to the convection section 114. Convection pressure sensor 127 measures the pressure of the convection section 114. Stack pressure sensor 129, if included, measures the pressure of the stack 116.

The pressure sensors 126, 127, 129 may include a manometer, or a Magnehelic draft gauge, where the pressure readings are manually entered into process controller 128 (or a handheld computer and then transferred wirelessly or via wired connection from the handheld computer to the process controller 128) including a sensor database 130 therein storing data from various components associated with the heater 102. The pressure sensors 126, 127, 129 may also include electronic pressure sensors and/or draft transmitters that transmit the sensed pressure to the process controller 128 via a wired or wireless connection 133. The wireless or wired connection 133 may be any communication protocol, including WiFi, cellular, CAN bus, etc.

The process controller 128 is a distributed control system (DCS) (or plant control system (PLC) used to control various systems throughout the system 100, including fuel-side control (e.g., control of components associated with getting fuel source 108 into the heater 102 for combustion therein), air-side control (e.g., control of components associated with getting air source 110 into the heater 102), internal combustion-process control (e.g., components associated with managing production of the thermal energy 112, such as draft within the heater 102), and post-combustion control (e.g., components associated with managing the emissions after production of the thermal energy 112 through the stack 116). The process controller 128 typically includes many control loops, in which autonomous controllers are distributed throughout the system 100 (associated with individual or multiple components thereof), and including a central operator supervisory control.

Figure 4:
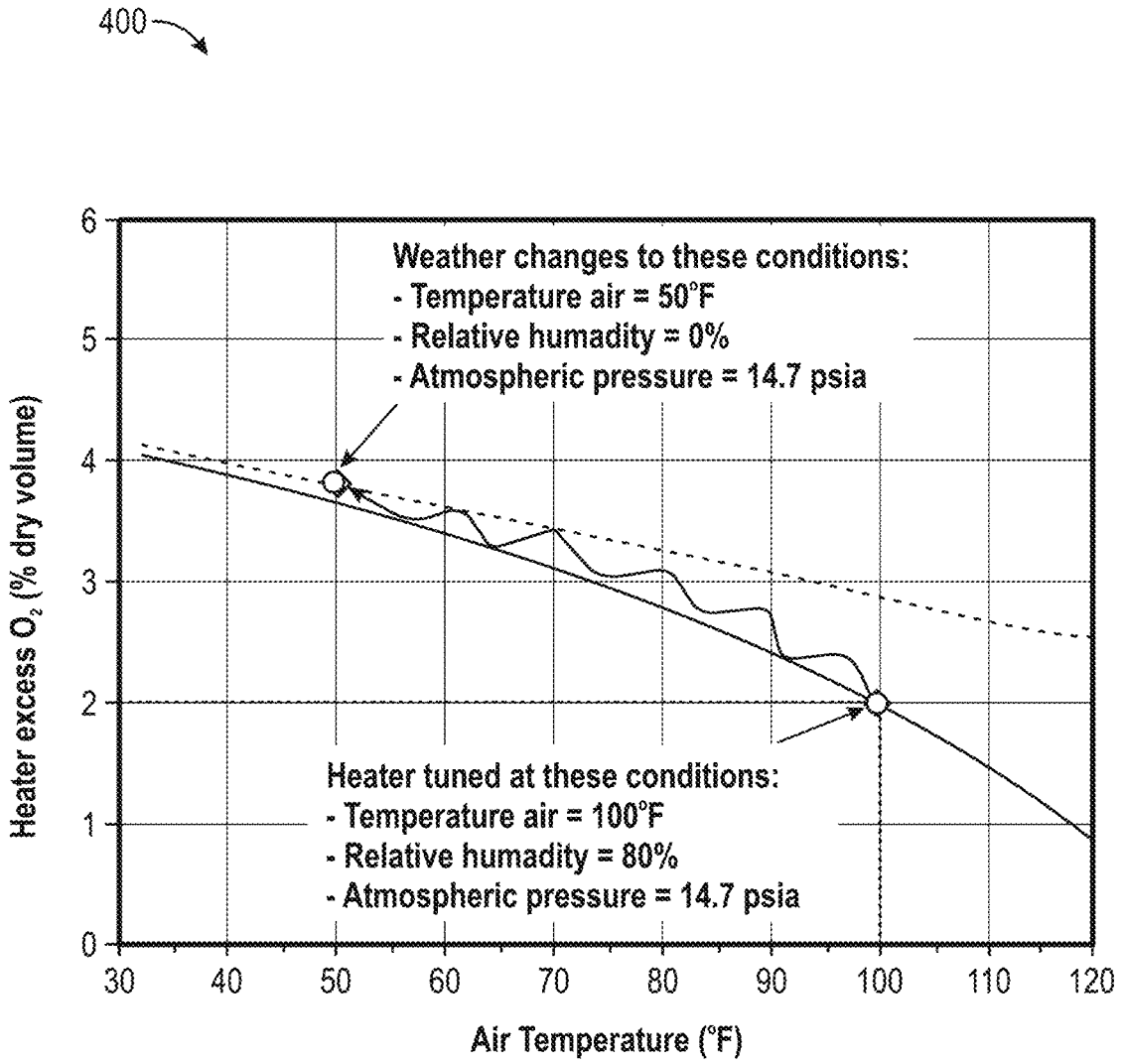
FIG. 4 depicts a diagram showing air temperature and humidity effects on sensed excess $O_2$ levels.

Operating conditions within the heater 102 (such as draft, and the stoichiometry associated with creating the thermal energy 112) are further impacted via atmospheric conditions, such as wind, wind direction, humidity, ambient air temperature, sea level, etc. FIG. 4 depicts a diagram 400 showing air temperature and humidity effects on sensed excess $O_2$ levels. The changes in operating conditions are often controlled by monitoring and manipulating the draft conditions within the heater 102. The stack dampers 118 are commonly digitally controlled, and therefore often controllable from the operating room of the system 100, via the process controller 128. However, many systems do not include burner air registers 120 that are digitally controlled. Because of this, system operators often control draft within the heater 102 using just an electronic stack damper (e.g., stack damper 118) thereby avoiding timely and costly manual operation of each burner air register (e.g., burner air register 120) associated with each individual burner (e.g., burner 104). This cost grows depending on the number of burners located in each heater—each heater may have over 100 burners therein.

Figure 5:
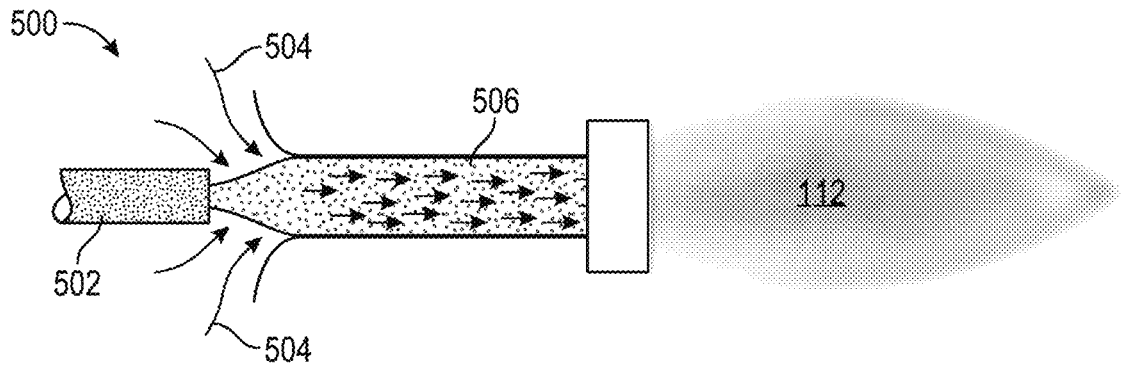
FIG. 5 depicts a schematic of air and fuel mixture in a pre-mix burner, in embodiments.
Figure 6:
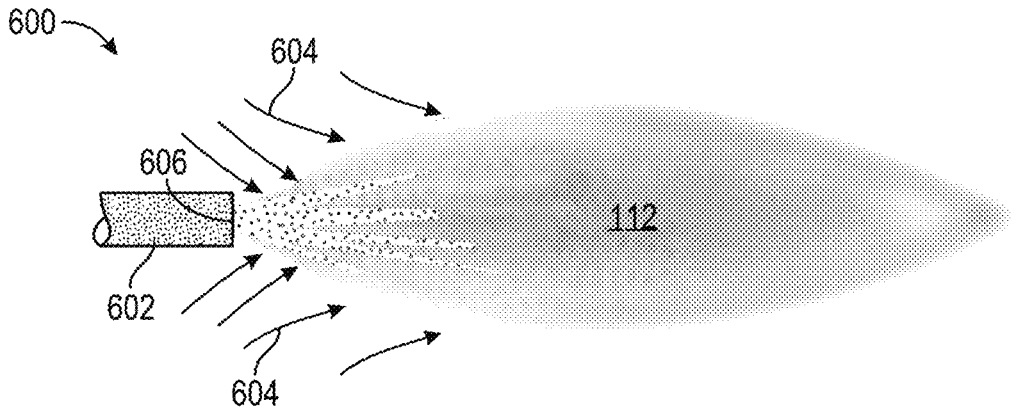
FIG. 6 depicts a schematic of air and fuel mixture in a diffusion burner, in embodiments.

In addition to the draft as discussed above, burner geometry plays a critical role in managing the thermal energy 112 produced in the heater 102. Each burner 104 is configured to mix the fuel source 108 with the air source 110 to cause combustion and thereby create the thermal energy 112. Common burner types include pre-mix burners and diffusion burners. FIG. 5 depicts a schematic 500 of air and fuel mixture in a pre-mix burner, in embodiments. In a pre-mix burner, kinetic energy of the fuel gas 502 draws some primary air 504 needed for combustion into the burner. The fuel and air mix to create an air/fuel mixture 504 having a specific air-to-fuel ratio prior to igniting to create the thermal energy 112. FIG. 6 depicts a schematic 600 of air and fuel mixture in a diffusion burner, in embodiments. In a diffusion burner, air 604 for combustion is drawn (by induced- or natural-draft) or pushed (by forced-, or balanced-draft) into the heater before mixing with the fuel 602. The mixture burns at the burner gas tip 606.

Figure 7:
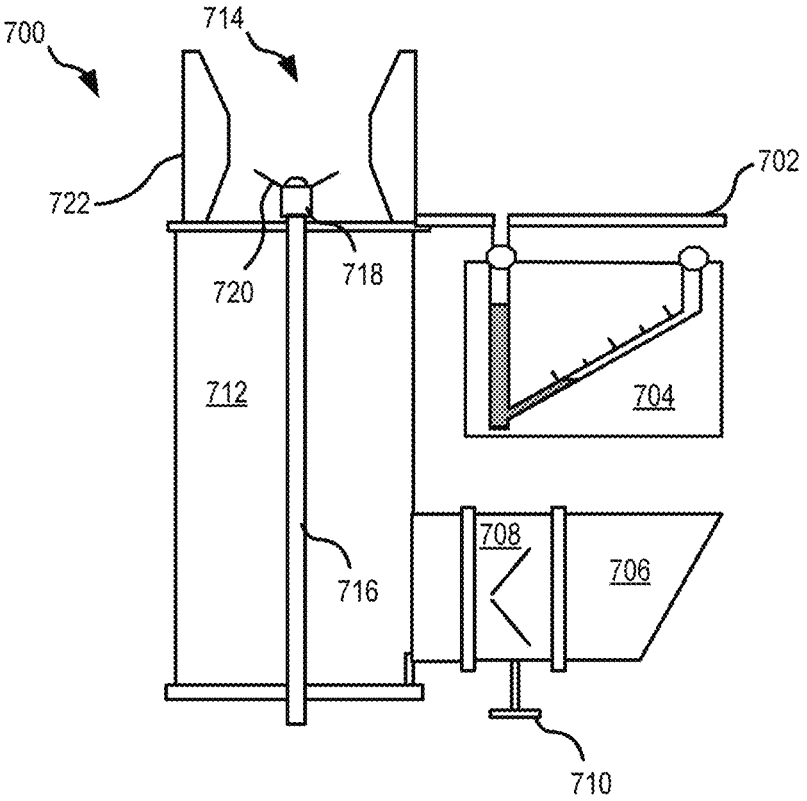
FIG. 7 depicts an example cutaway diagram of a burner, which is an example of the burner of FIG. 1.
Figure 8:
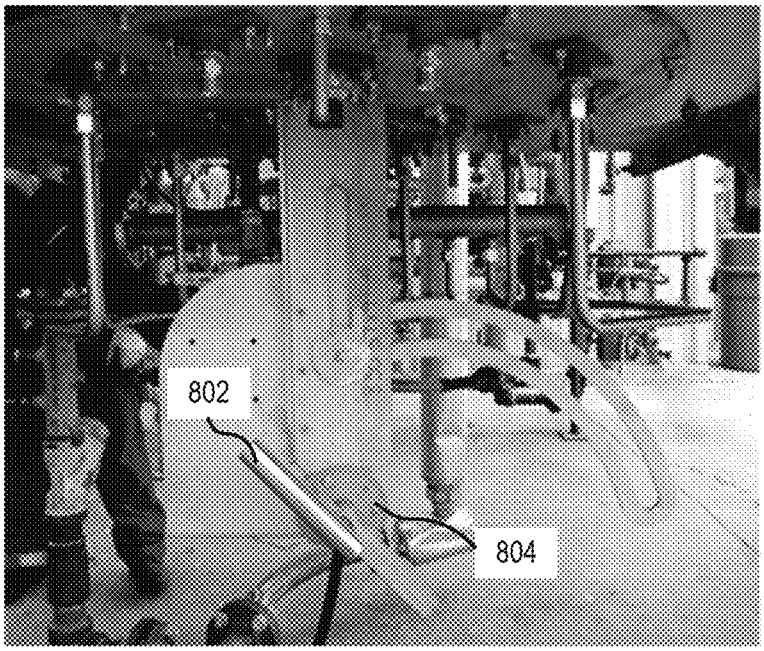
FIG. 8 depicts an example air register handle and indicator plate 804 that is manually controlled.

FIG. 7 depicts an example cutaway diagram of a burner 700, which is an example of the burner 104 of FIG. 1. Burner 700 is an example of a diffusion burner. Burner 700 is shown located mounted in a heater at the heater floor 702. Proximate the burner 700 in the heater floor 702 is a manometer 704, which is an example of the pressure sensors 126, 127, 129 discussed above. The manometer 704 may be another type of pressure sensor without departing from the scope hereof. Burner 700 is shown for a natural or induced-draft heater system, and includes a muffler 706 and a burner air register 708. Ambient air flows through the muffler 706 from outside the heater system. In a forced or balanced-draft system, the muffler 706 may not be included and instead be replaced with an intake ducting from the forced fan (e.g., forced fan 124 in FIG. 1). The burner air register 708 is an example of the burner air register 120 discussed above with respect to FIG. 1, and may be manipulated via an air register handle 710 to one of a plurality of settings defining how open or closed the air register 708 is. As discussed above, the air register handle 710 is typically manually controlled (although sometimes is fitted with an actuator, or provided with mechanical linkage and an actuator so a single actuator manipulates a plurality of burners). FIG. 8 depicts an example air register handle 802 and indicator plate 804 that is manually controlled. The input air then travels through the burner plenum 712 towards the burner output 714 where it is mixed with input fuel and ignited to combust and produce thermal energy (e.g., thermal energy 112 of FIG. 1).

Figure 9:
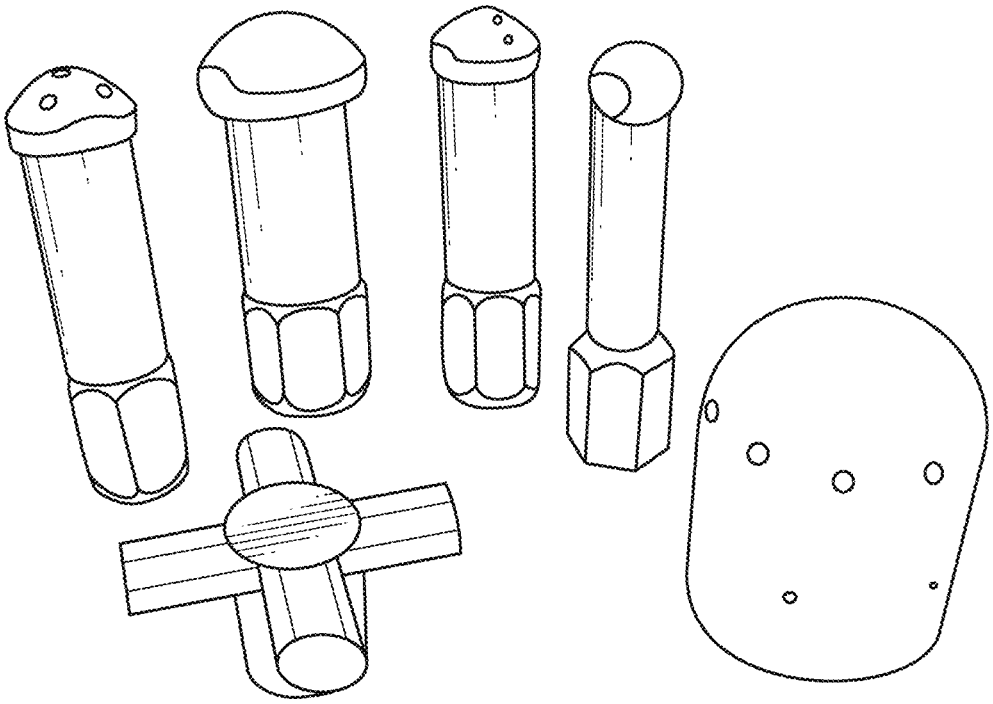
FIG. 9 depicts example burner tips with different shapes and sizes.
Figure 10:
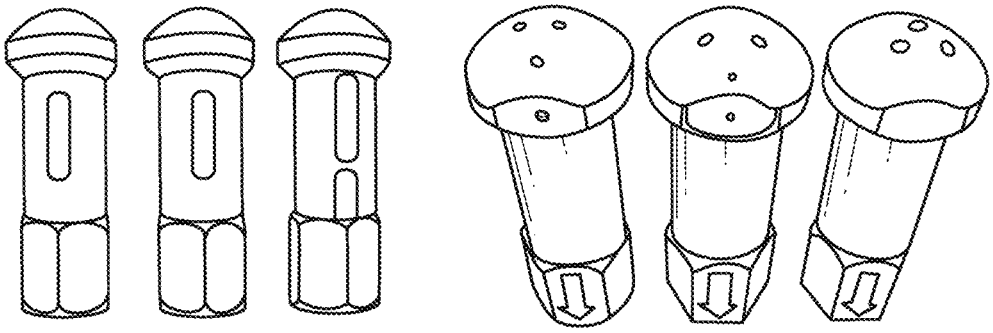
FIG. 10 depicts example burner tips with the same shape, but different drill hole configurations.

The fuel travels through a fuel line 716, and is output at a burner tip 718. The fuel may be disbursed on a deflector 720. The burner tip 718 and deflector 720 may be configured with a variety of shapes, sizes, fuel injection holes, etc. to achieve the desired combustion results (e.g., flame shaping, emissions tuning, etc.). FIG. 9 depicts example burner tips with different shapes and sizes. FIG. 10 depicts example burner tips with the same shape, but different drill hole configurations. Furthermore, one or more tiles 722 may be included at the burner output 714 to achieve a desired flame shape or other characteristic.

Referring to FIG. 1, control of the system 100 occurs both manually and digitally. As discussed above, various components, such as burner air register 120 are commonly manually controlled. However, the system 100 also includes a variety of sensors throughout the heater 102, the fuel-side input, and the air-side input used to monitor and control the system using the process controller 128.

At the stack 116, an oxygen sensor 132, a carbon monoxide sensor 134, and $NO_x$ sensor 136 can be utilized to monitor the condition of the exhaust and emissions leaving the heater 102 via the stack 116. Each of the oxygen sensor 132, carbon monoxide sensor 134, and NOx sensor 136 may be separate sensors, or part of a single gas-analysis system. The oxygen sensor 132, carbon monoxide sensor 134, and $NO_x$ sensor 136 are each operatively coupled to the process controller 128 via a wired or wireless communication link These sensors indicate the state of combustion in the heater 102 in substantially real-time. Data captured by these sensors is transmitted to the process controller 128 and stored in the sensor database 130. By monitoring the combustion process represented by at least one of the oxygen sensor 132, carbon monoxide sensor 134, and $NO_x$ sensor 136, the system operator may adjust the process and combustion to stabilize the heater 102, improve efficiency, and/or reduce emissions. In some examples, other sensors, not shown, can be included to monitor other emissions (e.g., combustibles, methane, sulfur dioxide, particulates, carbon dioxide, etc.) on a real-time basis to comply with environmental regulations and/or add constraints to the operation of the process system. Further, although the oxygen sensor 132, carbon monoxide sensor 134, and $NO_x$ sensor 136 are shown in the stack 116, there may be additional oxygen sensor(s), carbon monoxide sensor(s), and $NO_x$ sensor(s) located elsewhere in the heater 102, such as at one or more of the convection section 114, radiant section 113, and/or arch of the heater 102. The above discussed sensors in the stack section may include a flue gas analyzer (not shown) prior to transmission to the process controller 128 that extract, or otherwise test, a sample of the emitted gas within the stack 116 (or other section of the heater) and perform an analysis on the sample to determine the associated oxygen, carbon monoxide, or $NO_x$ levels in the sample (or other analyzed gas). Other types of sensors include tunable laser diode absorption spectroscopy (TDLAS) systems that determine the chemical composition of the gas based on laser spectroscopy.

Flue gas temperature may also be monitored by the process controller 128. To monitor the flue gas temperatures, the heater 102 may include one or more of a stack temperature sensor 138, a convection sensor temperature sensor 140, and a radiant temperature sensor 142 that are operatively coupled to the process controller 128. Data from the temperature sensors 138, 140, 142 are transmitted to the process controller 128 and stored in the sensor database 130. Further, each section may have a plurality of temperature sensors—in the example of FIG. 1, there are three radiant section temperature sensors 142(1)-(3). The above discussed temperature sensors may include a thermocouple, suction pyrometer, and/or laser spectroscopy analysis systems that determine the temperature associated with the given temperature sensor.

The process controller 128 may further monitor air-side measurements and control airflow into the burner 104 and heater 102. Air-side measurement devices include an air temperature sensor 144, an air-humidity sensor 146, a pre-burner air register air pressure sensor 148, and a post-burner air register air pressure sensor 150. In embodiments, the post-burner air pressure is determined based on monitoring excess oxygen readings in the heater 102. The air-side measurement devices are coupled within or to the air-side ductwork 151 to measure characteristics of the air flowing into the burner 104 and heater 102. The air-temperature sensor 144 may be configured to sense ambient air temperatures, particularly for natural and induced-draft systems. The air-temperature sensor 144 may also be configured to detect air temperature just prior to entering the burner 104 such that any pre-heated air from an air-preheat system is taken into consideration by the process controller 128. The air-temperature sensor 144 may be a thermocouple, suction pyrometer, or any other temperature measuring device known in the art. The air humidity sensor 146 may be a component of the air temperature sensor, or may be separate therefrom, and is configured to sense the humidity in the air entering the burner 104. The air temperature sensor 144 and air humidity sensor 146 may be located upstream or downstream from the burner air register 120 without departing from the scope hereof. The pre-burner air register air pressure sensor 148 is configured to determine the air pressure before the burner air register 120. The post-burner air register air pressure sensor 150 is configured to determine the air pressure after the burner air register 120. The post-burner air register air pressure sensor 150 may not be a sensor measuring the furnace draft at the burner elevation, or other elevation and then calculated to determine the furnace draft at the burner elevation. Comparisons between the post-burner air register air pressure sensor 150 and the pre-burner air register air pressure sensor 148 may be made by the process controller to determine the pressure drop across the burner 104, particularly in a forced-draft or balanced-draft system. Air-side and temperature measurements discussed herein may further be measured using one or more TDLAS devices 147 located within the heater 102 (at any of the radiant section 113, convection section 114, and/or stack 116).

Burner 104 operational parameters may further be monitored using a flame scanner 149. Flame scanners 149 operate to analyze frequency oscillations in ultraviolet and/or infrared wavelengths of one or both of the main burner flame or the burner pilot light.

FIG. 1 also shows an air-handling damper 152 that is located prior to the burner air register 120. The air-handling damper 152 includes any damper that impacts air-flow into the heater 102, such as a duct damper, variable speed fan, fixed-speed fan with air throttling damper, etc.) In certain system configurations, a single air input (including a given fan 124) supplies air to a plurality of burners, or a plurality of zones within a given heater. There may be any number of fans (e.g., forced fan 124), temperature sensors (e.g., air temperature sensor 144), air humidity sensors (e.g., air humidity sensor 146), air pressure sensors (e.g., pre-burner air register air pressure sensor 148) for a given configuration. Further, any of these air-side sensors maybe located upstream or downstream from the air-handling damper 152 without departing form the scope hereof.

The process controller 128 may further monitor fuel-side measurements and control fuel flow into the burner 104. Fuel-side measurement devices include one or more of flow sensor 154, fuel temperature sensor 156, and fuel-pressure sensor 158. The fuel-side measurement devices are coupled within or to the fuel supply line(s) 160 to measure characteristics of the fuel flowing into the burner 104. The flow sensor 154 may be configured to sense flow of the fuel through the fuel supply line 160. The fuel-temperature sensor 156 detects fuel temperature in the fuel supply line 160, and includes known temperature sensors such as a thermocouple. The fuel-pressure sensor 158 detects fuel-pressure in the fuel supply line 160.

The fuel line(s) 160 may have a plurality of fuel control valves 162 located thereon. These fuel control valves 162 operate to control the flow of fuel through the supply lines 160. The fuel control valves 162 are typically digitally controlled via control signals generated by the process controller 128. FIG. 1 shows a first fuel control valve 162(1) and a second fuel control valve 162(2). The first fuel control valve 162(1) controls fuel being supplied to all burners located in the heater 102. The second fuel control valve 162(2) controls fuel being supplied to each individual burner 104 (or a grouping of burners in each heater zone). There may be more or fewer fuel control valves 162 without departing from the scope hereof. Further, as shown, there may be a grouping of fuel-side measurement devices between individual components on the fuel supply line 160. For example, a first flow sensor 154(1), first fuel temperature sensor 156(1), and first fuel-pressure sensor 158(1) are located on the fuel supply line 160 between the fuel source 108 and the first fuel control valve 162(1). A second flow sensor 154(2), second fuel temperature sensor 156(2), and second fuel-pressure sensor 158(2) are located on the fuel supply line 160 between the first fuel control valve 162(1) and the second fuel control valve 162(2). Additionally, a third flow sensor 154(3), third fuel temperature sensor 156(3), and third fuel-pressure sensor 158(3) are located on the fuel supply line 160 between the second fuel control valve 162(2) and the burner 104. The third fuel temperature sensor 156(3), and third fuel-pressure sensor 158(3) may be configured to determine flow, temperature, and pressure respectively of an air/fuel mixture for pre-mix burners discussed above with respect to FIG. 5.

The process controller 128 may also measure process-side temperatures associated with the processes occurring within the process tubes 106. For example, system 100 may further include one or more tube temperature sensors 168, such as a thermocouple, that monitor the temperature of the process tubes 106. The temperature sensor 168 may also be implemented using optical scanning technologies, such as an IR camera, and/or one of the TDLAS devices 147. Furthermore, the heater controller 128 may also receive sensed outlet temperature of the fluid within the process tubes 106 from process outlet temperature sensor (not shown), such as a thermocouple. The process controller 128 may then use these sensed temperatures (from the tube temperature sensors 168 and/or the outlet temperature sensor) to control firing rate of the burners 104 to increase or decrease the generated thermal energy 112 to achieve a desired process temperature.

Figure 11:
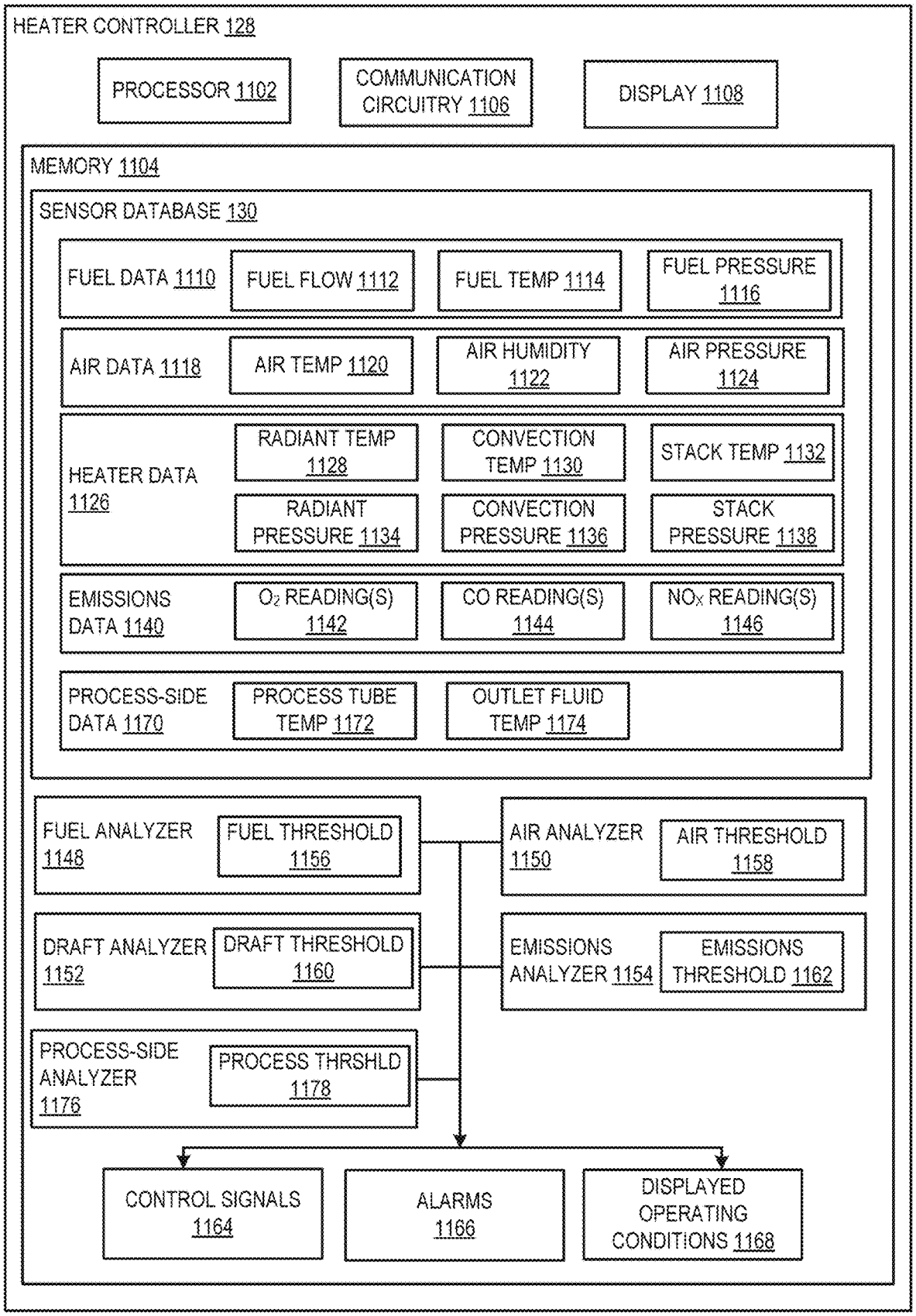
FIG. 11 depicts a block diagram of the heater controller of FIG. 1 in further detail, in embodiments.

FIG. 11 depicts a block diagram of the process controller 128 of FIG. 1 in further detail, in embodiments. The process controller 128 includes a processor 1102 communicatively coupled with memory 1104. The processor 1102 may include a single processing device or a plurality of processing devices operating in concert. The memory 1104 may include transitory and or non-transitory memory that is volatile and/or non-volatile.

The process controller 128 may further include communication circuitry 1106 and a display 1108. The communication circuitry 1106 includes wired or wireless communication protocols known in the art configured to receive and transmit data from and to components of the system 100. The display 1108 may be co-located with the process controller 128, or may be remote therefrom and displays data about the operating conditions of the heater 102 as discussed in further detail below.

Memory 1104 stores the sensor database 130 discussed above, which includes any one or more of fuel data 1110, air data 1118, heater data 1126, emissions data 1140, process-side data 1170, and any combination thereof. In embodiments, the sensor database 130 includes fuel data 1110. The fuel data 1110 includes fuel flow 1112, fuel temperature 1114, and fuel-pressure 1116 readings throughout the system 100 regarding the fuel being supplied to the burner 104. For example, the fuel flow data 1112 includes sensed readings from any one or more of the flow sensor(s) 154 in system 100 transmitted to the process controller 128. The fuel temperature data 1114 includes sensed readings from any one or more of the fuel temperature sensor(s) 156 in system 100 transmitted to the process controller 128. The fuel-pressure data 1116 includes sensed readings from any one or more of the fuel-pressure sensor(s) 158 in system 100 transmitted to the process controller 128. In embodiments, the fuel data 1110 may further include fuel composition information that is either sensed via a sensor located at the fuel source 108 or that is determined based on an inferred fuel composition such as that discussed in U.S. Provisional No. 62/864,954, filed Jun. 21, 2019 and which is incorporated by reference as if set forth in its entirety. The fuel data 1110 may also include data regarding other fuel-side sensors not necessarily shown in FIG. 1, but known in the art.

In embodiments, the sensor database 130 includes air data 1118 regarding the air being supplied to the burner 104 and heater 102. The air data 1118 includes air temperature data 1120, air humidity data 1122, and air pressure data 1124. The air temperature data 1120 includes sensed readings from any one or more of the air temperature sensor(s) 144 in system 100 transmitted to the process controller 128. The air humidity data 1122 includes sensed readings from any one or more of the air humidity sensor(s) 146 in system 100, and/or data from local weather servers, transmitted to the process controller 128. The air pressure data 1124 includes sensed readings from any one or more of the pre-burner air register air pressure sensor 148, and a post-burner air register air pressure sensor 150 (or any other air pressure sensor) in system 100 transmitted to the process controller 128. The air data 1118 may also include data regarding other air-side sensors not necessarily shown in FIG. 1, but known in the art.

In embodiments, the sensor database 130 includes heater data 1126. The heater data 1126 includes radiant-section temperature data 1128, convection-section temperature data 1130, stack-section temperature data 1132, radiant-section pressure data 1134, convection-section pressure data 1136, and stack-section pressure data 1138. The radiant-section temperature data 1128 includes sensed readings from the radiant temperature sensor(s) 142 of system 100 that are transmitted to the process controller 128. The convection-section temperature data 1130 includes sensed readings from the convection temperature sensor(s) 140 of system 100 that are transmitted to the process controller 128. The stack-section temperature data 1132 includes sensed readings from the stack temperature sensor(s) 138 of system 100 that are transmitted to the process controller 128. The radiant-section pressure data 1134 includes sensed readings from the radiant pressure sensor(s) 126 of system 100 that are transmitted to the process controller 128. The convection-section pressure data 1136 includes sensed readings from the convection pressure sensor(s) 127 of system 100 that are transmitted to the process controller 128. The stack-section pressure data 1136 includes sensed readings from the stack pressure sensor(s) 129 of system 100 that are transmitted to the process controller 128. The heater data 1126 may also include data regarding other heater sensors not necessarily shown in FIG. 1, but known in the art.

In embodiments, the sensor database 130 further includes emissions data 1140. The emissions data 1140 includes $O_2$ reading(s) 1142, CO reading(s) 1144, and $NO_x$ reading(s) 1146. The $O_2$ reading(s) 1142 include sensed readings from the oxygen sensor 132 transmitted to the process controller 128. The CO reading(s) 1144 include sensed readings from the carbon monoxide sensor 134 transmitted to the process controller 128. The NOx reading(s) 1146 include sensed readings from the $NO_x$ sensor 136 transmitted to the process controller 128. The emissions data 1140 may also include data regarding other emissions sensors not necessarily shown in FIG. 1, but known in the art.

In embodiments, the sensor database 130 includes process-side data 1170 regarding the conditions of the process tubes 106 and the process occurring. The process-side data 1170 includes process tube temperature 1172, and the outlet fluid temperature 1174. The process tube temperature 1172 may include data captured by the process tube temperature sensor 168, discussed above. The outlet fluid temperature 1174 may include data captured by an outlet fluid sensor (not shown), such as a thermocouple. The process-side data 1170 may also include data regarding other process-side sensors not necessarily shown in FIG. 1, but known in the art.

Data within the sensor database 130 is indexed according to the sensor providing said readings. Accordingly, data within the sensor database 130 may be used to provide real-time operating conditions of the system 100.

The memory 1104, in embodiments, further includes one or more of a fuel analyzer 1148, an air analyzer 1150, a draft analyzer 1152, an emissions analyzer 1154, a process-side analyzer 1176, and any combination thereof. Each of the fuel analyzer 1148, air analyzer 1150, draft analyzer 1152, emissions analyzer 1154, and process-side analyzer 1176 comprise machine readable instructions that when executed by the processor 1102 operate to perform the functionality associated with each respective analyzer discussed herein. Each of the fuel analyzer 1148, air analyzer 1150, draft analyzer 1152, emissions analyzer 1154, and process-side analyzer 1176 may be executed in serial or parallel to one another.

The fuel analyzer 1148 operates to compare the fuel data 1110 against one or more fuel alarm thresholds 1156. One common fuel alarm threshold 1156 includes fuel-pressure threshold that sets a safe operation under normal operating condition without causing nuisance shutdowns of the system 100 due to improperly functioning burner 104 caused by excess or low fuel-pressure. The fuel alarm thresholds 1156 are typically set during design of the system 100. The fuel analyzer 1148 may analyze other data within the sensor database 130 not included in the fuel data 1110, such as any one or more of air data 1118, heater data 1126, emissions data 1140, process-side data 1170, and any combination thereof to ensure there is appropriate air to fuel ratio within the heater to achieve the stoichiometric conditions for appropriate generation of the thermal energy 112.

The air analyzer 1150 operates to compare the air data 1118 against one or more air alarm thresholds 1158. One common air alarm threshold 1158 includes fan operating threshold that sets a safe operation condition of the forced fan 124 and/or stack fan 122 under normal operating condition without causing nuisance shutdowns of the system 100 due to improper draft within the heater 102 caused by excess or low air pressure throughout the system 100. The air alarm thresholds 1158 are typically set during design of the system 100. The air analyzer 1150 may analyze other data within the sensor database 130 not included in the air data 1118, such as any one or more of fuel data 1110, heater data 1126, emissions data 1140, process-side data 1170, and any combination thereof to ensure there is appropriate air to fuel ratio within the heater to achieve the stoichiometric conditions for appropriate generation of the thermal energy 112.

The draft analyzer 1152 operates to compare the heater data 1126 against one or more draft alarm thresholds 1160. One common draft alarm threshold 1160 includes heater pressure threshold that sets safe operation conditions of the heater 102 under normal operating condition without causing nuisance shutdowns or dangerous conditions of the system 100 due to positive pressure within the heater 102 (such as at the arch of the heater 102). The draft alarm thresholds 1160 are typically set during design of the system 100. The draft analyzer 1152 may analyze other data within the sensor database 130 not included in the heater data 1126, such as any one or more of fuel data 1110, air data 1118, emissions data 1140, process-side data 1170, and any combination thereof to ensure there is appropriate operating conditions within the heater 102 to achieve the stoichiometric conditions for appropriate generation of the thermal energy 112.

The emissions analyzer 1154 operates to compare the emissions data 1140 against one or more emission alarm thresholds 1162. One emissions alarm threshold 1162 include a minimum and maximum excess oxygen level that sets safe operation conditions of the heater 102 under normal operating condition without causing nuisance shutdowns or dangerous conditions of the system 100 due to too little or too much oxygen within the heater 102 during creation of the thermal energy 112. Other emission alarm thresholds 1162 include pollution limits set by environmental guidelines associated with the location in which system 100 is installed. The emission alarm thresholds 1162 are typically set during design of the system 100. The emissions analyzer 1154 may analyze other data within the sensor database 130 not included in the emissions data 1140, such as any one or more of fuel data 1110, air data 1118, heater data 1126, process-side data 1170, and any combination thereof to ensure there is appropriate operating conditions within the heater 102 to achieve the stoichiometric conditions for appropriate generation of the thermal energy 112.

The process-side analyzer 1176 operates to compare the process-side data 1170 against one or more process thresholds 1178. One common process threshold 1178 includes a desired outlet temperature to achieve efficient process conversion in the process tubes 106. Another example process threshold 1178 includes a maximum temperature threshold of the process tube 106 at which the process tube 106 is unlikely to fail. The process-side analyzer 1176 may analyze other data within the sensor database 130 not included in the process-side data 1170, such as any one or more of fuel data 1110, air-data 1118, heater data 1126, emissions data 1140, and any combination thereof to ensure there is appropriate air to fuel ratio within the heater to achieve the stoichiometric conditions for appropriate generation of the thermal energy 112.

The fuel analyzer 1148, the air analyzer 1150, the draft analyzer 1152, the emissions analyzer 1154, and the process-side analyzer 1176 operate to create one or more of control signals 1164, alarms 1166, and displayed operating conditions 1168. The control signals 1164 include signals transmitted from the process controller 128 to one or more components of the system 100, such as the dampers 118, air registers 120 (if electrically controlled), fans 122, 124, and valves 162. The alarms 1166 include audible, tactile, and visual alarms that are generated in response to tripping of one or more of the fuel alarm threshold 1156, air alarm threshold 1158, draft alarm threshold 1160, and emission alarm threshold 1162. The displayed operating conditions 1168 include information that is displayed on the display 1108 regarding the data within the sensor database 130 and the operating conditions analyzed by one or more of the fuel analyzer 1148, air analyzer 1150, draft analyzer 1152, emissions analyzer 1154, and process-side analyzer 1176.

Referring to FIG. 1, one or more of the fuel analyzer 1148, the air analyzer 1150, the draft analyzer 1152, the emissions analyzer 1154 and the process-side analyzer 1176 may be entirely or partially implemented on an external server 164. The external server 164 may receive some or all of the data within the sensor database 130 and implement specific algorithms within each of the fuel analyzer 1148, the air analyzer 1150, the draft analyzer 1152, the emissions analyzer 1154 and the process-side analyzer 1176. In response, the external server 164 may transmit one or more of the control signals 1164, the alarms 1166, and/or the displayed operating conditions 1168 back to the process controller 128.

Automatic Adjustment of Safety Settings

The present disclosure acknowledges that, because conservative assumptions are made during design of the process heater, the maximum control levels, such as the fuel-pressure trip setting, are not accurate to actual operating conditions. This causes the process heater to operate below full capacity due to the conservative constraints. As discussed in detail below, the present application solves this problem by creating a dynamic safety setting that allows the electronic control system (e.g., the heater controller 128) to reconfigure its control maximums and minimums thereby allowing significantly increased operating capacity.

Figure 12:
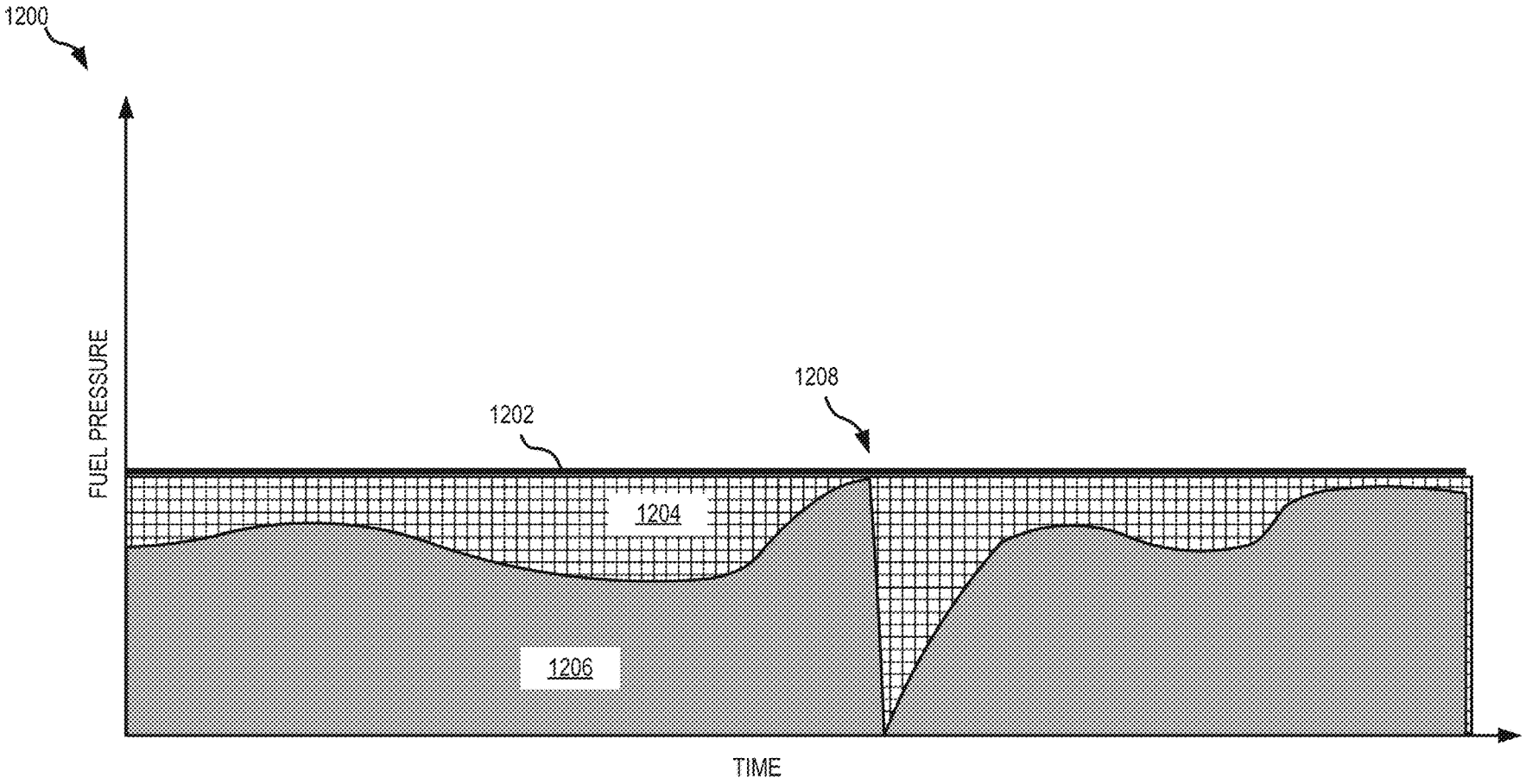
FIG. 12 depicts an example designed heater fuel-pressure operating profile, including a fuel-pressure safety trip, fuel-pressure potentially unsafe level, and fuel-pressure safe operation level, over a given year.

FIG. 12 depicts an example designed heater fuel-pressure operating profile 1200, including a fuel-pressure safety trip 1202, fuel-pressure potentially unsafe level 1204, and fuel-pressure safe operation level 1206, over a given year. The fuel-pressure safety trip 1202 defines the fuel-pressure level that, if sensed by one or more fuel-pressure sensors (e.g., fuel-pressure sensor 158), causes the heater controller 128 to generate a control signal shutting down the heater 102, or the given burner 104 associated with the tripped fuel-pressure sensor. The fuel-pressure potentially unsafe level 1204 indicates a range, or level, at which, if an operator chooses to set the high-pressure trip setting (e.g., trip 1202) at the maximum fuel pressure the operator expects to see throughout the temporal period of operating, there are operating conditions throughout the year where the burner will achieve the desired heat release at a lower fuel pressure requirement. Because the heat release illustrated in this graph is exactly the same, but at varying fuel gas pressures due to the swing in fuel gas composition, the burner could run out of air if the same fuel is fired at the fuel gas pressure maximum trip setting. The fuel-pressure operation level 1206 indicates areas of operation in which the fuel pressure achieved results in a heat release that is within the "rated heat release" of the burner, given the available burner airside pressure drop and specified air temperature and humidity conditions defined in the design phase. The modulation of the curve is simply due to changes in fuel temperature and fuel composition to achieve the maximum fired heat release of the burner. At time 1208, the system enters a shutdown situation because the operation meets the fuel-pressure safety trip 1202. This shutdown situation is very costly to the operation of the plant because it stops production according to the process occurring in the process tubes.

Figure 13:
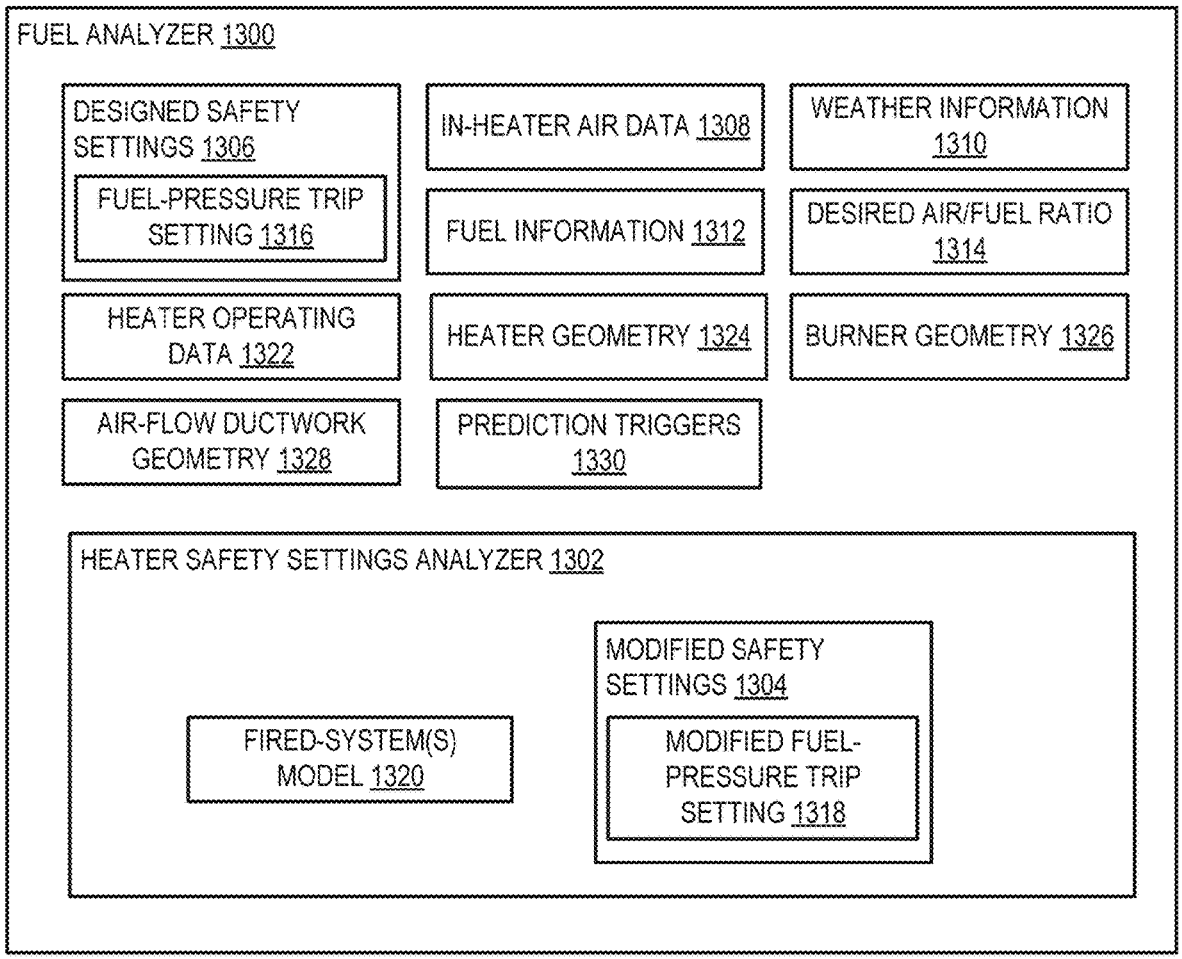
FIG. 13 depicts a fuel analyzer, which is an example of the fuel analyzer of FIG. 11, in an embodiment.

FIG. 13 depicts a fuel analyzer 1300, which is an example of the fuel analyzer 1148, of FIG. 11, in an embodiment. Fuel analyzer 1300 includes a heater safety settings analyzer 1302. Heater safety settings analyzer 1302 includes computer readable instructions that when executed by a processor (e.g., processor 1102), operate to create modified safety settings 1304 that dynamically adjust one or more designed safety settings 1306 that are pre-stored within the memory 1102 of the heater controller and associated with operation of the heater 102 or burner 104 as shown in FIG. 12.

In one embodiment, to generate the modified safety settings 1304, the heater safety settings analyzer 1302 analyzes in-heater air data 1308 to determine the actual air-flow occurring through each burner 104. The in-heater air data 1308 may include sensed pressure data from one or more of the floor pressure sensor 126(1), the arch pressure sensor 126(2), the convection pressure sensor 127, and the stack pressure sensor 129. In embodiments, the in-heater air data 1308 may also include operating characteristics of the hardware associated with air-flow within the heater 102, such as the stack damper 118, burner air register 120, the stack fan 122, and/or the forced fan 124, if included. In embodiments, the heater safety settings analyzer 1302 further determines the actual air-flow occurring in the heater 102 based on weather information 1310. The weather information 1310 may be received at the fuel analyzer 1300 from a weather server, or generated on site using one or more sensors (e.g., precipitation, humidity, barometric, and/or temperature sensors at the heater 102). The weather plays an important role in determining available air flow within the heater, as humidity levels and/or temperature levels can greatly impact the air composition and draft within the heater 102.

Once the actual air-flow occurring in the heater 102 and each individual burner 104 is known, the fuel analyzer 1302 may then, based on the fuel information 1312, determine if a desired air/fuel ratio 1314 is capable of being maintained past a designed fuel-pressure trip setting 1316 defined within the designed safety settings 1306. Prior art operation of combustion systems assumes knowledge of total air flow is going in the heater by measuring excess O2. However, unbeknownst to the combustion system operator, there may be air flow entering the heater that is not coming through the burner. The current system uses knowledge of air-flow through each burner 104 to ensure the appropriate air flow is occurring where it matters, thus allowing creation of the modified safety settings 1304.

The fuel information 1312 includes the fuel composition that is either sensed, or inferred as discussed above, and may also include other information such as expected fuel temperature and other data within fuel data 1110. If a desired air/fuel ratio 1314 is achievable above the designed fuel-pressure trip setting 1316, then the fuel analyzer 1302 may dynamically adjust the designed fuel-pressure trip setting 1316 by creating the modified safety settings 1304 having a modified fuel-pressure trip setting 1318 that is a threshold level below the maximum pressure level that maintains the desired air/fuel ratio 1314.

In embodiments, the heater safety settings analyzer 1302 may predict future available conditions in the heater 102. For example, the heater safety settings analyzer 1302 may analyze a fired-systems model 1320 of the heater 102. The fired-systems model 1320 may be for an entire combustion system (e.g., from the air-input and the fuel-input through the exit of the stack), or may be for one or more specific components within a given combustion system (such as one or more of a burner model, an air ductwork model, a model of draft within the heater, a model of heat transfer surrounding process tubes, etc.). The fired-systems model 1320 model may be based on any one or more of combustion chemistry, combustion kinetics, air and fuel fluid dynamics, heat transfer, process side modeling, computational fluid dynamics modeling, and other various types of combustion modeling. The fired-systems model 1320 is different than a CFD model used to design the heater 102 because it is updated based on heater operating data 1322, heater geometry 1324, burner geometry 1326, air-flow ductwork geometry 1328, etc.

The heater operating data 1322 includes historical data regarding the operating conditions of the heater 102, such as data captured by any of the sensors discussed above with respect to FIG. 1, and may also include the in-heater data 1308 discussed above. The burner geometry 1326 includes the number, location, and physical geometry of the burners, the burner zones within the heater, as well as burner settings for each burner, such as the controllable range of the burner air register (e.g., burner air register 120) such as the controllable range shown on indicator plate 804 in FIG. 8. The air-flow ductwork geometry 1328 includes the geometry of the airflow ductwork (e.g., ductwork 151) throughout the system 100. This includes any air-handling register (e.g., air-handling register 152), the air-flow zones, and the geometry of each of the above.

By utilizing fired-systems model 1320, the heater safety settings analyzer 1302 understands the actual operating conditions of the heater 102 and creates the modified fuel-pressure trip settings 1318. Therefore, the heater safety settings analyzer 1302 and the modified fuel-pressure trip settings 1318 created thereby are not subject to the conservative assumptions made during the design of the heater 102. Prediction using the fired-systems model 1320 may be triggered by one or more prediction triggers 1330. Prediction triggers 1330 include one or more of changes in desired operating conditions (higher firing rates or new fuel compositions), weather conditions (as identified within weather information 1310), safety settings change requests from the operator of the heater 102, and periodic safety settings checks that are pre-loaded into the fuel analyzer 1300 and cause the prediction using the fired-systems model 1320 to occur periodically such as every quarter.

Figure 14:
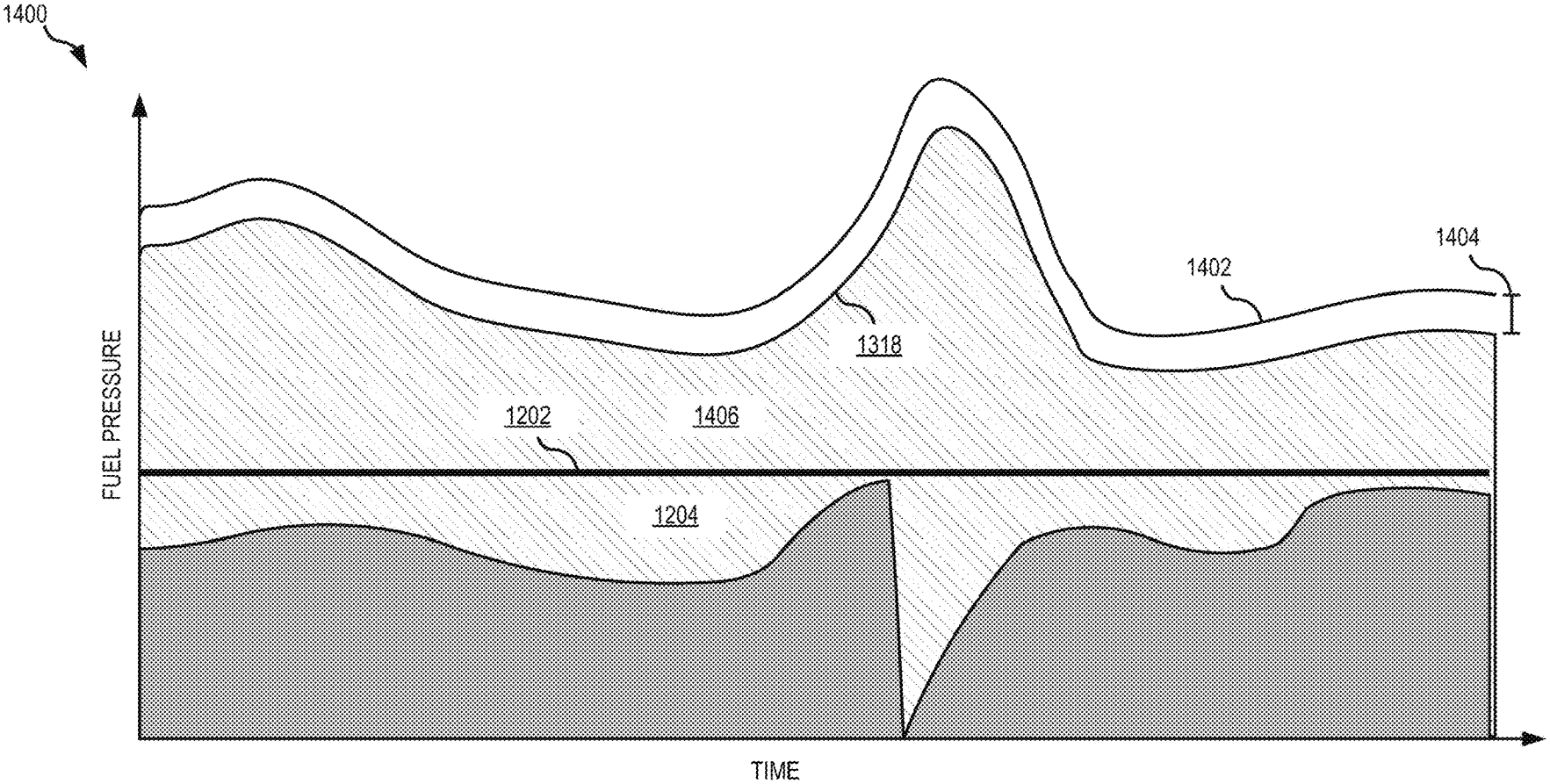
FIG. 14 depicts an example modified fuel-pressure trip setting as compared to the prior art fuel-pressure operating profile of FIG. 12, in an embodiment.

FIG. 14 depicts an example modified fuel-pressure trip setting as compared to the prior art fuel-pressure operating profile 1200 of FIG. 12, in an embodiment. As shown, the maximum pressure level 1402 that maintains the desired air/fuel ratio 1314 in actual operation is significantly higher fuel pressure than the designed fuel-pressure trip setting 1202. Therefore, the modified fuel-pressure trip setting 1318 shown in FIG. 14 is a threshold pressure level 1404 below the maximum pressure level 1404 calculated by the heater safety settings analyzer 1302. The section 1406 represents the increased firing capacity that the combustion system 100 results in. Furthermore, as shown, the combustion system does not enter into the shutdown operation, which significantly increases efficiency and productivity of the system.

Figure 15:
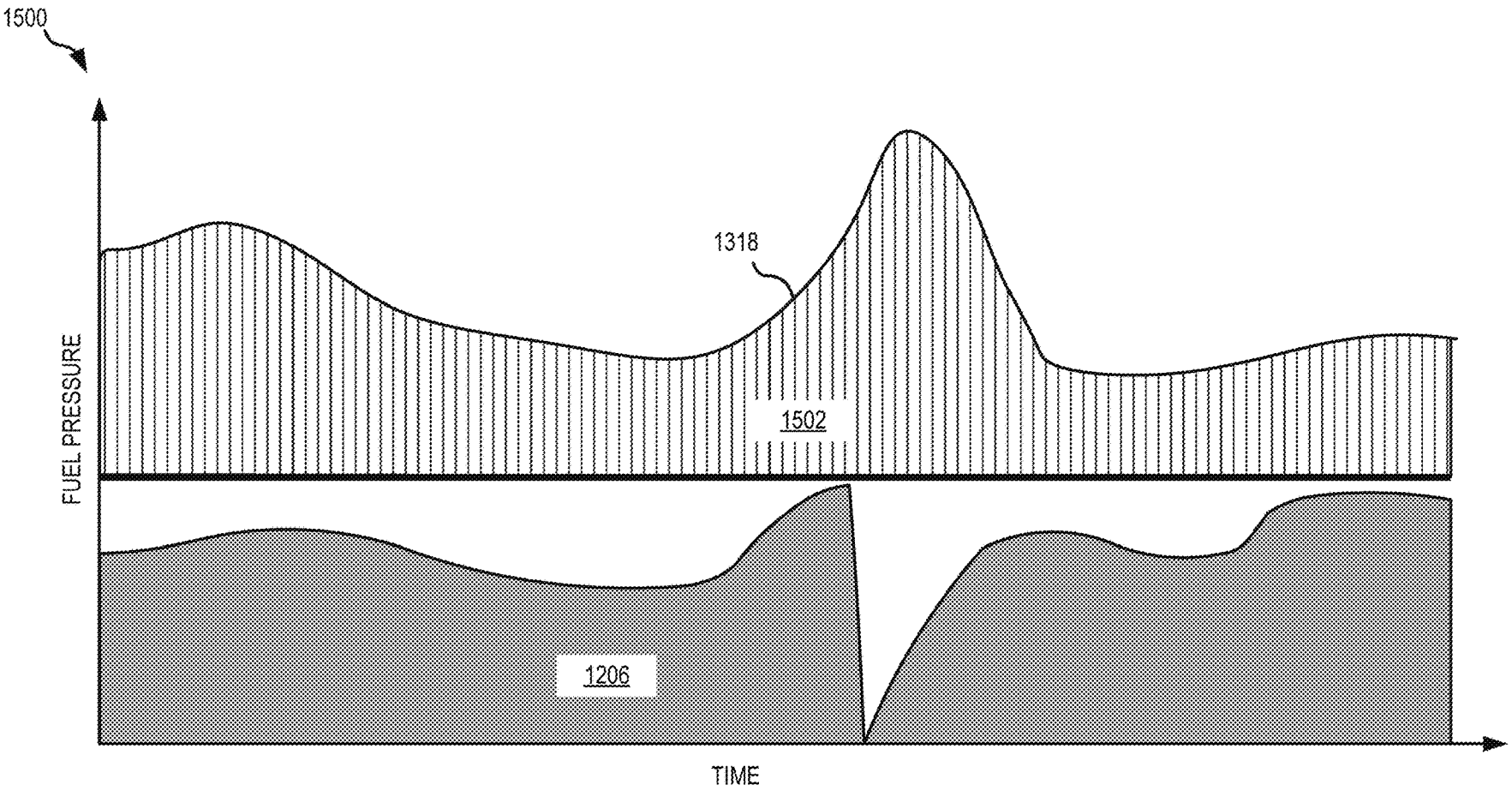
FIG. 15 depicts an example operating profile showing the increased fuel pressure capabilities provided by the modified fuel-pressure trip settings generated by the heater safety settings analyzer of FIG. 13.

FIG. 15 depicts an example operating profile 1500 showing the increased fuel pressure capabilities 1502 provided by the modified fuel-pressure trip settings 1318 generated by the heater safety settings analyzer 1302. This increase fuel pressure allows for greater thermal energy 112 within the heater 102, thereby increasing the capacity of the system. Furthermore, this eliminates the above discussed conservative specifications thereby allowing the system to operate according to hardware constraints (such as fan speed, or capable draft) as opposed to assumed (but not necessarily present) safety risks.

Figure 16:
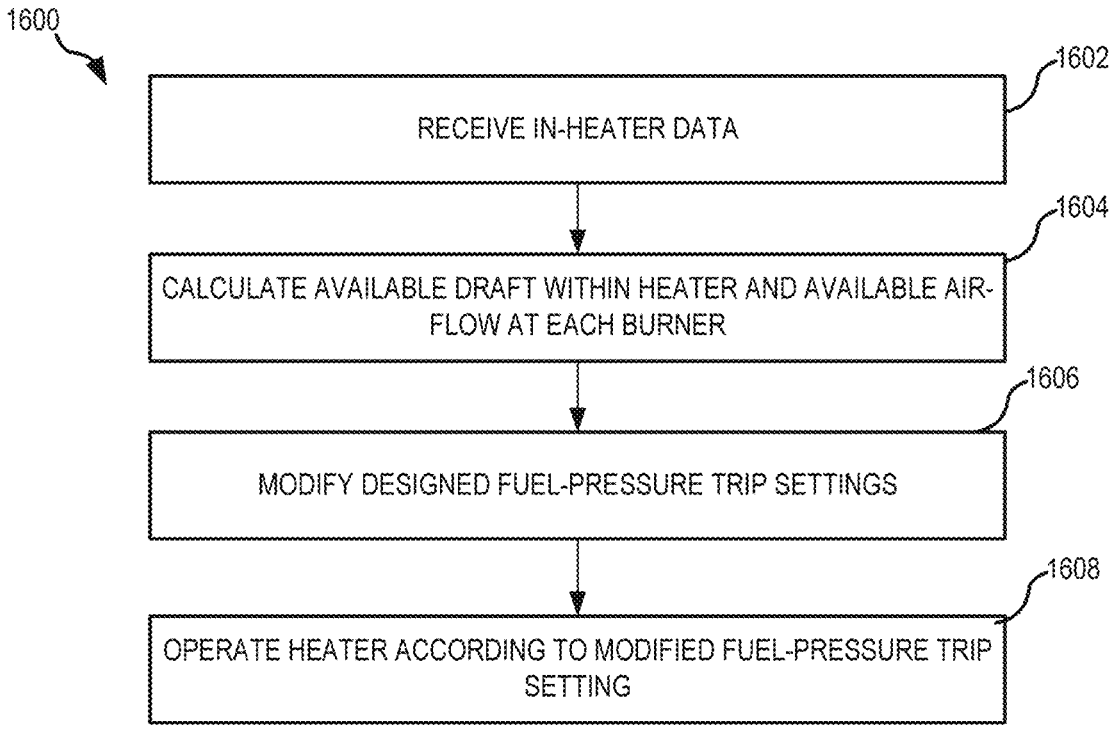
FIG. 16 depicts a method for dynamic adjustment of safety settings in a combustion heater, in an embodiment.

FIG. 16 depicts a method 1600 for dynamic adjustment of safety settings in a combustion heater, in an embodiment. Method 1600 may be performed via the system 100 discussed above in FIGS. 1-15. Particularly, method 1600 is implemented via the processor 1102 executing the computer readable instructions of the heater safety settings analyzer 1302.

In block 1602, the method 1600 receives in-heater data defining actual operating conditions of the heater. In one example of operation of block 1602, the heater safety settings analyzer 1302 receives the in-heater air data 1308 including sensed pressure data from one or more of the floor pressure sensor 126(1), the arch pressure sensor 126(2), the convection pressure sensor 127, and the stack pressure sensor 129. In an example of block 1602, the in-heater air data 1308 also includes operating characteristics of the hardware associated with air-flow within the heater 102, such as the stack damper 118, burner air register 120, the stack fan 122, and/or the forced fan 124, if included.

In block 1604, the method 1600 calculates the available air-flow to from each burner 104 (including calculating available draft within the heater in some embodiments). In one example of block 1604, the heater safety settings analyzer 1302 calculates the available air-flow through each burner 104, and, in some embodiments, draft available within the heater 102 based on the in-heater data 1308. In certain embodiments of block 1604, the heater safety settings analyzer 1302 further determines the actual air-flow occurring in the heater 102 and each specific burner 104 based additionally on weather information 1310. The weather information 1310 may be received at the fuel analyzer 1300 from a weather server, or generated on site using one or more sensors (e.g., precipitation, humidity, barometric, and/or temperature sensors at the heater 102). The embodiments calculating the draft within the heater allow the system and method to determine the air-flow at each specific burner 104 via pressure differential across the burner (e.g., based on difference between sensed pressure before the burner air register and the draft within the heater at the location of the burner).

In block 1606, the method 1600 modifies the designed fuel-pressure trip settings to create a modified fuel-pressure trip setting. In one example of block 1606, the heater safety settings analyzer 1302 creates modified fuel-pressure trip setting 1318. In certain embodiments of block 1606, the modified fuel-pressure trip setting 1318 that is a threshold level below the maximum pressure level that maintains the desired air/fuel ratio 1314 as determined by the heater safety settings analyzer 1302.

In block 1608, the method 1600 operates the heater according to the modified fuel-pressure trip setting. In one example of operation of block 1608, the heater safety settings analyzer 1302, or the heater controller 128, generates a fuel valve control signal configured to control the fuel valve 162 to open, thereby increasing fuel supply to the burner 104 and increasing generation of the thermal energy 112.

Figure 17:
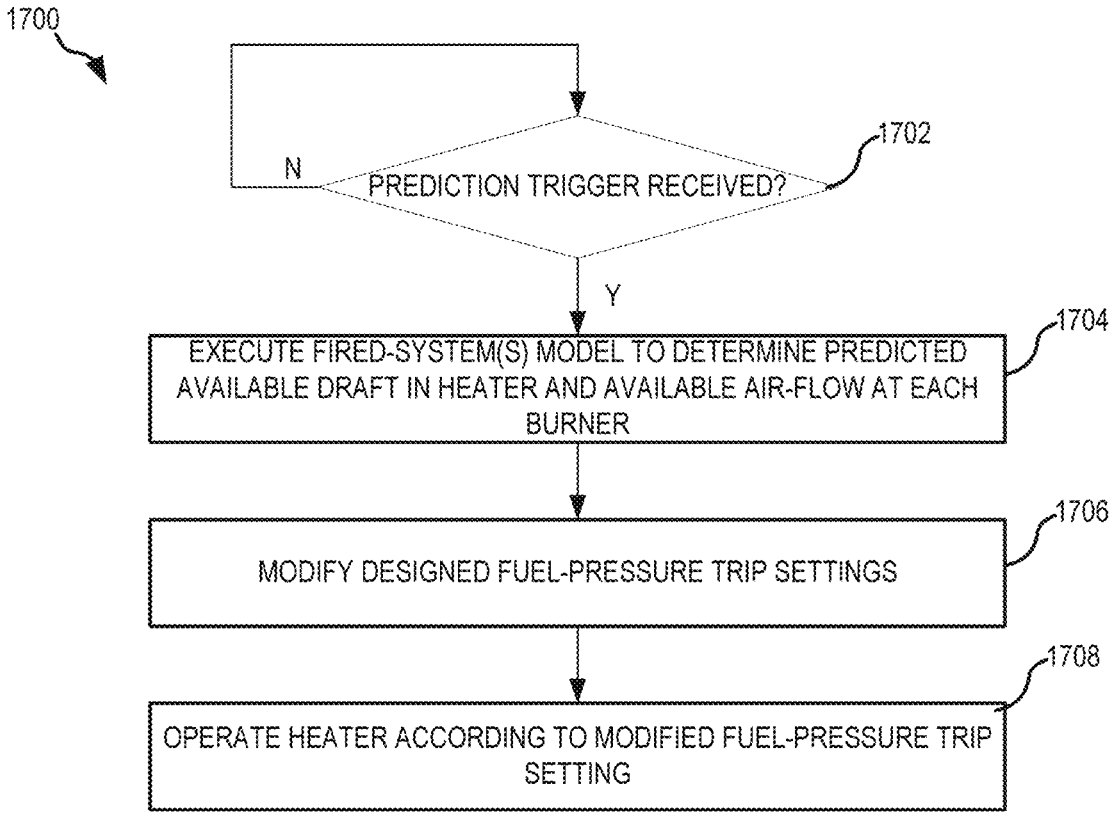
FIG. 17 depicts a method for dynamic adjustment of future safety settings, in an embodiment.

FIG. 17 depicts a method 1700 for dynamic adjustment of future safety settings, in an embodiment. Method 1700 may be performed via the system 100 discussed above in FIGS. 1-15. Particularly, method 1700 is implemented via the processor 1102 executing the computer readable instructions of the heater safety settings analyzer 1302. In one embodiment, method 1700 is a portion of method 1600 (e.g., blocks 1604-1608).

In block 1702, method 1700 determines if a prediction trigger is received. In one example of block 1702, the heater safety settings analyzer 1302 receives a prediction trigger 1330. In examples of block 1702, the prediction triggers 1330 include new fuel compositions being fired, one or more of changes in weather conditions (as identified within weather information 1310), safety settings change requests from the operator of the heater 102, and periodic safety settings checks that are pre-loaded into the fuel analyzer 1300 and cause the prediction using the fired-systems model 1320 to occur periodically such as every quarter. If so, then method 1700 proceeds with block 1704, else method 1700 waits for a prediction trigger to be received.

In block 1704, method 1700 solves a fired-systems model to determine predicted air-flow available by each burner within the heater. In one example of block 1702, heater safety settings analyzer 1302 may analyze the fired-systems model 1320 of the heater 102. In examples of block 1704, the fired-systems model 1320 is updated based on heater operating data 1322, heater geometry 1324, burner geometry 1326, air-flow ductwork geometry 1328, etc. The heater operating data 1322 includes historical data regarding the operating conditions of the heater 102, such as data captured by any of the sensors discussed above with respect to FIG. 1, and may also include the in-heater data 1308 discussed above. The burner geometry 1326 includes the number, location, and physical geometry of the burners, the burner zones within the heater, as well as burner settings for each burner, such as the controllable range of the burner air register (e.g., burner air register 120) such as the controllable range shown on indicator plate 804 in FIG. 8. The air-flow ductwork geometry 1328 includes the geometry of the airflow ductwork (e.g., ductwork 151) throughout the system 100. This includes any air-handling register (e.g., air-handling register 152), the air-flow zones, and the geometry of each of the above.

Based on the fired-systems model 1320, the safety settings analyzer 1302 calculates the predicted available air-flow to from each burner 104 (including calculating available draft within the heater in some embodiments). In one example of block 1704, the heater safety settings analyzer 1302 calculates the available air-flow through each burner 104, and, in some embodiments, draft available within the heater 102 based on the in-heater data 1308. In certain embodiments of block 1704, the heater safety settings analyzer 1302 further determines the predicted air-flow occurring in the heater 102 and each specific burner 104 based additionally on future weather information 1310. The weather information 1310 may be received at the fuel analyzer 1300 from a weather server, or generated on site using one or more sensors (e.g., precipitation, humidity, barometric, and/or temperature sensors at the heater 102). In embodiments, block 1704 includes predicting the draft within the heater allow the system and method to determine the air-flow at each specific burner 104 via pressure differential across the burner (e.g., based on difference between sensed pressure before the burner air register and the draft within the heater at the location of the burner).

Blocks 1706 and 1708 are similar to blocks 1606 and 1608, respectively.

Any portion of the heater controller 128, including the fuel analyzer 1300 of FIG. 13 may be implemented using an edge computing scheme. For example, the fuel analyzer 1300 may be located at the external server 164, and data (such as in-heater air data 1308, weather information 1310, fuel information 1312, heater operating data 1322, etc.) may be transmitted from the heater controller 128 to the external server 164. This allows the fired-systems model 1320 to be created and executed on the external server 164. The modified safety settings 1304 may then be transmitted from the external server 164 to the heater controller 128.

The modified safety settings discussed with respect to the above systems and methods may identify other safety settings besides fuel-trip safety settings. For example, the systems and methods herein may generate modified tube metal temperature trip settings, oxygen level trip settings, other combustible level trip settings, or any trip settings used in combustion systems.

Burner Stability Envelope

Another type of safety setting that may be modified by the systems and methods herein are the burner safety settings. A variety of conditions may occur that cause one or more of the burners 104 to enter an unstable state. For example, the global oxygen sensor (e.g., oxygen sensor 132) may indicate that the oxygen levels are within an acceptable range. However, individual burners (e.g., burner 104) within the process heater 102 may vary in stoichiometric ratio and ultimately destabilize when the heater is turned down to colder temperatures. Another potential event that causes burner destabilization also occurs when the global oxygen sensor (e.g., oxygen sensor 132) may indicate that the oxygen levels are within an acceptable range. During the startup under cold conditions, the burners with sub-optimal stoichiometric ratios destabilize. Atmospheric conditions may impact the operation of the burner 104 due to humid, cold, or hot weather. Wind conditions from one direction may impact the air flow of some burners in comparison to the others, causing substoichiometric combustion of some burners and not others. This substoichiometric combustion can result in destabilization of some burners and not others.

Operational stability is typically analyzed using the above discussed global oxygen measurement as well as a combustibles and/or CO reading in the radiant box or stack of the furnace. Although the oxygen sensor 132 is shown in the stack, in embodiments of system 100, the oxygen sensor 132 is located at the exit of the heater radiant section 113 and before the convection section 114. In large heaters with numerous combustion zones, multiple oxygen sensors 132 are often utilized. In these large systems, some operators choose to measure one excess oxygen per flue gas exit offtake within the radiant section 113 of the heater 102. Excess oxygen measurements downstream of the convection section 114 have an increased risk of including some amount of tramp air (e.g., excess air entering into the heater via holes within the heater housing or seals associated therewith) that is likely enter into the combustion system through the convection tube penetrations. Tramp air can skew the measurement to an artificially high value. Additionally, most heater excess oxygen measurements are taken as a point source measurement which has some inherit risk as they are unable to identify oxygen imbalances in the flue gas at the elevation of interest.

Unfortunately, single or multiple radiant excess oxygen measurements cannot explicitly guarantee that each burner 104 within the heater 102 is operating at an equivalent excess air (stoichiometric) level. Common operational issues such as burner gas tip plugging, varying air register settings per burner, operator modulated firing rate splits among burners, and poor airside distribution in forced draft ducts will cause uneven fuel and air flow rates per burner. These variations can result in unacceptable stochiometric ratios per burner which aggregate to an acceptable heater stoichiometric ratio at the excess air measurement location (e.g., location of the oxygen sensor 132 providing the excess oxygen measurement).

While the combustion system is at normal operating conditions (relatively hot flue gas environments), the safety implications of individual burners varying in stochiometric ratio will be less consequential. The hotter furnace environments temporarily mask the consequences of varying burner stochiometric ratio operation making it difficult to identify the imbalances as they gradually begin to occur. The safety concern from varying burner stochiometric ratio operation will most often manifest itself when the heater is ramped down to turndown operating conditions or when the heater has been shut down and is then required to perform a sudden cold start-up. Generally, burner stability and burner flame anchoring capability are much more sensitive to burner stoichiometry variations at cold furnace temperatures. Failing to ensure proper stochiometric ratios are achieved per burner can result in some burner flames destabilizing, causing unburned fuel and air be introduced to the firebox. If the unburned fuel and air streams mix and meet an ignition source, the mixture can rapidly ignite causing severe damage and even loss of life risks. Common ignition sources in these scenarios can be the pilot flame from the burner that has become unstable, the flame from a stabilized burner that is running at the proper stochiometric ratio, hot refractory, etc.

Because the risk level of this issue is severe, destruction of equipment and possible loss-of-life, there is a significant need to provide safety systems that prevent burner instability.

Figure 18:
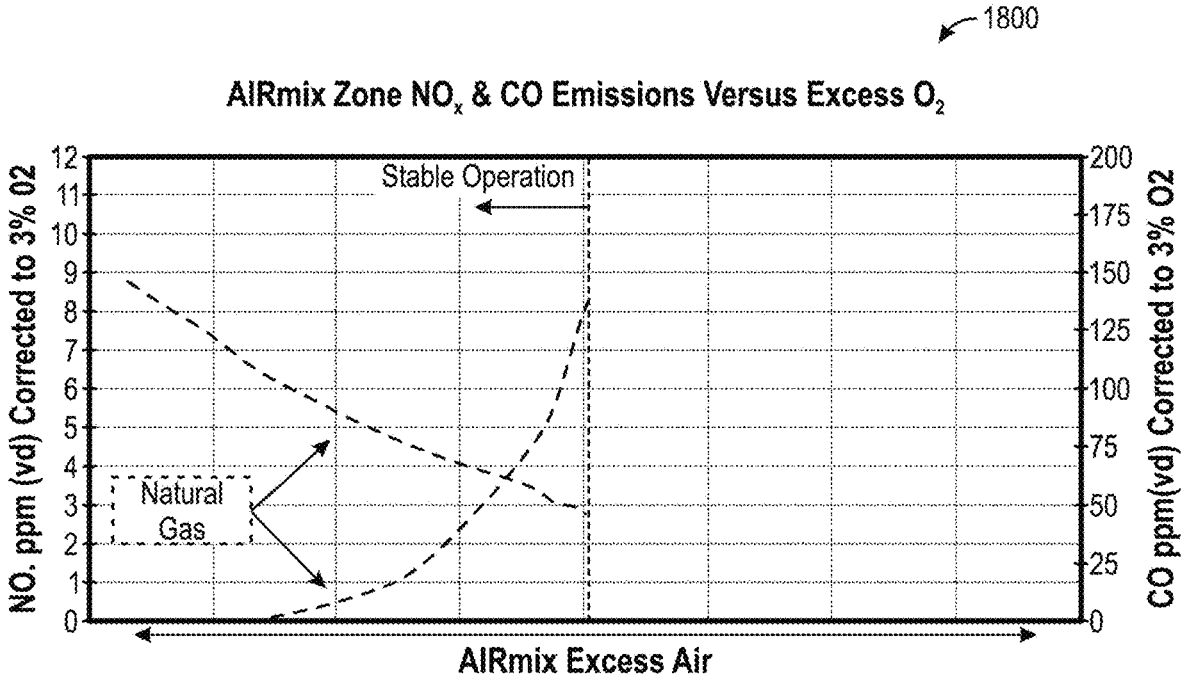
FIG. 18 depicts a graph showing air/fuel ratio effect on burner stability in a premix burner for a natural gas input fuel source in an embodiment.

FIG. 18 depicts a graph 1800 showing the air/fuel ratio effect on burner stability in a premix burner for a natural gas input fuel source, in an embodiment. In this example, the X axis represent the air fuel ratio, or excess air, from the premix zone of the burner which is where the burner is anchored and stabilized. The left Y axis represents the $NO_x$ emission corrected to three percent $O_2$. The right Y axis represents the CO emission corrected to three percent $O_2$. As the air/fuel ratio increases, the burner gets leaner and leaner and it will eventually be cooled too much by the air and ultimately the flame will go out resulting in an instability event. Burner stability not only depends on air/fuel ratio, but a variety of operating parameters including one or more of sensed emissions data, fuel-source composition, fuel flow rate, air flow, flame temperature, floor flue gas temperature proximate to the burner, and flame scanner information.

Figure 19:
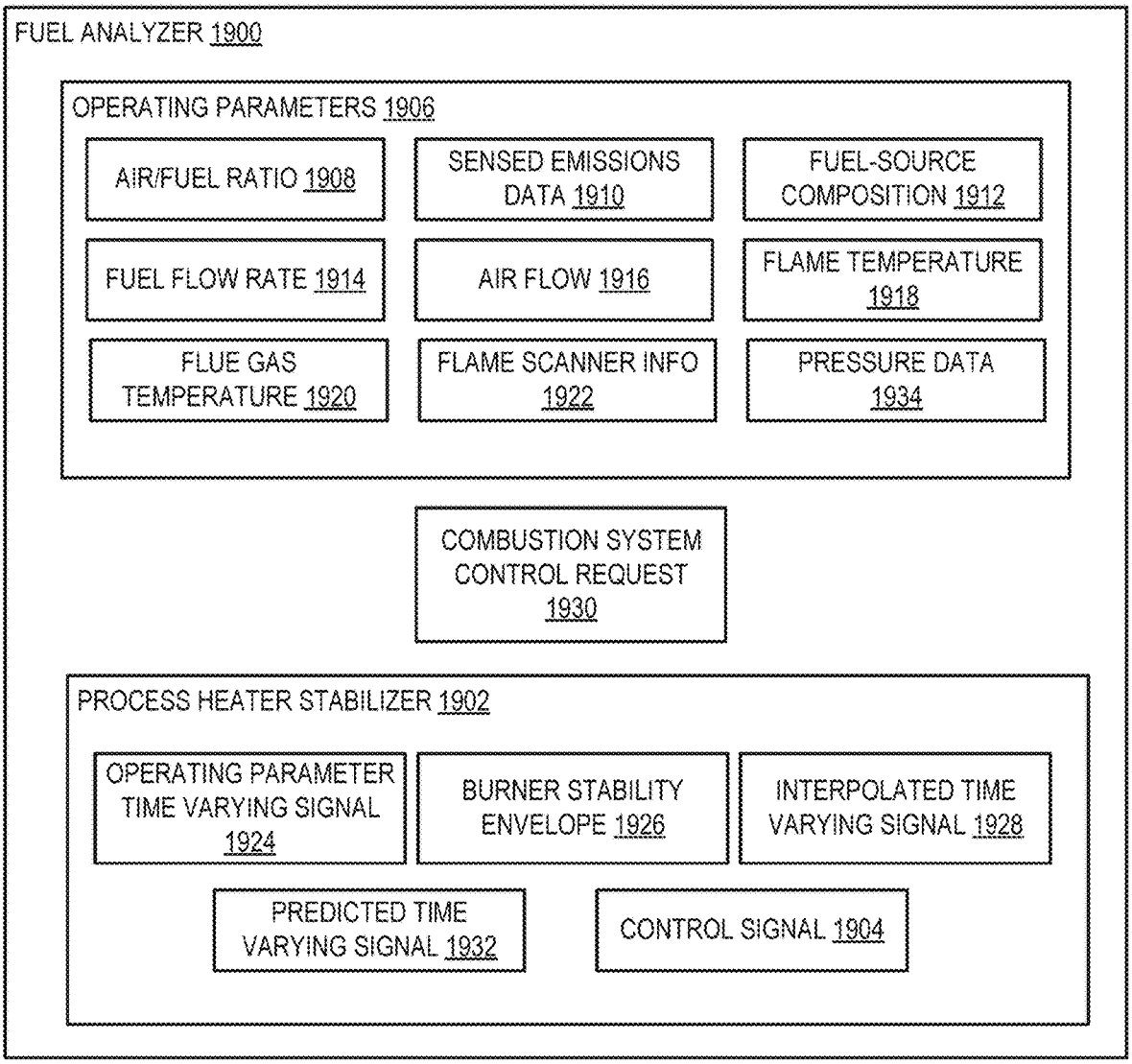
FIG. 19 is a schematic diagram depicting a fuel analyzer in an embodiment.

FIG. 19 depicts a fuel analyzer 1900, which is an example of the fuel analyzer 1148, of FIG. 11, and/or the fuel analyzer 1300 of FIG. 13, in an embodiment. Fuel analyzer 1900 includes a process heater stabilizer 1902, which is integral to, or combinable with the functionality of, the heater safety settings analyzer 1302 discussed above. Process heater stabilizer 1902 includes computer readable instructions that when executed by a processor (e.g., processor 1102), operate to create one or more control signals 1904 that alter operation of the process heater 102 to maintain stability thereof.

Process heater stabilizer 1902 analyzes a variety of information about the process heater 102. For example, one or more sensors within the process heater 102 may sense operating parameters 1906 at a plurality of time intervals. Operating parameters 1906 include any one or more information sensed within the process heater 102, including, but not limited to, one or more of air/fuel ratio 1908, sensed emissions data 1910, fuel-source composition 1912, fuel flow rate 1914, air flow 1916, flame temperature 1918, heater flue gas temperature proximate to the burner 1920 (which may define, either directly or through interpolation, flue gas temperature at the location of the burner), and flame scanner information 1922. The air/fuel ratio 1908 may be determined based on settings of one or more of stack damper 118, burner air register 120, stack fan 122, forced fan 124, air handling dampers 152, and fuel supply valves 162. The sensed emissions data 1910 may include one or more data captured by oxygen sensor 132, CO sensor 134, and $NO_x$ sensor 136, or combustibles meter. The fuel-source composition 1912 may be sensed at the fuel source 108, or inferred. In embodiments, the fuel-source composition 1912 includes the hydrocarbon, hydrogen and inert composition values of the input fuel source 108. The fuel flow rate 1914 may be determined based on data from one or more of mass flow sensors 154, fuel temperature sensors 156, and fuel pressure sensors 158. The air-flow rate 1916 may be determined based on data from one or more of stack damper 118, burner air register 120, stack fan 122, forced fan 124, air handling dampers 152, air temperature sensor 144, air humidity sensor 146, and air pressure sensors 148 and/or 150. In embodiments, the air-flow rate 1916 may alternatively or additionally include the draft within the process heater as determined based on one or more of floor pressure sensor 126(1), arch pressure sensor 126(2), convection pressure sensor 127, and stack pressure sensor 129. The flame temperature 1918 includes data captured by temperature sensors, including the flame scanner 149, the TDLAS scanner 147, and other temperature sensors known in the art. In embodiments, the flame temperature 1918 may be calculated based on physics-based modeling of the combustion system. The flue gas temperature 1920 in the heater (and, in embodiments, at or proximate to the burner) includes data captured by temperature sensors, including the flame scanner 149, the TDLAS scanner 147, as well as radiant temperature sensor 142, and/or data calculated based on physics-based model of the combustion system and real-time sensed data. The flame scanner information 1922 includes data captured by the flame scanner 149, including flame intensity/signal strength for a plurality of wave lengths. Although not shown, the operating parameters 1906 may further include ambient conditions, such as weather and humidity values surrounding the process heater 102.

The operating parameters 1906 are sensed at each of a plurality of time intervals. The process heater stabilizer 1902 converts each sensed type of operating parameter 1906 into individual time-varying signals 1924. Each time-varying signal 1924 is then compared to a burner stability envelope 1926. The burner stability envelope 1926 is multi-dimensional and is defined by a stability window of the process heater. In embodiments, the stability envelope 1926 may be specific to each burner, group of burners, or the entire heater/combustion system. Each boundary of the stability window indicates when a burner within the combustion system likely enters an unstable state.

Unstable state may include burner lift-off (at which the flame lifts away from the intended burner anchoring zone), burner huffing (at which the flame pulses away from the burner and reattaches at a given frequency), burner flashback (at which the flame propagates into the burner upstream of the intended flame anchor point for premix burner types), and other types of improper flame operation. Flashback instability is highly dependent on keeping uniform premix velocities at the exit of the injection to the combustion plane within the process heater. This can be challenging in premix wall burners because unburned mixtures of air and gas often must make torturous turns within the burner as they are injected into the furnace. Maintaining proper velocities through these turns as to not cause low pressure zones in the burner is challenging, and as such, the prediction of flashback will be highly configuration dependent. It is also understood to be heavily influenced by non-obvious factors such as air and fuel cleanliness (bugs, dust, etc.), or transient weather effects (such as wind).

Figure 20:
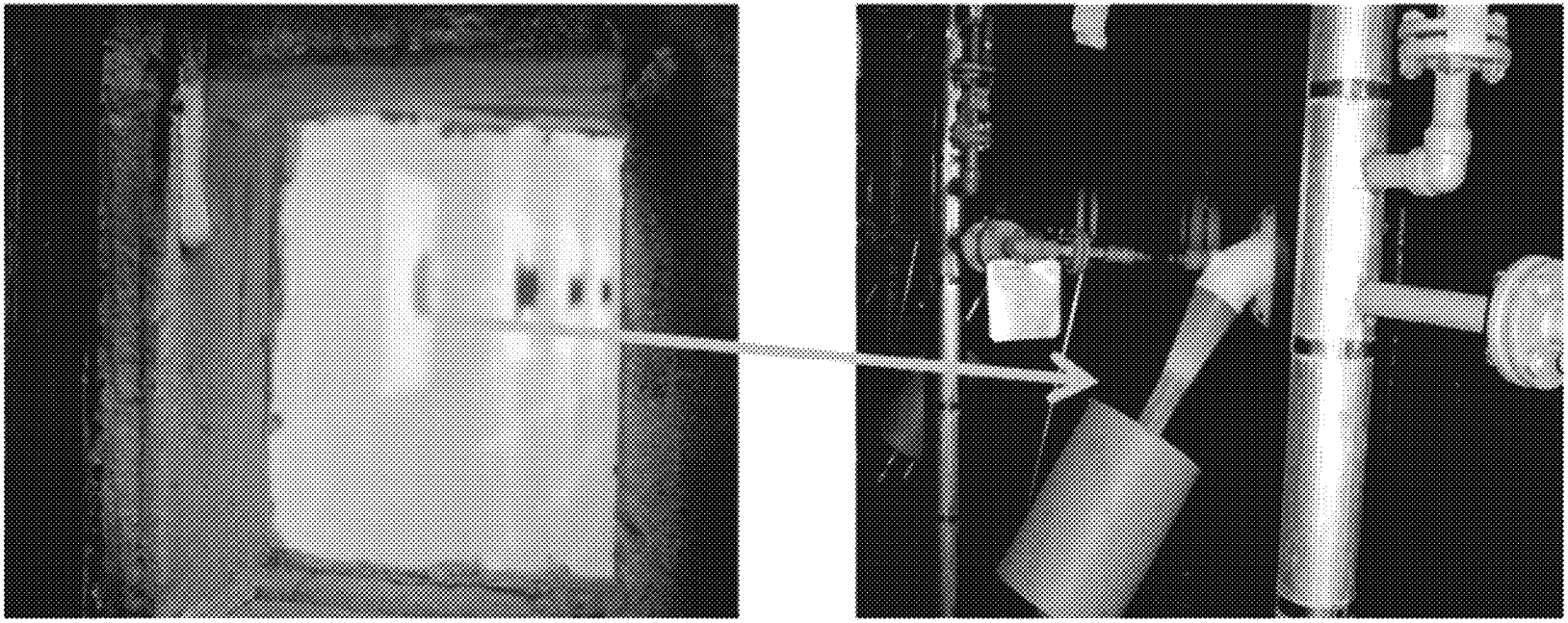
FIG. 20 depicts an in-field example of burner flashback.

FIG. 20 depicts an in-field example of burner flashback. In the left image of FIG. 20, it is seen that the burner is much hotter as compared to the other burners within the viewing window because the burner is glowing red. This is consistent with viewing the burner hardware from outside the burner as well, as shown in the image on the right, where the pre-mix section outside of the process heater chamber is further glowing red-hot.

Figure 21:
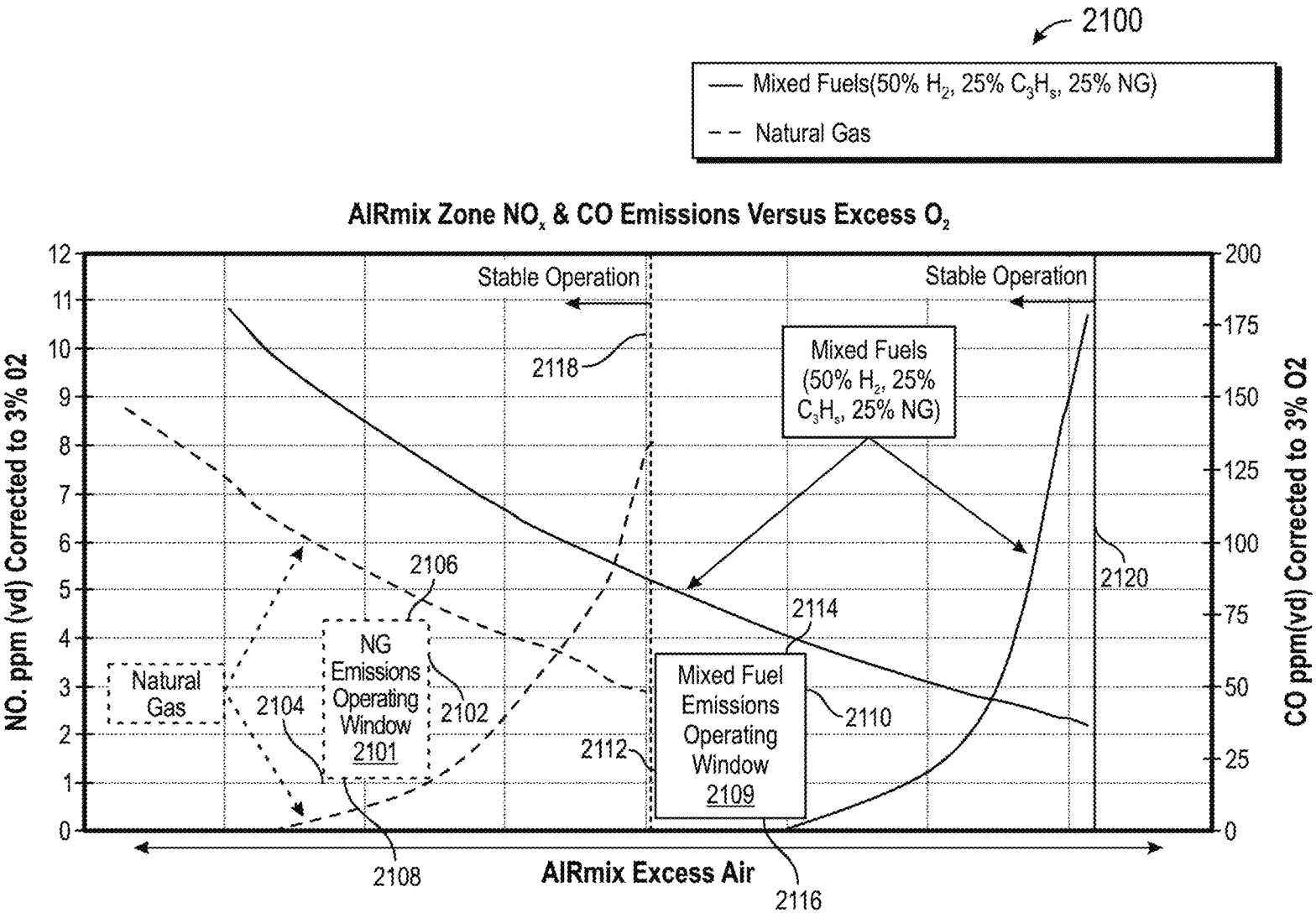
FIG. 21 depicts an example burner stability envelope in graph form, in an embodiment.

FIG. 21 depicts an example burner stability envelope 2100 in graph form, in an embodiment. Burner stability envelope 2100 is an example of the burner stability envelope 1926. Burner stability envelope 2100 defines a stability window 2101 including a maximum boundary 2102 for air/fuel ratio (e.g., air/fuel ratio 1908), the minimum boundary 2104 for air/fuel ratio, the maximum boundary 2106 for sensed NOx emission data and/or CO emission data (e.g., emissions data 1910), and the minimum boundary 2108 for sensed NOx emission data and/or CO emission data (e.g., emissions data 1910) at which the burner will likely enter an unstable state if the input fuel source is natural gas. The burner stability envelope 2100 also shows a second stability window 2109 including defined by maximum boundary 2110 for air/fuel ratio (e.g., air/fuel ratio 1908), the minimum boundary 2112 for air/fuel ratio, the maximum boundary 2114 for sensed NOx emission data and/or CO emission data (e.g., emissions data 1910), and the minimum boundary 2116 for sensed NOx emission data and/or CO emission data (e.g., emissions data 1910) at which the burner will likely enter an unstable state if the input fuel source is mixed fuel source having 50 percent $H_2$, 25 percent $C_3H_8$, and 25 percent natural gas composition.

Stability windows 2101 and 2109 in FIG. 21 illustrate the desirable operating windows for NOx emissions less than 5 ppm and CO emissions less than 50 ppm. In embodiments, the stability envelope 2100 is much larger, of which the high side (right side) of the air fuel ratio would be graphically observed by the "stable operation" vertical lines 2118 and 2120, respectively. At higher air fuel ratios than lines 2118 and 2120, it would be most common to observe flame lift off, though sometimes flame huffing can occur as the flame will try to reattach at a given frequency. Not shown on the graph (very far to the left of the graph) a minimum air fuel ratio would be defined by the stability envelope 1926 that could cause an instability even that would most likely be observed as huffing. As the flame becomes too fuel rich, there would not be enough local air for combustion, at which point in time the flame would go out. As soon as the flame goes out, there is instantaneously an inflow of air which then mixes stoichiometrically with some of the fuel, which then will rapidly ignite. This rapid ignition once again consumes all of the available combustion air, causing the flame to become immediately too fuel rich once again. This cycle repeats at some given frequency which is known as huffing. It may be possible to have fuel rich combustion result in lift off as well, if the burner is geometrically designed in such a configuration that the pressure pulsations are not able to set up at a repeatable frequency. This is essentially what happens in fuel rich combustion where the flame cannot find enough oxygen, and ultimately "goes out" (the flame is lifted into the firebox until the available oxygen is consumed) and then is unable to re-ignite itself back to the burner again.

Burner stability envelope 2100 evidences the principle that each individual boundary value of the stability window is dependent, for a given operational parameter, on the current status of other operational parameters. For example, the air/fuel ratio maxima and minima is dependent on the type of input fuel source (as well as other operational parameters). While maxima and minima values are shown for emissions data, air/fuel ratio, and input fuel source are illustrated in the burner stability envelope 2100, other maxima and minima for other operational parameters such as, but not limited to, other sensed emissions data (e.g., oxygen), fuel-source composition, fuel flow rate, air flow, flame temperature, flue gas temperature in the heater (and/or at or proximate to the burner), and flame scanner information may be included in the burner stability envelope.

In certain embodiments, the burner stability envelope 1926, or at least a portion thereof, is generic to the specific burner 104, regardless of the installation of within the process heater. In certain embodiments, the burner stability envelope 1926, or a portion thereof, is configured based on the specific process heater 102 geometry, and the specific geometry of the burner 104 when installed in the process heater 102.

In embodiments, the burner stability envelope 1926 may include a static or time-varying signature related to operating conditions of the process heater. For example, where the burner stability envelope 1926 is defined based on an operational parameter related to flame scanner data, the burner approaching an unstable state may be identified within the burner stability envelope 1926 based on oscillations in detected spectral characteristics of the flame scanner data, such as ultraviolet or infrared spectral characteristics. In embodiments, the flame scanner data is combined with other known parameters as part of the multi-parameter burner stability envelope 1926 such that, at given operating conditions within the heater 102, a specific spectral characteristic within the sensed data by the flame scanner 149 would indicate a potentially unstable condition. In some embodiments, the burner approaching an unstable state may be identified by a static signature within the flame scanner data, such as a specific spectral characteristic that, to the visual human observer, would otherwise not indicate a potentially unstable condition but, due to configuration and training of the burner stability envelope 1926, if a certain spectral characteristic (or range thereof) occurs, an unstable condition is approaching. Each flame scanner 149 may scan one or more flames within the heater 102. The burner stability envelope 1926 may identify when, even if a given burner goes out, the overall heater 102 still maintains stability.

Figure 22:
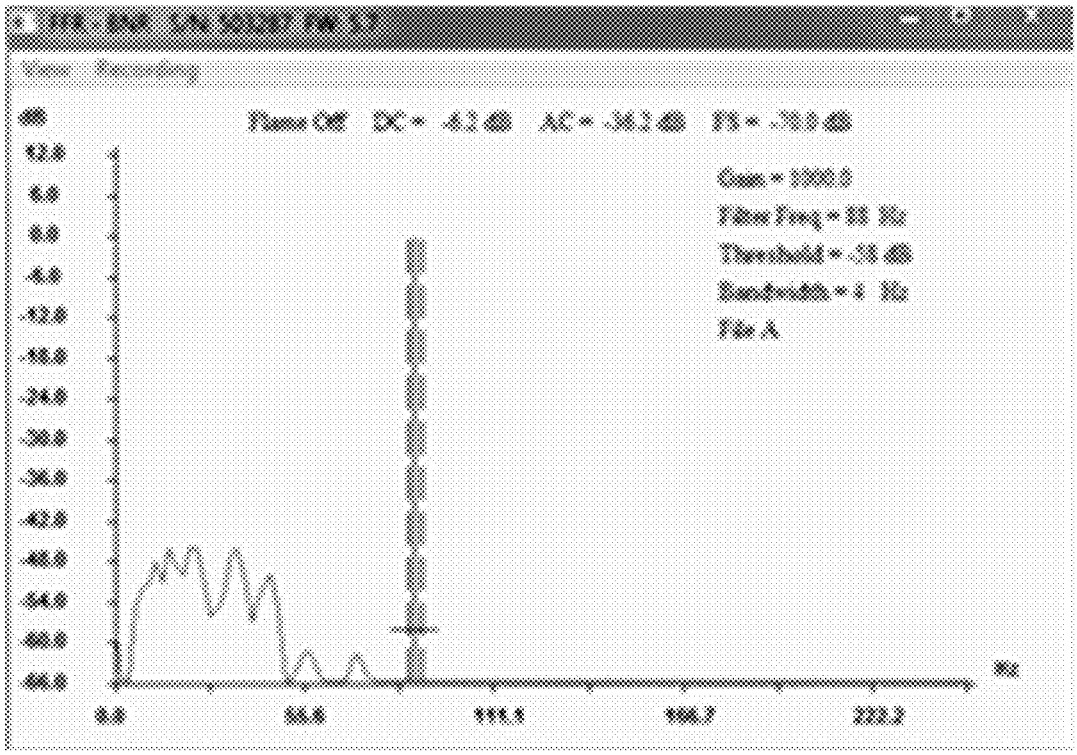
FIGS. 22-24 depict various datasets related to captured information from a flame scanner, in embodiments.
Figure 23:
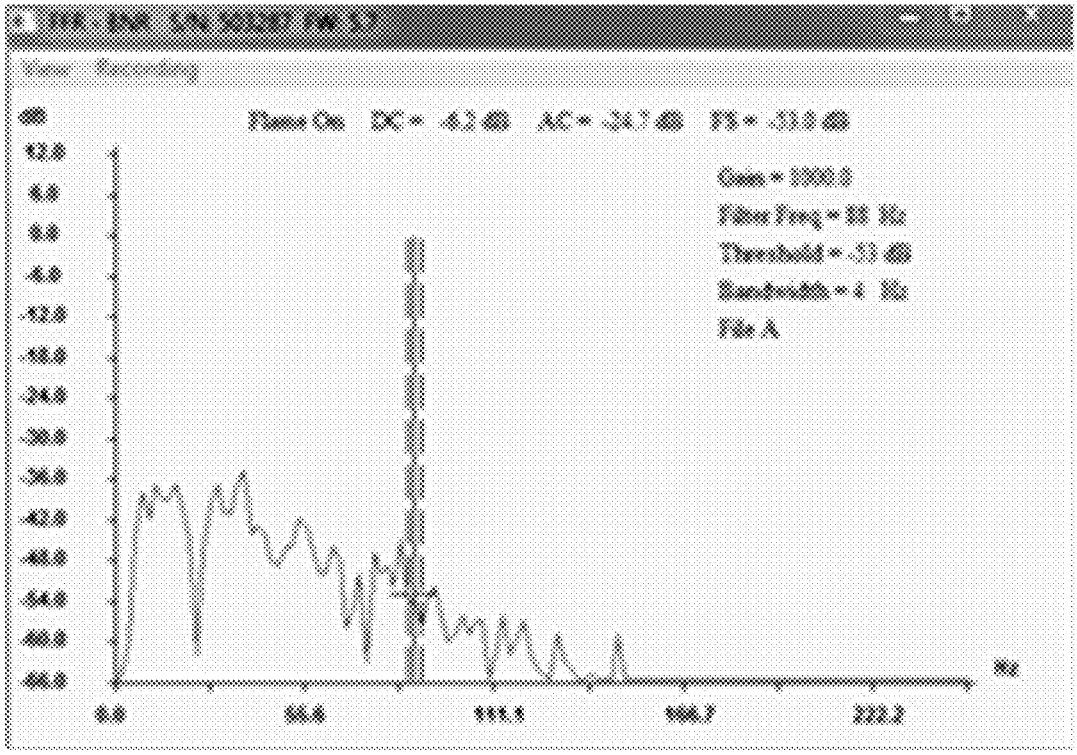
Figure 24:
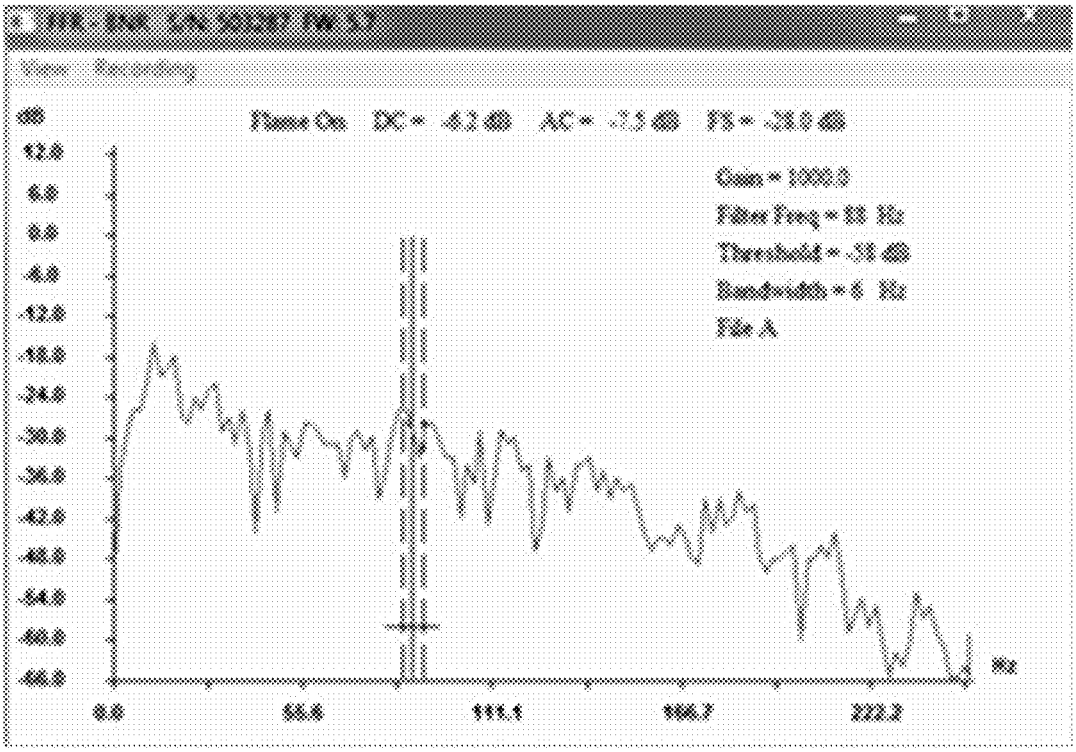

FIGS. 22-24 depict various datasets related to captured information from a flame scanner, in embodiments. FIG. 22 shows an example dataset of just the pilot light on, and no flame. FIG. 23 shows an example dataset of the pilot light and main flame in a first operating condition. FIG. 24 shows an example dataset of the pilot light and main flame in a second operating condition. The process heater stabilizer 1902 may combine multiple ones of the individual captured operating parameters at each time interval into a single time-varying signal (and/or generate an individual time-varying signal for each captured operating parameter), and then compare this time-varying signal against the stability window (or time-varying signatures) defined in the burner stability envelope 1926 to determine if the burner is approaching an unstable state.

Another example of a static or time-varying signature related to operating conditions of the process heater included in the burner stability envelope 1926 involves monitoring pressure fluctuations within the heater. As discussed above, various pressure sensors (e.g., floor pressure 126(1), arch pressure 126(2), stack pressure 129, etc.) are included in the heater 102. The signals captured by these sensors may be leveraged to identify burner instability. Accordingly, in embodiments, the burner stability envelope 1926 may define pressure boundaries that identify unstable conditions. Accordingly, the process heater stabilizer 1902 may utilize pressure data 1934 to identify pressure fluctuations in data from one or more pressure sensors within the heater 102. To identify the pressure fluctuations, the operating parameter time varying signal 1924 is generated based on the pressure data 1934. The operating parameter time varying signal 1924 may define intensity of combustion pulsations measured from Fourier Series analysis of the pressure data 1934. In embodiments, a flat top window filter is used to process the time series data within the pressure data 1934 before the Fourier Series is computed. The flat top window filter preserves the amplitude of sinusoidal peaks in the pressure data 1934 at the expense of frequency resolution. However, amplitude resolution is of greater interest than frequency resolution to identify the pressure fluctuations. In embodiments, the pressure data 1934 includes frequency data resolution between 1 Hz to 500 Hz. In such embodiments, the pressure sensors include a response time of 1 ms or better to obtain this resolution. In the above embodiments analyzing pressure fluctuations, the burner stability envelope 1926 may identify a first instability identifier (e.g., a "pant" or "huffing") of the burner in the range of 3 Hz≤f≤15 Hz; a second instability identifier (e.g., a "rumble") in the range of 15 Hz<f≤50 Hz; and a third instability identifier (e.g., a "Growl/Howl") in the range of 15 Hz<f≤50 Hz. The frequency values, and number of instability identifiers, may differ based on any specific configurations of the heater 102, including, but not limited to, number and type of burners therein. If any of the first, second, or third instability identifier conditions are met in the operating parameter time varying signal 1924, the process heater stabilizer 1902 may output a control signal 1904 (as discussed above) accordingly.

In embodiments, aspects of the burner stability envelope 1926, such as the maxima and minima, the above discussed signature, and/or the predetermined thresholds may be determined based on artificial intelligence. For example, during design and factory testing of a burner, the burner is purposefully driven to unstable states. This information, and the conditions at which the burner enters the unstable state, may be used to train a neural network. The neural network may include the type of burner, and the operating parameters at which the burner is purposefully driven to unstable state. Furthermore, collection of data from various operating process heaters may be used to further train the neural network increasing the accuracy of the burner stability envelope 1926 and the identification of when the burner is likely to enter the unstable state.

The process heater stabilizer 1902 compares the time-varying signal 1924 to the burner stability envelope 1926 to determine if the time-varying signal 1924 is approaching the stability window defined in the burner stability envelope 1926, or otherwise matches the signature defined in the burner stability envelope 1926. The time-varying signal 1924 may be based on a single or multiple captured operating parameters, or may be based on a specific captured operating parameter that is combined with other stability indicators that are defined based on measured heater data or data interpolated based on a comparison of real-time heating data and physics-based modeling of the combustion system. The time-varying signal 1924 may be approaching (e.g., breaching) the boundary when the time-varying signal reaches the boundary. The time-varying signal 1924 may be approaching the stability boundary when the time-varying signal 1924 becomes within a predefined threshold range of the boundary. The predetermined threshold may be the same as the boundary (or otherwise a value of "zero") when the value of the boundary is already a threshold value away from the actual value of the operating parameter at which the burner is likely to enter an unstable state. In embodiments, the predetermined threshold may be a value with respect to the boundary at which the burner will still operate in a stable state, but should the time-varying signal continue to change at a given rate, the burner will enter into an unstable state within a predetermined amount of time (e.g., 15 minutes, or any other amount of time). This predetermined threshold gives the process heater stabilizer 1902 enough time to process the signals and control the system 100 to maintain stable operation.

If the process heater stabilizer 1902 determines that the burner 104 is entering an unstable state, the process heater stabilizer 1902 generates the control signal 1904 to alter operation of the burner 104 to maintain stability of the system 100. In embodiments, the altering operation of the burner 104 includes outputting control signal 1904 that shuts the fuel control valve or reduces the fuel flow 162 to prevent/reduce the fuel from flowing to the burner 104 (such as by initiating the BMS (Burner management system) safe shutdown sequence). In embodiments, the altering operation of the burner 104 includes outputting the control signal changing the air/fuel ratio at the burner 104 such as by controlling one or more of the stack damper 118, burner air register 120, stack fan 122, forced fan 124, air duct dampers 152, and fuel control valve 162. In embodiments, the altering operation of the burner 104 includes shifting fuel from one burner zone to another, shutting down some burners but not all, and other types of automated control within the heater 102.

In embodiments, where the process heater stabilizer 1902 determines that one or a plurality of burners are potentially entering an unstable condition, it may complete further analysis to determine if that given burner or plurality of burners will result in an overall unstable condition within the heater. For example, one burner entering an unstable condition may not impact stability of the heater. Thus, the process heater stabilizer 1902 may perform physics-based, analytical, or fast-CFD based modeling to determine if a given burner or group of burners becomes unstable, the overall combustion system will become unstable or remain stable. If the overall combustion system will remain stable, the process heater stabilizer 1902 may forego outputting a control signal 1904, do nothing, and/or just output an indication of the burner or group of burners that are entering an unstable state.

The process heater stabilizer 1902 may further interpolate a future value 1928 of the time-varying signal corresponding to a future time and interpolated from the operating parameters 1906 at a plurality of the time intervals under the assumption that that the operating state data will change at a predictable rate until the future time. In such a situation, the process heater stabilizer 1902 may compare the future value 1928 against the burner stability envelope 1926 to determine if the time-varying signal will breach the burner stability envelope 1926.

The process heater stabilizer 1902 may be initiated periodically (e.g., every two minutes, or other time interval), in embodiments. In additional or alternative embodiments, it may be initiated in response to receipt of a combustion system control request 1930. The combustion system control request 1930 is generated by the heater controller 128 (e.g., automatically or in response to a change in control by the operator of the heater 102 interacting with the heater controller 128). In response to the receipt of the combustion system control request 1930, the process heater stabilizer 1902 may generate a predicted time-varying signal 1932 based on the expected operating state data of the process heater 102 should the combustion system control request 1930 be implemented. The process heater stabilizer 1902 then compares the predicted time-varying signal 1932 against the burner stability envelope 1926. If the predicted time-varying signal 1932 breaches the burner stability envelope 1926 (e.g., by breaching the predetermined threshold approaching one of the maxima or minima, or by matching a signature in the burner stability envelope 1926), the process heater stabilizer 1902 overrides the combustion system control defined in the combustion system control request 1930.

Figure 25:
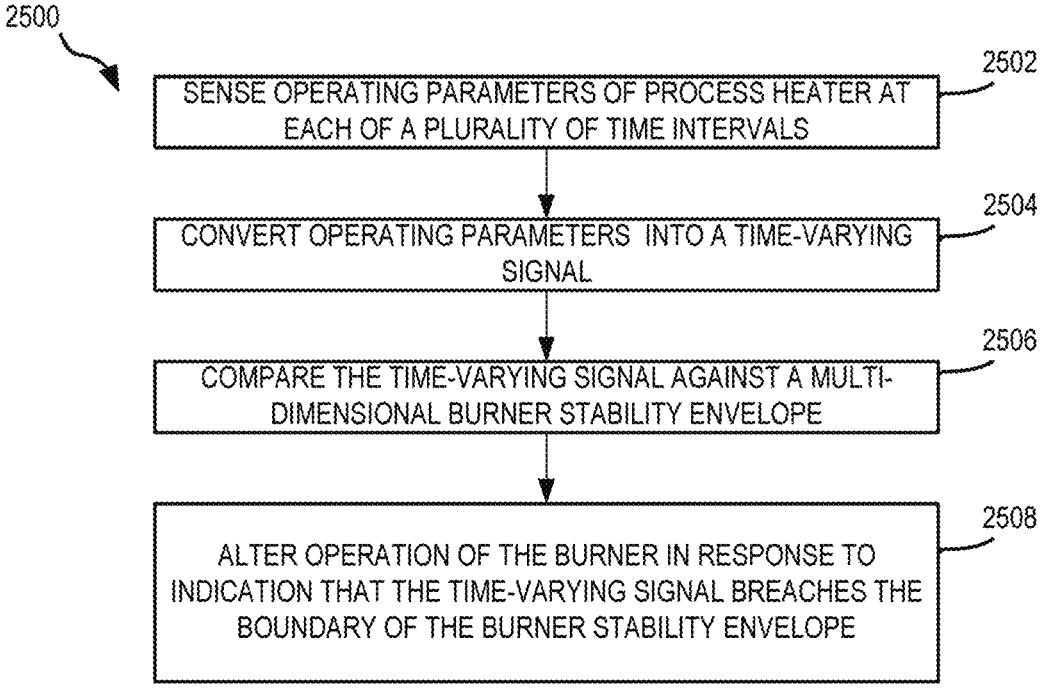
FIG. 25 depicts a method for stabilizing a process heater, in an embodiment.
Figure 26:
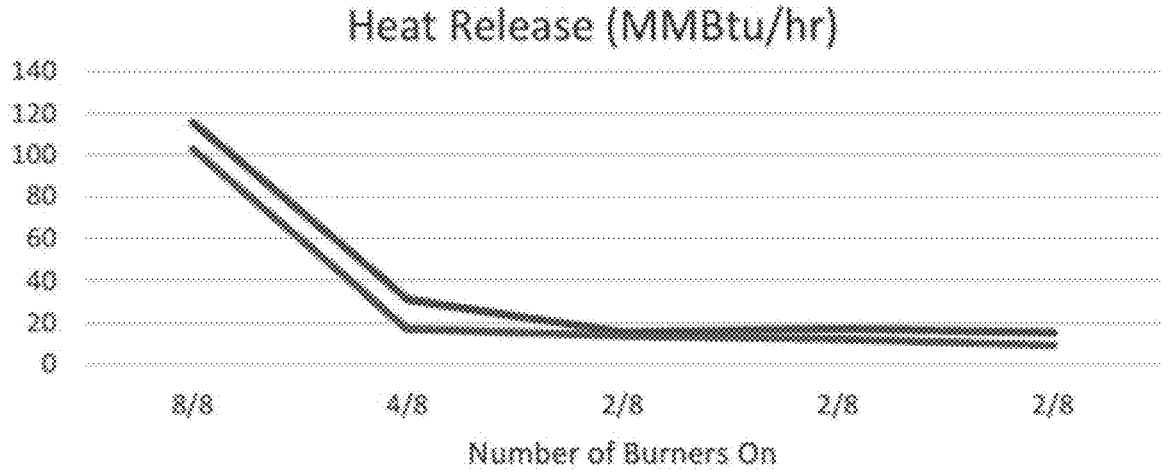
FIGS. 26-31 depict sensed operating parameters and expected operating parameters for a system having burners during a shutdown event.
Figure 27:
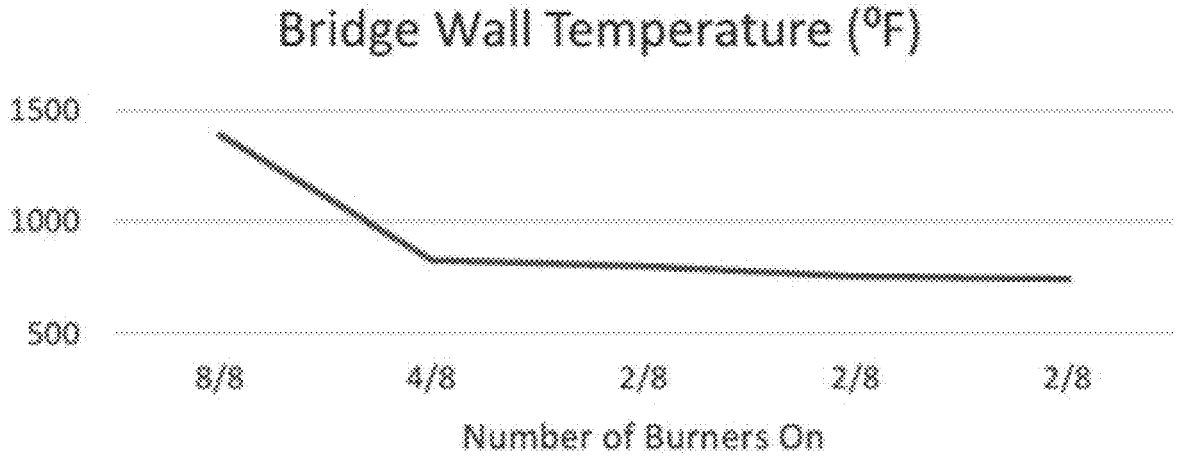
Figure 28:
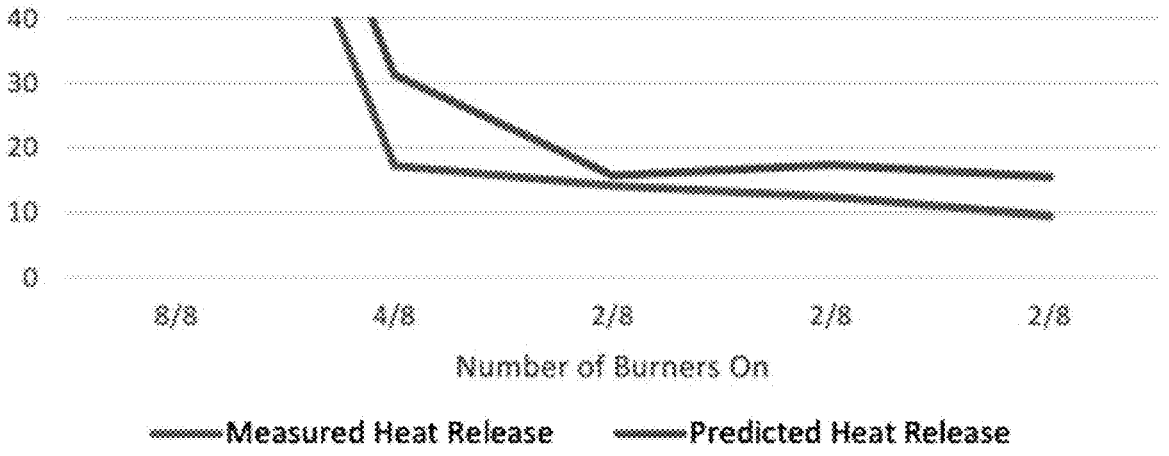
Figure 29:
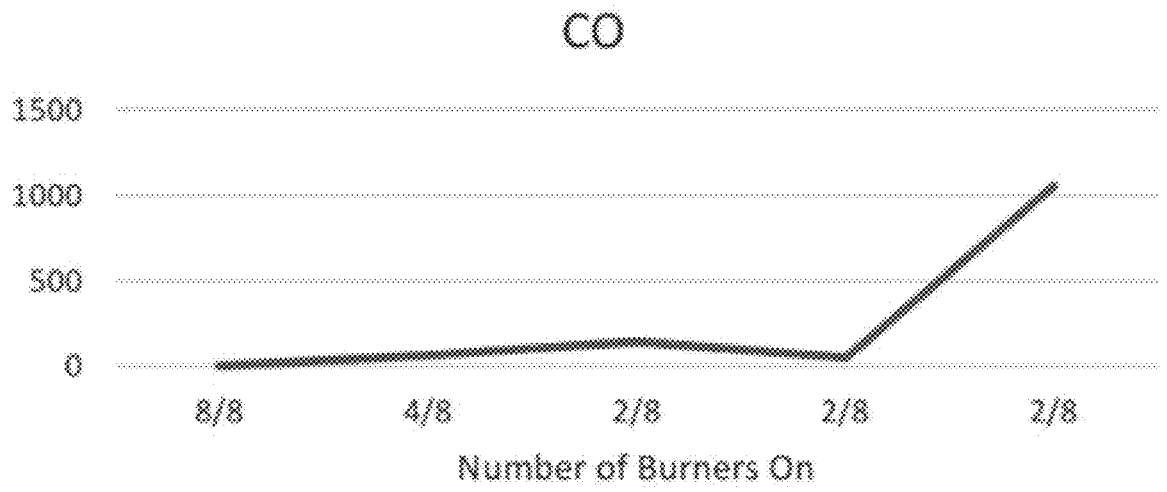
Figure 30:
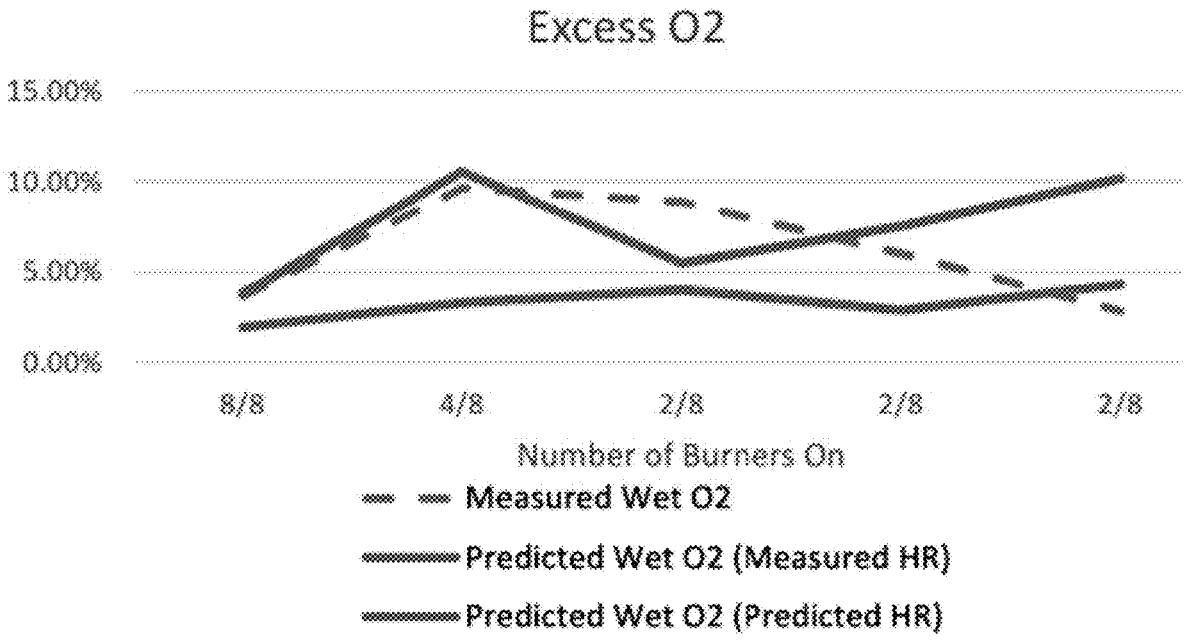
Figure 31:
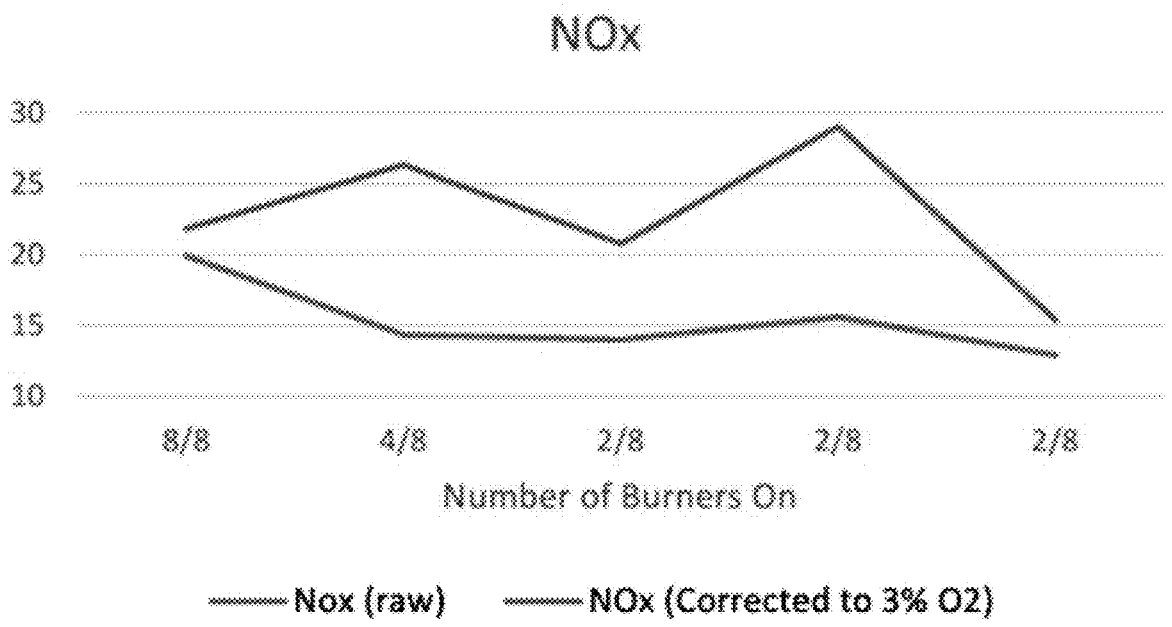

FIG. 25 depicts a method 2500 for stabilizing a process heater, in an embodiment. Method 2500 is implemented using the system 100 of FIGS. 1-11 and 18-24, for example. In particular, the method 2500 may be implemented by executing the computer readable instructions of the process heater stabilizer 1902.

In block 2502, the method 2500 senses operating parameters of a process heater at each of a plurality of time intervals. In one example of operation of block 2502, operating parameters 1906 of the process heater 102 are sensed using one or more of the sensors of system 100. Operating parameters 1906 may include any one or more information sensed within the process heater 102, including, but not limited to, one or more of air/fuel ratio 1908, sensed emissions data 1910, fuel-source composition 1912, fuel flow rate 1914, air flow 1916, flame temperature 1918, flue gas temperature 1920, and flame scanner information 1922. In one example of block 2502, the pressure data 1934 is captured using one or more pressure sensors in the heater 102.

In block 2504, the method 2500 converts the operating parameters into a time-varying signal. In one example of operation of block 2504, the process heater stabilizer 1902 converts each of the operating parameters 1906 into the time-varying signal 1924. In another example of operation of block 2504, the process heater stabilizer 1902 combines multiple of the sensed operating parameters 1906 into the time-varying signal 1924. In another example of operation of block 2504, the process heater stabilizer 1902 interpolates a future value 1928 of the time-varying signal corresponding to a future time and interpolated from one or more of the operating parameters 1906 at a plurality of the time intervals under the assumption that that the operating parameters will change at a predictable rate until the future time. In one example of block 2504 Fourier Series analysis is performed on the pressure data 1934. In embodiments, during block 2504, a flat top window filter is used to process the time series data within the pressure data 1934 before the Fourier Series is computed.

In certain embodiments of method 2500, the method 2500 and/or the block 2504 is initiated based on receipt of a combustion system control request (e.g., combustion system control request 1930). In such embodiments, an example of operation of block 2504 may include generating the predicted time-varying signal 1932 based on the expected operating parameters of the process heater 102 should the combustion system control request 1930 be implemented.

In block 2506, the method compares the time-varying signal against a multi-dimensional burner stability envelope. In one example of operation of block 2506, the process heater stabilizer 1902 compares the time-varying signal 1924 against the burner stability envelope 1926. In one example of operation of block 2506, the process heater stabilizer 1902 compares the interpolated time-varying signal 1928 against the burner stability envelope 1926. In one example of operation of block 2506, the process heater stabilizer 1902 compares the predicted time-varying signal 1932 against the burner stability envelope 1936. In any of the examples of block 2506, the process heater stabilizer 1902 may be comparing the time-varying signal 1928 against a signature, defining when a burner within the combustion system likely enters an unstable state, defined within the burner stability envelope 1926, such as, but not limited to: a spectral signature of flame scanner data, a first instability identifier based on pressure data (e.g., a "pant") of the burner in the range of 3 Hz≤f≤15 Hz; a second instability identifier based on pressure data (e.g., a "rumble") in the range of 15 Hz<f≤50 Hz; and a third instability identifier based on pressure data (e.g., a "Growl/Howl") in the range of 15 Hz<f≤500 Hz.

In block 2508, the method 2500 alters operation of the burner in response to indication that a value of the time-varying signal breaching the boundary of the burner stability envelope. The time-varying signal 1924 may be approaching (e.g., breaching) the boundary when the time-varying signal reaches the boundary. The time-varying signal 1924 may be approaching the stability boundary when the time-varying signal 1924 becomes within a predefined threshold range of the boundary. The predetermined threshold may be the same as the boundary (or otherwise a value of "zero") when the value of the boundary is already a threshold value away from the actual value of the operating parameter at which the burner is likely to enter an unstable state. In embodiments, the predetermined threshold may be a value with respect to the boundary at which the burner will still operate in a stable state, but should the time-varying signal continue to change at a given rate, the burner will enter into an unstable state within a predetermined amount of time (e.g., 15 minutes, or any other amount of time). This predetermined threshold gives the process heater stabilizer 1902 enough time to process the signals and control the system 100 to maintain stable operation.

In one example of operation of block 2508, the process heater stabilizer 1902 generates the control signal 1904 to alter operation of the burner 104 to maintain stability of the system 100. In another example of operation of block 2508, the process heater stabilizer 1902 outputs the control signal 1904 to shut the fuel control valve 162 to prevent fuel from flowing to the burner 104. In another example of operation of block 2508, the process heater stabilizer 1902 outputs the control signal 1904 to changing the air/fuel ratio at the burner 104 such as by controlling one or more of the stack damper 118, burner air register 120, stack fan 122, forced fan 124, air duct dampers 152, and fuel control valve 162.

Instability Based on Global and Local Adiabatic Flame Temperature

Improper operation of the combustion system can cause stoichiometric conditions that result in catastrophic results. FIGS. 26-31 depict sensed operating parameters and expected operating parameters for a system having 8 burners during a shutdown event. Each graph in FIGS. 26-31 shows a shutdown over 25 minutes, where each data point on the X-axis is separated by five minutes. A near-miss situations (near-catastrophic event) occurred when the sensed $O_2$ levels drop and the sensed CO levels raised dramatically. These situations can occur when improper air register adjustments to the burner(s) result in excess fuel entering into the system.

The near-miss event may not be observable at steady-state operation of the heater used in FIGS. 26-31. This is because generally, the heat release by fuel gas pressure is trending well with the measured heat release. During turndown, however, the fuel pressure may spike to the remaining burners faster than the fuel gas control valve can manage. This results in a situation where the predicted excess O2 levels at steady-state normal operation trend with the measured excess O2 levels, indicating no expected near-miss situation. However, during turndown the predicted excess air indicates a lower excess air level while the measured excess air lags significantly, indicating sub-stoichiometric conditions. It is believed that the CO excursion is attributed to the low excess operation at turndown (cold heater conditions) due to the flame quenching effect that cold flue gas without substantially high excess air has on staged fuel technology.

Figure 32:
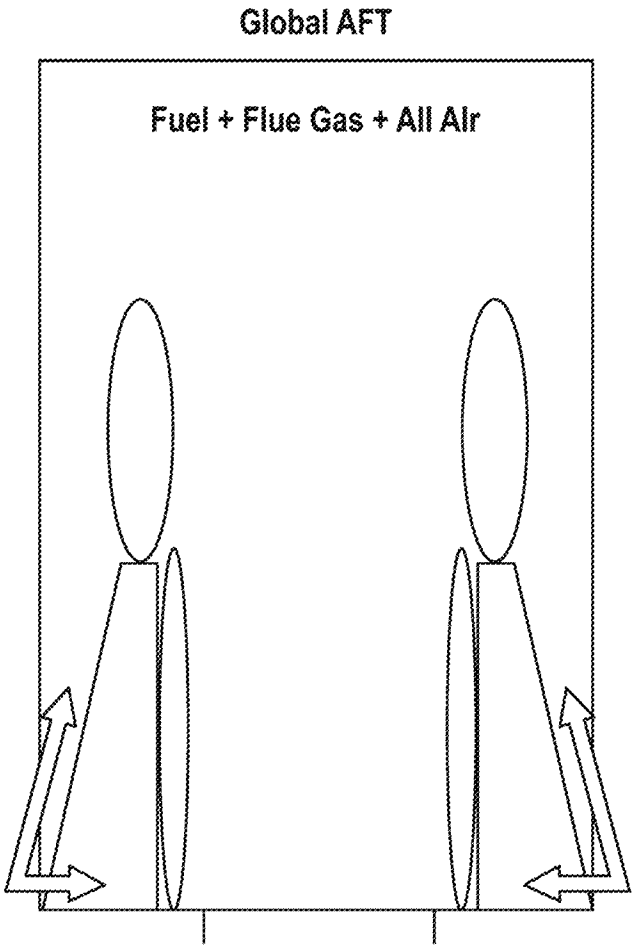
FIG. 32 shows a conventional burner management system that monitors global adiabatic flame temperature, in an embodiment.

Adiabatic flame temperature (AFT) define flame temperature in the system assuming no energy lost to the outside environment. Conventional burner management systems monitor global AFT, shown in FIG. 32, which indicates the flame temperature throughout the entire system, using AFT physics-based calculations assuming that all air for combustion, fuel for combustion, and flue gas entrained into the combustion process mix uniformly. Applicant, however, has identified that analyzing the local AFT can provide more insight into burner stability. Local AFT is shown at a high-level in FIG. 33 and includes AFT physics-based calculations at each burner assuming a stoichiometric amount of air utilized for combustion, with all fuel from combustion, and all flue gas entrained into the combustion process.

Figure 33:
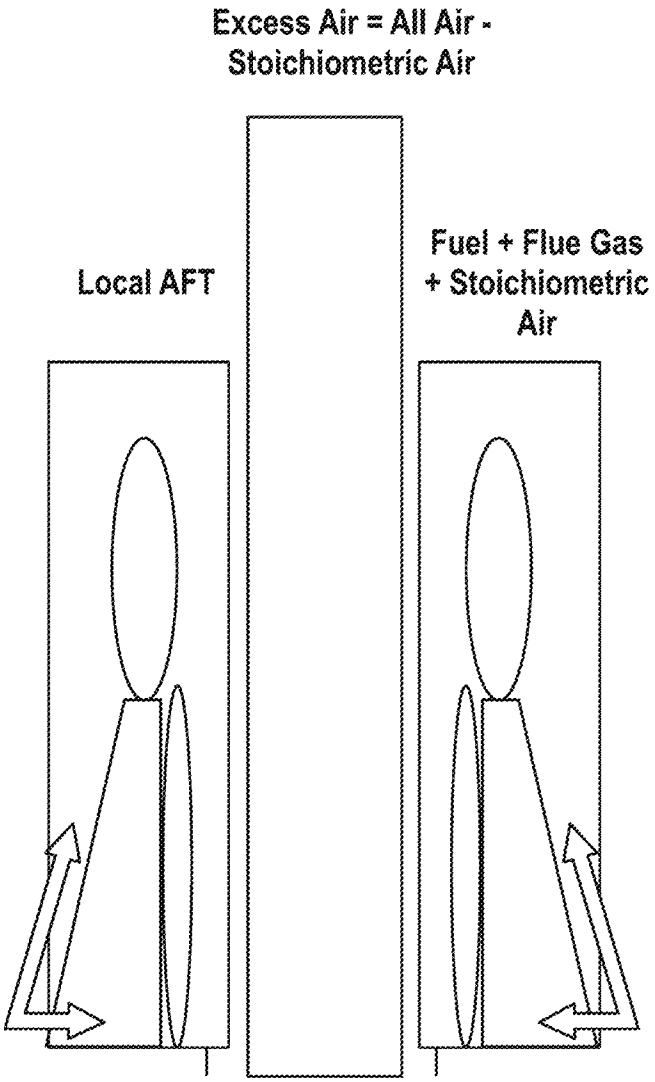
FIG. 33 includes local adiabatic flame temperature shown at a high-level, and further includes adiabatic flame temperature physics-based calculations at each burner, in an embodiment.

As shown in FIG. 33, analyzing the local AFT provides insight to excess air at the specific burner. If the local AFT remains high enough, such as due to more excess air in the flue gas entrained into the burner, then the burner may remain sufficiently stable. However, the excess air may cause the global AFT value to improperly indicate instability by indicating a lower global AFT value due to the excess air. This is broadly illustrated in FIG. 33 where a higher local AFT is caused, but excess air channel in the burner occurs.

Figure 34:
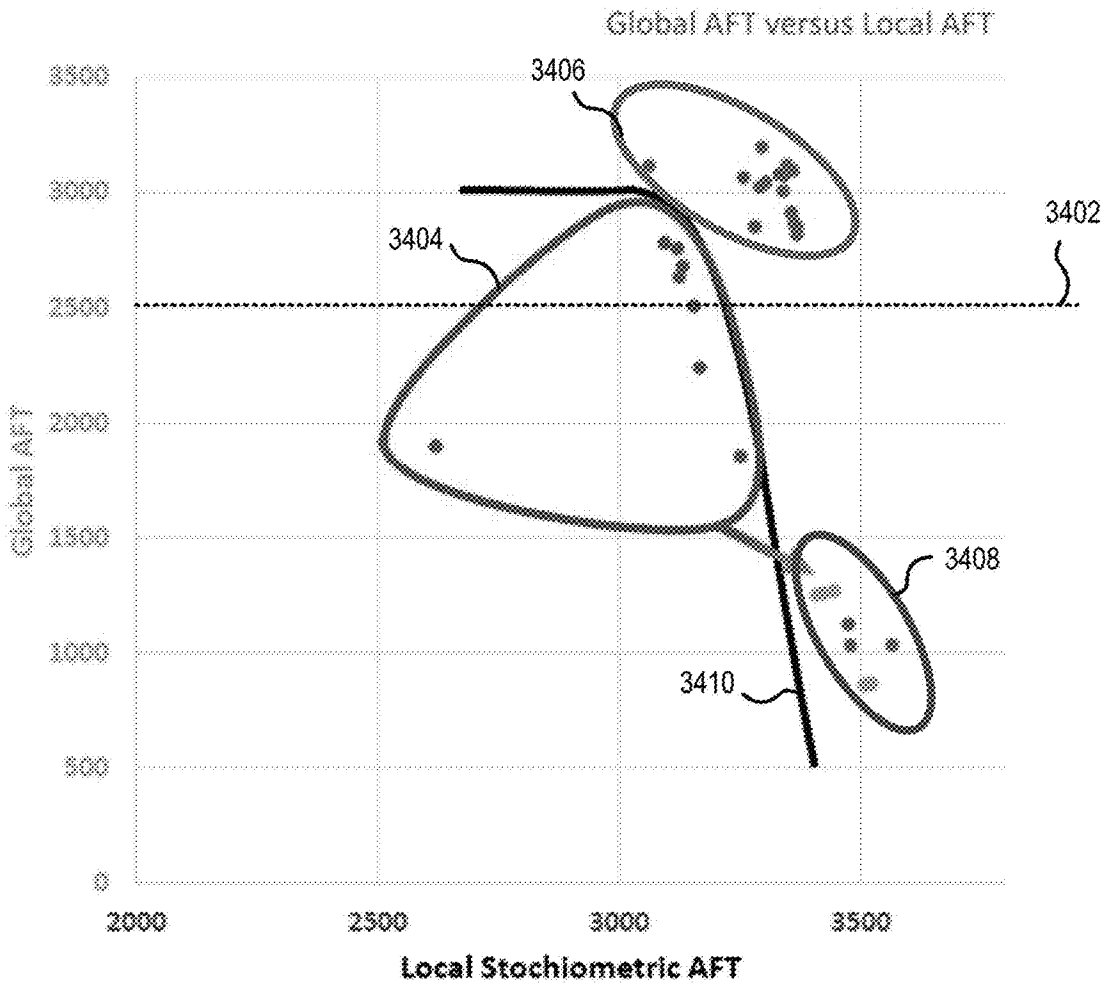
FIG. 34 depicts a graphical representation of test-values of global AFT versus local AFT corresponded to near-miss events, in an embodiment.

FIG. 34 depicts a graphical representation of test-values of global AFT versus local AFT corresponded to near-miss events. Typical operation monitors only the global AFT. A low-level global AFT safety setting threshold is set indicating that, when the global AFT calculated (based on sensed operating parameters of the heater) is at or below the low-level global AFT safety setting threshold, an alarm or other control signal (e.g., control signal 1164, alarm 1166, and/or displayed operating condition 1168) may be output to prevent a catastrophic event. The low-level global AFT setting threshold 3402 in the example shown in FIG. 34 is 2500° F. In FIG. 34, the test points in circle 3404 indicate tested near-miss events. The test points in circle 3406 indicate expected non-near-miss events. The test points in circle 3408 indicate unexpected non-near-miss events. As can be seen, the non-near-miss events 3408 have a global AFT value below the low-level global AFT setting threshold 3402. However, FIG. 34 depicts a unique global/local AFT safety setting threshold 3410 indicating a dynamic safety setting that indicates stable operation because, although the global AFT is below the typical low-level global AFT setting threshold 3402, the local AFT is high enough to maintain stable operation of the burner. The safety setting threshold 3410 defines the stability window (to the right of the threshold 3410 in FIG. 34) similar to stability window 2101 discussed above.

Figure 35:
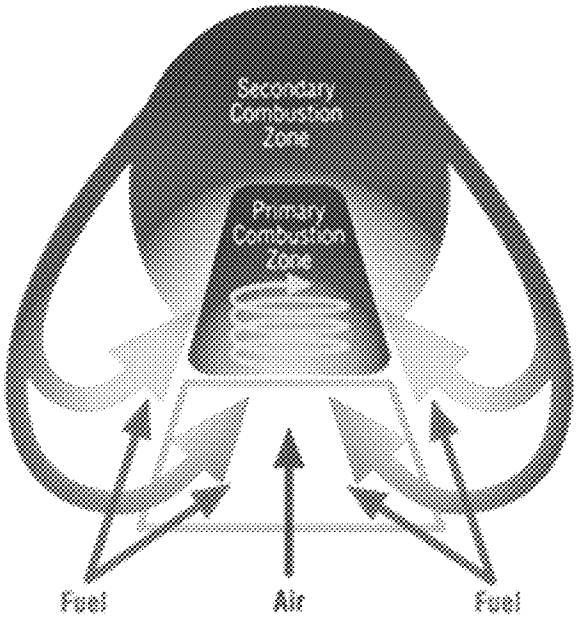
FIG. 35 illustrates flue gas entrainment, in an embodiment.

The above-described global and local AFT calculations uniquely include not only the fuel and air being supplied for combustion (as commonly measured), but also the amount of flue gas being entrained into the flame. FIG. 35 illustrates flue gas entrainment, in an embodiment. Flue gas entrainment into the burner flame is dependent on the burner design. For example, the flue gas may be entrained into the flame by being educated into the flame by staged gas tips on the outside of the burner tile. The staged gas tips are located within the furnace volume, but outside of the air supply zone. As the fuel gas exits the gas tip ports, it expands (typically at about a 7° half-angle), and entrains flue gasses (as calculated using the conservation of momentum equation) into the flame.

The flue-gas entrainment works to reduce NOx levels by entraining inert flue gases into the flame to cool flame temperatures and cause a reduction of thermal NOx emissions which is highly dependent on the flame temperature. Local AFT is difficult to calculate using typical sensors in the heater (such as those shown in FIG. 1, above). This application, in certain embodiments, is able to determine the local AFT based on measured NOx levels (e.g., sensed using NOx sensor 136 of FIG. 1).

Figure 36:
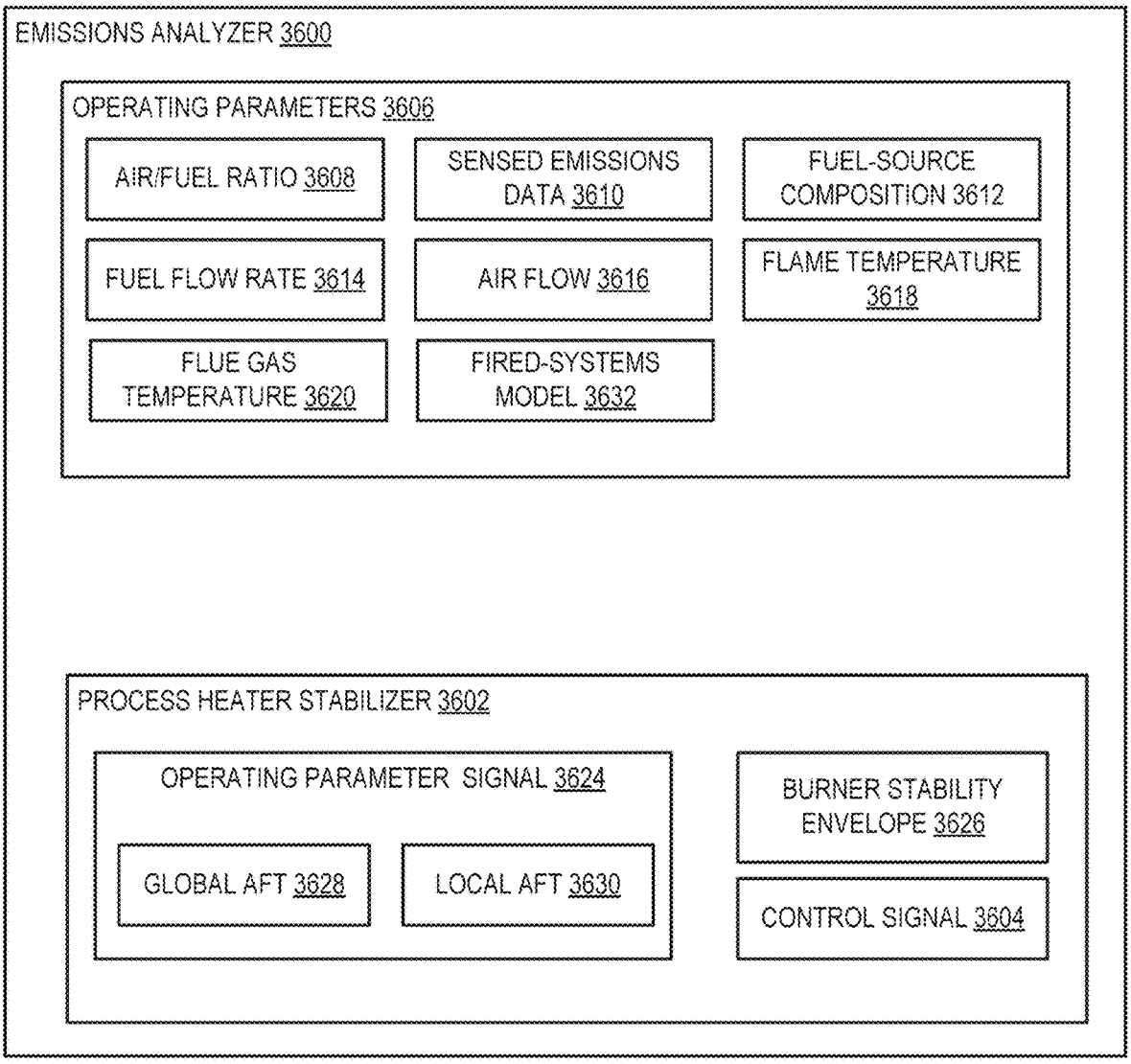
FIG. 36 depicts a schematic diagram of an emissions analyzer, in an embodiment.

FIG. 36 depicts an emissions analyzer 3600, which is an example of the emissions analyzer 1154, of FIG. 11, in an embodiment. Emissions analyzer 3600 includes a process heater stabilizer 3602, which is integral to, or combinable with the functionality of, the heater safety settings analyzer 1302 and the process heater stabilizer 1902 discussed above. Process heater stabilizer 3602 includes computer readable instructions that when executed by a processor (e.g., processor 1102), operate to create one or more control signals 3604 that alter operation of the process heater 102 to maintain stability thereof.

Process heater stabilizer 3602 analyzes a variety of information about the process heater 102. For example, one or more sensors within the process heater 102 may sense operating parameters 3606. Operating parameters 3606 may include any one or more information sensed within the process heater 102, including, but not limited to, one or more of air/fuel ratio 3608, sensed emissions data 3610, fuel-source composition 3612, fuel flow rate 3614, air flow 3616, flame temperature 3618, heater flue gas temperature proximate to the burner 3620 (which may define, either directly or through interpolation, flue gas temperature at the location of the burner), and flame scanner information 3622.

In one specific example, the process heater stabilizer 3602 generates an AFT operating parameter signal 3624. The AFT operating parameter 3624 may define a global AFT value 3628 and a local AFT value 3630. The AFT operating parameter 3624 may represent a snapshot in time, or may be a time-varying signal similar to and an example of operating parameter time varying signal 1924 discussed above. The global AFT value 3628 may be calculated based on known global AFT calculations. The local AFT value 3630 may, in at least some embodiments, be derived from the sensed emissions data 3610. In particular, the sensed emissions data 3610 may include NOx data generated by NOx sensor 136, for example.

In embodiments where the local AFT value 3630 is derived from emissions data 3610, and in particular NOx data, the burner stability envelope 3626 may define particular NOx levels, or the correlated local AFT and/or global AFT to those NOx levels, that indicate potential instability at the burner-level, or high CO events. The burner stability envelope 3626 may account for global AFT and local AFT. An example of the burner stability envelope 3626 is the global/local AFT safety setting threshold 3410 discussed above.

Correlation of the emissions data 3610 may occur using a fired-systems model 3632. The fired-systems model 3632 may be generated according to the following. First, historical data sensed for a given condition is captured, CFD data is performed, and/or field reference data of measured emissions (e.g., NOx), and correlated operating parameters to the historical data, CFD data, and/or field reference data are captured. In embodiments, the fired-systems model 3632 additionally or alternatively includes vendor guaranteed/expected NOx emissions for a given operating condition. Then, flue gas and air entrainment models based on the specific burner hardware and other heater geometry information are applied to generate a NOx prediction model that predict the amount of flue gas and air that are entrained into a given flame. This prediction model can then be used to calculate the global and local AFT based on the fuel, flue gas entrained and air for combustion. The flame temperature can be calculated for global fuel, flue gas, and air, and also for each specific burner zone (or individual burners) such as via a primary flame temperature producing a primary amount of NOx, and a staged flame temperature producing a staged amount of NOx based on the specific burner characteristics.

The fired-systems model 3632, and the NOx prediction model discussed above may further need to be tuned. To do so, the NOx prediction model is applied to sensed operating data and compared against the reference NOx emissions to verify an acceptable level of prediction accuracy. If the predicted versus measured NOx emissions are not accurate enough over the range of data being evaluated, then the flue gas entrainment model is tuned such that the error between the predicted NOx and the measured NOx is reduced.

By generating the fired-systems model 3632 including the NOx prediction model as discussed above, the process heater stabilizer 3602 can then generate the operating parameter signal 3624 including the global AFT 3628 and local AFT 3630 based simply off of a sensed emissions data 3610 (e.g., NOx data from NOx sensor 136). The local AFT 3630, in particular, is a value previously not considered for burner stability. This operating parameter signal 3624 is then compared to the burner stability envelope 3626 (e.g., the global/local AFT safety setting threshold 3410 discussed above) to provide a new burner stability threshold. As shown in FIG. 34, this new burner stability threshold allows for operating lower than the typical 2500° F. global AFT burner safety threshold so long as the calculated local AFT 3630 is above the global/local AFT safety setting threshold 3410. These additional operating conditions allow for increased production in the system while maintaining safe operation to prevent catastrophic events.

Figure 37:
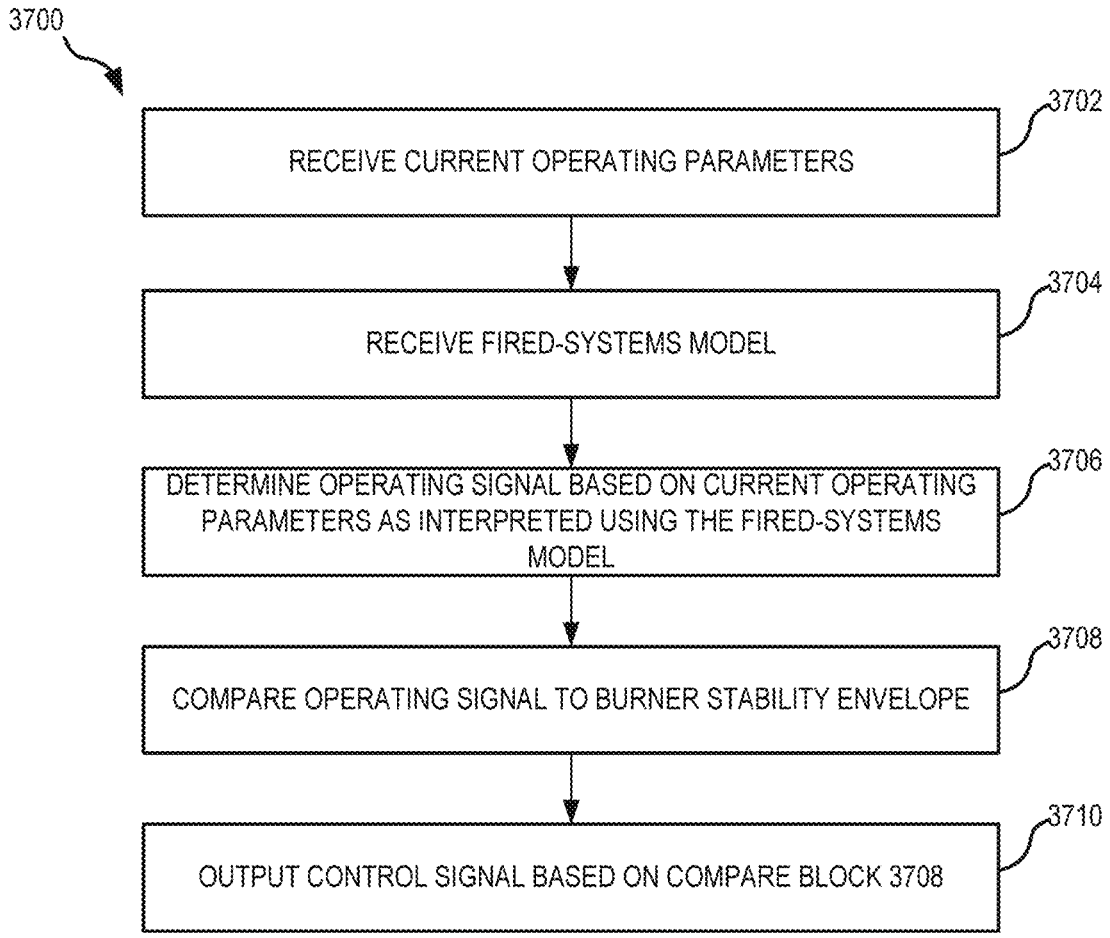
FIG. 37 depicts a method for control of a combustion heater based on burner stability envelope, in embodiments.

FIG. 37 depicts a method 3700 for control of a combustion heater based on burner stability envelope, in embodiments. Method 3700 is for example implemented using one or more of the "analyzers" discussed above with respect to FIGS. 1-36, including the process heater stabilizer 3602, the heater safety settings analyzer 1302, and/or the process heater stabilizer 1902 discussed above.

In block 3702, the method 3700 receives current operating parameters. In one example of block 3702, the emissions analyzer 3600 receives the operating parameters 3606 captured by one or more of the sensors discussed with respect to FIG. 1. In one example of block 3702, the operating parameters include NOx emissions data received from NOx sensor 136.

In block 3704, the method 3700 receives a fired-systems model. In one example of block 3704, the emissions analyzer 3600 receives the fired-systems model 3632. In one example of block 3704, the fired-systems model is a correlation of NOx readings to global and/or local AFT for the heater.

In block 3706, the method 3700 determines an operating signal based on current operating parameters as interpreted using the fired-systems model. In one example of block 3706, the emissions analyzer 3600 receives the operating parameters 3606 captured by one or more of the sensors discussed with respect to FIG. 1. In one example of block 3706, the emissions analyzer 3600 determines operating parameter signal 3624 discussed above. In one example, the operating parameter signal generated at block 3706 includes global AFT value 3628 and local AFT value 3630.

In block 3708, the method 3700 compares the operating signal from block 3706 to a burner stability envelope. In one example of block 3708, emissions analyzer 3600 compares the operating parameter signal 3624 against the burner stability envelope 3626 to determine if the global AFT 3628 and the local AFT 3630 indicate a instability condition or high CO condition.

In block 3710, the method 3700 outputs a control signal based on the results of block 3708. In one example of block 3708, emissions analyzer 3600 outputs control signal 3604 to prevent the instability condition or high CO condition thereby preventing a catastrophic event in the process heater 102.

Figure 38:
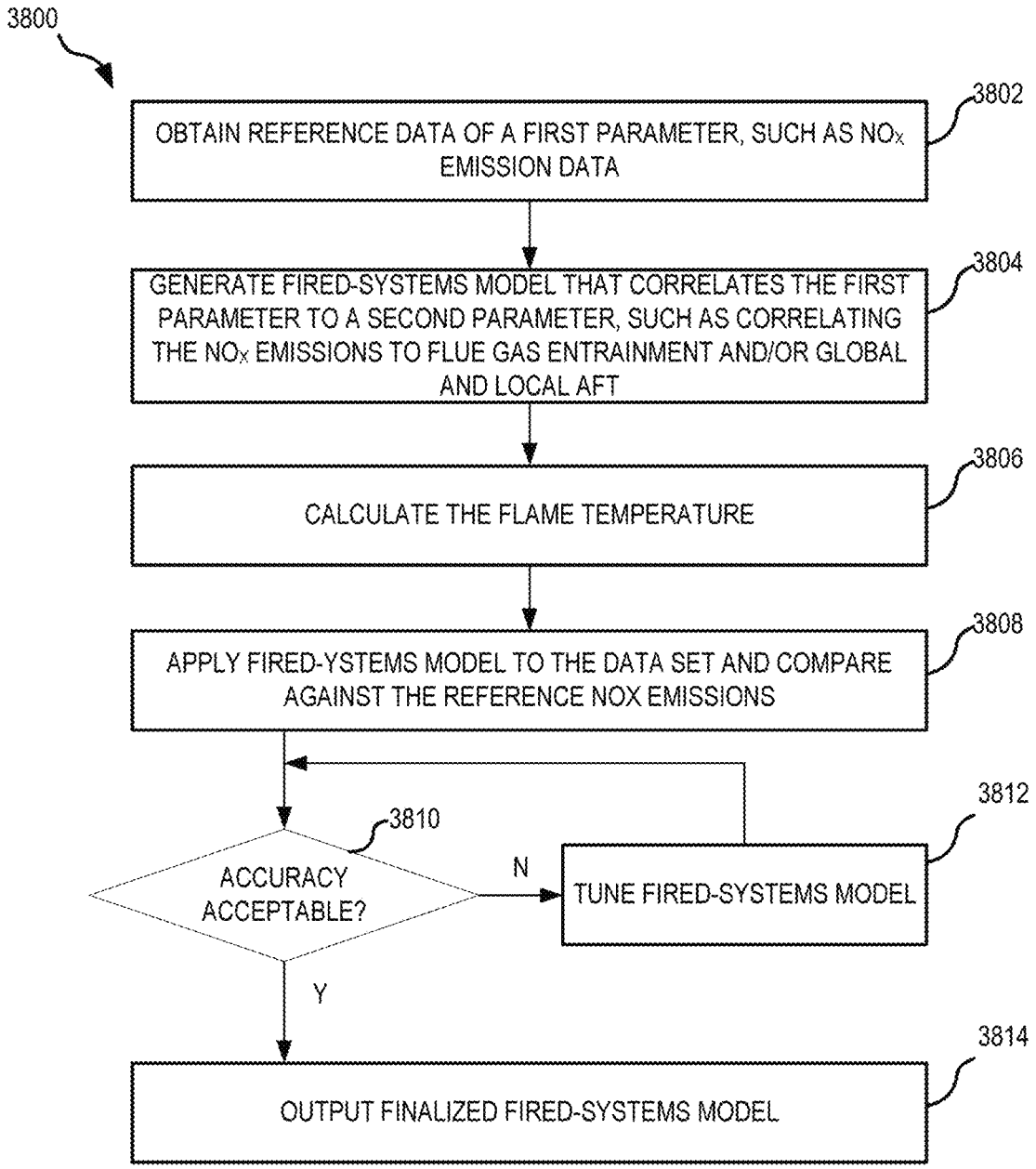
FIG. 38 depicts a method for creating a fired-systems model for analyzing global and/or local AFT, in an embodiment.

FIG. 38 depicts a method 3800 for creating a fired-systems model for analyzing global and/or local AFT, in an embodiment. Method 3800 is implemented using one or more of the "analyzers" discussed above with respect to FIGS. 1-36, including the process heater stabilizer 3602, the heater safety settings analyzer 1302, and/or the process heater stabilizer 1902 discussed above. Method 3800 is an example of block 3704 of method 3700, for example.

In block 3802, the method 3800 obtains reference data of a desired first parameter to be correlated in the fired-systems model, such as, but not limited to, NOx emission data. In one example of block 3802, the emissions analyzer 3602 obtains sampled test data from sensors in the corresponding heater 102 (or a similar hardware component), CFD analysis of the heater 102, or field reference data of measured NOx emissions. In another example of block 3802, the vendor guaranteed/expected NOx emissions for a given operating condition if the sampled test, CFD, or field reference data is unavailable.

In block 3804, the method 3800 creates a fired-systems model correlating the first parameter to a second parameter. In one example of block 3804, the emissions analyzer 3600 correlates the NOx emissions data to a second parameter, such as one or more of flue gas entrainment at the burner(s), air input at the burners, global AFT, and local AFT, or any combination thereof. The emissions analyzer 3600 may apply air and flue gas entrainment models to the NOx emissions data obtained in block 3802 to identify a fired-systems model that correlates to air and flue gas entrainment at the burner(s). In one example, the fired-systems model is created by applying the Zeldovich equation to the reference data to obtain the air and fuel gas entrainment including amount and mixing length of the air and flue gas at the burner.

In block 3806, the method 3800 calculates flame temperature based on the fired-systems model of block 3804. In one example of block 3804, the emissions analyzer 3600 calculates local and/or global AFT when the fired-systems model of block 3806 does not correlate the NOx emissions data directly to the local and/or global AFT. Accordingly, the fired-systems model of block 3804 may correlate NOx emission data to flue gas and air entrainment.

In block 3808, the method 3800 applies the fired-systems model to a dataset to compare against reference NOx emissions. In one example of block 3808, the fired-systems model 3632 is applied to a reference dataset to determine its accuracy.

Block 3810 is a decision. If the current fired-systems model is not sufficiently accurate, method 3800 proceeds to block 3812, else method 3800 proceeds to block 3814.

In block 3812, the method 3800 tunes the fired-systems model correlating the first parameter to a second parameter. In one example of block 3812, the fired-systems model is tuned to match the reference data until the accuracy is sufficient at block 3810.

In block 3814, the method 3800 outputs the fired-systems model to an analyzer for use in obtaining the second parameter. In one example of block 3814, the emissions analyzer 3600 stores the fired-systems model 3632 and uses the fired-systems model 3632 to correlate sensed emissions data 3610 (NOx emissions) to local and/or global AFT.

In embodiments, a portion or all of the fuel analyzer 1300 may be implemented remotely from the process controller 128, such as in the network-based "cloud", where the fuel analyzer 1300 and the process controller 128 are a portion of an edge computing scheme. For example, the fired-systems model 1320 may be stored and executed at the external server 164, such that after the modified safety settings 1304 are generated, the modified safety settings 1304 are then transmitted from the external server 164 to the process controller 128 for display on the display 1108 thereof or used automatic control of the hardware associated the system 100. The necessary data to implement the fuel analyzer 1300 may be gathered at the process controller 128 (such as at the system DCS or PLC (plant control system) and transmitted to the external server 164 for analysis by the fuel analyzer 1300. Alternatively, or additionally, one or more of the devices capturing the necessary data to implement the fuel analyzer 1300 may be an embedded device having data transmission capability that transfers its respective data directly to the external server 164 for analysis by the fuel analyzer 1300.

The disclosure herein may reference "physics-based models" and transforming, interpolating, or otherwise calculating certain data from other data inputs. Those of ordinary skill in the art should understand what physics-based models incorporate, and the calculations necessary to implement said transforming, interpolating, or otherwise calculating for a given situation. However, the present disclosure incorporates by reference chapter 9 of the "John Zink Hamworthy Combustion Handbook", which is incorporated by reference in its entirety (Baukal, Charles E. The John Zink Hamworthy Combustion Handbook. Fundamentals. 2nd ed., vol. 1 of 3, CRC Press, 2013) for further disclosure related to understanding of fluid dynamics physics-based modeling and other calculations. It should be appreciated, however, that "physics-based models" and transforming, interpolating, or otherwise calculating certain data from other data inputs is not limited to just those fluid dynamics calculations listed in chapter 9 of the John Zink Hamworthy Combustion Handbook.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

Any of the functionality described herein may be combined, in any combination, with the functionality in the applications incorporated by reference as discussed above. Such combinations include using given outputs from the various described "analyzers" to identify further insights into the control of the described combustion systems, as will be appreciated by those of ordinary skill in the art.

Examples of combination of features are as follows.

(A1) In a first aspect, a process heater combustion stabilization method, includes: sensing current operating parameters for a process heater at a plurality of time intervals; converting the current operating parameters into a time-varying signal; comparing the time-varying signal against a multi-dimensional burner stability envelope defined by a stability window of the process heater, each boundary of the stability window indicating when a burner within the combustion system likely enters an unstable state; and altering operation of at least one burner of the process heater in response to the time-varying signal breaching the boundary of the stability window.

(A2) In an embodiment of (A1), the stability window defined, at any given location on the boundary, for one of the operating parameters based on potential values of others of the operating parameters.

(A3) In an embodiment of any of (A1)-(A2), the unstable state including burner huffing.

(A4) In an embodiment of any of (A1)-(A3), the unstable state including burner flashback.

(A5) In an embodiment of any of (A1)-(A4), the unstable state including burner lift-off.

(A6) In an embodiment of any of (A1)-(A5), the operating parameters including one or more of measured or inferred data including emissions data, fuel-source composition, air-fuel ratio, fuel flow rate, air flow, flame temperature, flue gas temperature.

(A7) In an embodiment of any of (A6), the fuel-source composition comprising the hydrocarbon, hydrogen, and inert compositions within fuel-source input into the burner.

(A8) In an embodiment of any of (A6)-(A7), the emissions data including NOx levels.

(A9) In an embodiment of any of (A1)-(A8), the burner stability envelope being computed based on geometry of the at least one and geometry of the process heater.

(A10) In an embodiment of any of (A1)-(A9), the altering operation of the burner including outputting a control signal shutting a fuel control valve to prevent fuel from flowing to the burner.

(A11) In an embodiment of any of (A1)-(A10), the altering operation of the burner including outputting a control signal changing the air/fuel ratio at the burner.

(A12) In an embodiment of any of (A1)-(A11), the time-varying signal breaching the boundary when the time-varying signal becomes within a predefined threshold range of the boundary.

(A13) In an embodiment of any of (A1)-(A12), the time-varying signal breaching the boundary when the time-varying signal reaches the boundary.

(A14) In an embodiment of any of (A1)-(A13), the time-varying signal including a future value corresponding to a future time and interpolated from the sensed current operating parameters under the assumption that the operating state data will change at a predictable rate until the future time, and the method further including altering operation of the burner in response to indication that the future value of the time-varying signal will breach the predefined threshold value with respect to one or more of the maxima and minima values.

(A15) In an embodiment of any of (A1)-(A14), the sensed current operating parameters including scanned flame data from a flame scanner located within the process heater and scanning a flame produced by the burner.

(A16) In an embodiment of any of (A15), the burner stability envelope being further defined by a time-varying spectral signature at which a burner within the combustion heater likely enters an unstable state; the comparing the time-varying signal including comparing an oscillation in time-varying spectral signal of the scanned flame data to the time-varying spectral signature.

(A17) In an embodiment of any of (A1)-(A16), the method further including: receiving a process heater control requesting to change an operation of the process heater; generating a predicted time-varying signal based on expected operating parameters if the process heater control is implemented; comparing the predicted time-varying signal against the burner stability envelope; and overriding the process heater control in response to the predicted signal breaching the stability window.

(A18) In an embodiment of any of (A1)-(A17), the burner stability envelope being generated remotely at a cloud server, received and stored at a process controller local to the process heater.

(A19) In an embodiment of any of (A1)-(A18), the method further including identifying the boundary using an artificial intelligence neural network trained via test samples created during testing of the burner.

(A20) In an embodiment of any of (A1)-(A19), the sensed current operating parameters including NOx emissions data.

(A21) In an embodiment of any of (A20), the stability window defined by global adiabatic flame temperature (AFT) and local AFT.

(A22) In an embodiment of any of (A21), the method further including calculating the local AFT at a burner zone, or at each burner based on the NOx emissions data.

(A23) In an embodiment of any of (A21)-(A22), the stability window including stable conditions at global AFT below 2500° F.

(A24) In an embodiment of any of (A1)-(A223), the method further comprising generating a fired-systems model correlating measured NOx emissions to local AFT at a burner, or burner zones within the process heater.

(A25) In an embodiment of any of (A24), the generating the fired-systems model including: capturing historical data, computational fluid dynamics (CFD) data, or field reference data regarding NOx emissions at the process heater and correlated operating parameters; generating the fired-systems model by applying flue gas and air entrainment models to the captured historical data, computational fluid dynamics (CFD) data, or field reference data.

(A26) In an embodiment of any of (A25), the flue gas and air entrainment models including the Zeldovich equation.

(A27) In an embodiment of any of (A25)-(A26), further comprising tuning the fired-systems model when the fired-systems model does not meet an acceptable level of prediction accuracy.

(B1) In a second aspect, a process heater combustion stabilization method includes: scanning at least one flame of a process burner to capture flame data at each of a plurality of time intervals; converting the flame data into a time-varying signal; comparing the time-varying signal with a multi-dimensional burner stability envelope defining a time-varying spectral signature at which at least one burner producing the at least one flame likely enters an unstable state; and, altering operation of said at least one burner when the time-varying signal matches the multi-dimensional burner stability envelope.

(B2) In an embodiment of (B1), the unstable state including burner huffing.

(B3) In an embodiment of any of (B1)-(B2), the unstable state including burner flashback.

(B4) In an embodiment of any of (B1)-(B3), the unstable state including burner lift-off.

(B5) In an embodiment of any of (B1)-(B4), the altering operation of the burner including outputting a control signal shutting a fuel control valve to prevent fuel from flowing to the burner.

(B6) In an embodiment of any of (B1)-(B5), the altering operation of the burner including outputting a control signal changing the air/fuel ratio at the burner.

(B7) In an embodiment of any of (B1)-(B6), the burner stability envelope being further defined by a time-varying spectral signature at which a burner within the combustion heater likely enters an unstable state; the comparing the time-varying signal including comparing an oscillation in time-varying spectral signal of the scanned flame data to the time-varying spectral signature.

(B8) In an embodiment of any of (B1)-(B7), further including the features from any of (A1)-(A27).

(C1) In a third aspect, a process heater control system, includes: one or more sensors sensing current operating parameters for a process heater at a plurality of time intervals; a processor; a memory storing: the sensed operating parameters, and a process heater stabilizer including computer readable instructions that, when executed by the processor, operate to: convert the operating parameters into a time-varying signal; compare the time-varying signal against a multi-dimensional burner stability envelope defined by a stability window of the process heater, each boundary of the stability window indicating when a burner within the combustion system likely enters an unstable state; and, alter operation of at least one burner of the process heater in response to the time-varying signal breaching the boundary of the stability window.

(C2) In an embodiment of (C1), the stability window defined, at any given location on the boundary, for one of the operating parameters based on potential values of others of the operating parameters.

(C3) In an embodiment of any of (C1)-(C2), the unstable state including burner huffing, burner flashback, and/or burner lift-off.

(C4) In an embodiment of any of (C1)-(C3), the operating parameters including one or more of measured or inferred data including emissions data, fuel-source composition, air-fuel ratio, fuel flow rate, air flow, flame temperature, flue gas temperature.

(C5) In an embodiment of any of (C4), the fuel-source composition comprising the hydrocarbon, hydrogen, and inert compositions within fuel-source input into the burner.

(C6) In an embodiment of any of (C4)-(C5), the emissions data including NOx levels.

(C7) In an embodiment of any of (C1)-(C6), the burner stability envelope being computed based on geometry of the at least one and geometry of the process heater.

(C8) In an embodiment of any of (C1)-(C7), the altering operation of the burner including outputting a control signal shutting a fuel control valve to prevent fuel from flowing to the burner.

(C9) In an embodiment of any of (C1)-(C8), the altering operation of the burner including outputting a control signal changing the air/fuel ratio at the burner.

(C10) In an embodiment of any of (C1)-(C9), the time-varying signal breaching the boundary when the time-varying signal becomes within a predefined threshold range of the boundary.

(C11) In an embodiment of any of (C1)-(C10), the time-varying signal breaching the boundary when the time-varying signal reaches the boundary.

(C12) In an embodiment of any of (C1)-(C11), the time-varying signal including a future value corresponding to a future time and interpolated from the sensed current operating parameters under the assumption that the operating state data will change at a predictable rate until the future time, and the process heater stabilizer including further computer readable instructions that alter operation of the burner in response to indication that the future value of the time-varying signal will breach the predefined threshold value with respect to one or more of the maxima and minima values.

(C13) In an embodiment of any of (C1)-(C12), the sensed current operating parameters including scanned flame data from a flame scanner located within the process heater and scanning a flame produced by the burner.

(C14) In an embodiment of any of (C13), the burner stability envelope being further defined by a time-varying spectral signature at which a burner within the combustion heater likely enters an unstable state; the comparing the time-varying signal including comparing an oscillation in time-varying spectral signal of the scanned flame data to the time-varying spectral signature.

(C15) In an embodiment of any of (C1)-(C14), the process heater stabilizer including further computer readable instructions that receive a process heater control requesting to change an operation of the process heater; generate a predicted time-varying signal based on expected operating parameters if the process heater control is implemented; compare the predicted time-varying signal against the burner stability envelope; and override the process heater control in response to the predicted signal breaching the stability window.

(C16) In an embodiment of any of (C1)-(C15), the sensed current operating parameters including NOx emissions data.

(C17) In an embodiment of any of (C16), the stability window defined by global adiabatic flame temperature (AFT) and local AFT.

(C18) In an embodiment of any of (C16)-(C17), the process heater stabilizer including further computer readable instructions that calculate the local AFT at a burner zone, or at each burner based on the NOx emissions data.

(C19) In an embodiment of any of (C16)-(C18), the stability window including stable conditions at global AFT below 2500° F.

(C20) In an embodiment of any of (C1)-(C19), the process heater stabilizer including further computer readable instructions that generate a fired-systems model correlating measured NOx emissions to local AFT at a burner, or burner zones within the process heater.

(C21) In an embodiment of any of (C1)-(C20), the instructions that generate the fired-systems model including instructions that operate to: capture historical data, computational fluid dynamics (CFD) data, or field reference data regarding NOx emissions at the process heater and correlated operating parameters; generate the fired-systems model by applying flue gas and air entrainment models to the captured historical data, computational fluid dynamics (CFD) data, or field reference data.

(C21) In an embodiment of any of (C21), the flue gas and air entrainment models including the Zeldovich equation.

(C22) In an embodiment of any of (C1)—(C21), the instructions further including instructions to implement any of the features of from any of (A1)-(A27), and/or (B1)-(B8).

(D1) In a fourth aspect, a method for dynamically adjusting a combustion heater, includes: receiving in-heater data defining current operating conditions of the chemical combustion heater; determining available airflow at each burner within the combustion heater based on the in-heater data; generating a fuel-pressure trip setting based on the available draft; and, controlling the chemical combustion heater according to the fuel-pressure trip setting.

(D2) In an embodiment of any of (D1), the in-heater data comprising sensed pressure received from one or more of a floor pressure sensor, an arch pressure sensor, a convection pressure sensor, and a stack pressure sensor.

(D3) In an embodiment of any of (D1)—(D2), wherein determining the available airflow at each burner includes determining available draft within the combustion heater at the location of each burner.

(D4) In an embodiment of any of (D3), wherein determining the available draft further comprises determining the available draft based additionally on weather conditions.

(D5) In an embodiment of any of (D1)—(D4), the method further including receiving the weather conditions from a weather server.

(D6) In an embodiment of any of (D1)—(D5), the method further including receiving the weather conditions from on-site sensors located at the heater, the on-site sensors comprising one or more of a precipitation sensor, a humidity sensor, a barometric sensor, a wind sensor, and a temperature sensor.

(D7) In an embodiment of any of (D1)-(D6), the fuel-pressure trip setting being less than a maximum fuel pressure that maintains a desired air/fuel ratio in the heater.

(D8) In an embodiment of any of (D1)-(D7), wherein controlling the heater comprises generating a fuel valve control signal configured to adjust flow through a fuel valve, to increase fuel to at least one burner within the heater.

(D9) In an embodiment of any of (D1)-(D8), the method further implementing any of the features of from any of (A1)-(A27), (B1)-(B8), and/or (C1)-(C22).

(E1) In a fifth aspect, a dynamically adjustable combustion heater includes: one or more sensors providing in-heater data defining current operating conditions of the combustion heater; at least one mechanical valve that adjusts fuel flow into the chemical combustion heater; a controller having machine readable instructions executed by the controller to: determine available airflow at each burner within the combustion heater based on the in-heater data; generate a fuel-pressure trip setting based on the available airflow at each burner; and, control the at least one valve to adjust the fuel flow according to the fuel-pressure trip setting.

(E2) In an embodiment of any of (E1), the instructions further including instructions to implement any of the features of from any of (A1)-(A27), (B1)-(B8), (C1)-(C22), and/or (D1)-(D9).

What is claimed is:

1. A process heater combustion stabilization method, comprising sensing current operating parameters for a process heater at a plurality of time intervals;

converting the current operating parameters into a time-varying signal;

comparing the time-varying signal against a multi-dimensional burner stability envelope defined by a stability window of the process heater, each boundary of the stability window indicating when a burner within the combustion system likely enters an unstable state; and altering operation of at least one burner of the process heater in response to the time-varying signal breaching the boundary of the stability window.

2. The method of claim 1, wherein the stability-window is defined, at any given location on the boundary, for one of the operating parameters based on potential values of others of the operating parameters.

3. The method of claim 1, wherein the unstable state comprises burner huffing.

4. The method of claim 1, wherein the unstable state comprises burner flashback.

5. The method of claim 1, wherein the unstable state comprises burner lift-off.

6. The method of claim 1, wherein the operating parameters comprise at least one of measured or inferred data including emissions data, fuel-source composition, air-fuel ratio, fuel flow rate, air flow, flame temperature, and flue gas temperature.

7. The method of claim 6, wherein the fuel-source composition comprises hydrocarbon, hydrogen, and inert compositions within fuel-source input into the burner.

8. The method of claim 6, wherein the emissions data comprise NOx levels.

9. The method of claim 1, wherein the burner stability envelope is computed based on geometry of the at least one burner and geometry of the process heater.

10. The method of claim 1, wherein the altering operation of the burner comprises outputting a control signal shutting a fuel control valve to prevent fuel from flowing to the burner.

11. The method of claim 1, wherein the altering operation of the burner comprises outputting a control signal changing the air/fuel ratio at the burner.

12. The method of claim 1, wherein the time-varying signal breaches the boundary when the time-varying signal becomes within a predefined threshold range of the boundary.

13. The method of claim 1, wherein the time-varying signal breaches the boundary when the time-varying signal reaches the boundary.

14. The method of claim 1, wherein:

the time-varying signal comprises a future value corresponding to a future time and interpolated from the sensed current operating parameters under the assumption that the operating state data will change at a predictable rate until the future time, and altering operation of the burner is performed in response to indication that the future value of the time-varying signal breaches the predefined threshold value with respect to at least one of the maxima and minima values.

15. The method of claim 1, wherein the sensed current operating parameters compromise scanned flame data from a flame scanner located within the process heater and scanning a flame produced by the burner.

16. The method of claim 15, wherein:

the burner stability envelope is further defined by a time-varying spectral signature at which a burner within the combustion heater likely enters an unstable state; and the comparing of the time-varying signal comprises comparing an oscillation in time-varying spectral signal of the scanned flame data to the time-varying spectral signature.

17. The method of claim 1, further comprising:

receiving a process heater control requesting to change an operation of the process heater, generating a predicted time-varying signal based on expected operating parameters if the process heater control is implemented, and comparing the predicted time-varying signal against the burner stability envelope, and overriding the process heater control in response to the predicted signal breaching the stability window.

18. The method of claim 1, wherein the burner stability envelope is generated remotely at a cloud server, received, and stored at a process controller local to the process heater.

19. The method of claim 1, further comprising identifying the boundary using an artificial intelligence neural network trained via test samples created during testing of the burner.

20. The method of claim 1, wherein the sensed current operating parameters comprises NOx emissions data.

21. The method of claim 20, wherein the stability window is defined by global adiabatic flame temperature (AFT) and local AFT.

22. The method of claim 21, further comprising calculating the local AFT at a burner zone, or at each burner based on the NOx emissions data.

23. The method of claim 21, wherein the stability window comprises stable conditions at global AFT below 2500° F.

24. The method of claim 20, further comprising generating a fired-systems model correlating measured NOx emissions to local AFT at a burner, or burner zones within the process heater.

25. The method of claim 24, wherein:

the generating of the fired-systems model comprises capturing historical data, computational fluid dynamics (CFD) data, or field reference data regarding NOx emissions at the process heater and correlated operating parameters; and generating the fired-systems model comprises applying flue gas and air entrainment models to the captured historical data, computational fluid dynamics (CFD) data, or field reference data.

26. The method of claim 25, wherein the flue gas and air entrainment models comprise the Zeldovich equation.

27. The method of claim 25, further comprising tuning the fired-systems model when the fired-systems model does not meet an acceptable level of prediction accuracy.

28. A process heater combustion stabilization method, comprising:

scanning at least one flame of a process burner to capture flame data at each of a plurality of time intervals;

converting the flame data into a time-varying signal;

comparing the time-varying signal with a multi-dimensional burner stability envelope defining a time-varying spectral signature at which at least one burner producing the at least one flame likely enters an unstable state; and altering operation of the at least one burner when the time-varying signal matches the multidimensional burner stability envelope.

29. The process heater combustion stabilization method of claim 28, wherein the unstable state comprises burner huffing.

30. The process heater combustion stabilization method of claim 28, wherein the unstable state comprises burner flashback.

31. The process heater combustion stabilization method of claim 28, wherein the unstable state comprises burner lift-off.

32. The process heater combustion stabilization method of claim 28, wherein the altering of the operation of the burner comprises outputting a control signal shutting a fuel control valve to prevent fuel from flowing to the burner.

33. The process heater combustion stabilization method of claim 28, wherein the altering operation of the burner comprises outputting a control signal changing the air/fuel ratio at the burner.

34. The process heater combustion stabilization method of claim 28, wherein:

the burner stability envelope is further defined by a time-varying spectral signature at which a burner within the combustion heater likely enters an unstable state; and the comparing the time- varying signal including comparing an oscillation in time-varying spectral signal of the scanned flame data to the time-varying spectral signature.

35. A process heater control system, comprising:

one or more sensors configured to sense current operating parameters for a process heater at a plurality of time intervals;

at least one hardware processor; and a memory storing the sensed operating parameters and program instructions that, when executed by the at least one hardware processor, direct the at least one hardware processor to:

convert the operating parameters into a time-varying signal;

compare the time-varying signal against a multi-dimensional burner stability envelope defined by a stability window of the process heater, each boundary of the stability window indicating when a burner within the combustion system likely enters an unstable state; and alter operation of at least one burner of the process heater in response to the time-varying signal breaching the boundary of the stability window.

36. The process heater control system of claim 35, wherein the stability window is defined, at any given location on the boundary, for one of the operating parameters based on potential values of others of the operating parameters.

37. The process heater control system of claim 35, wherein the unstable state comprises at least one of: burner huffing, burner flashback, and burner lift-off.

38. The process heater control system of claim 35, wherein the operating parameters comprise at least one of measured or inferred data including emissions data, fuel-source composition, air-fuel ratio, fuel flow rate, air flow, flame temperature, and flue gas temperature.

39. The process heater control system of claim 38, wherein the fuel-source composition comprises hydrocarbon, hydrogen, and inert compositions within fuel-source input into the burner.

40. The process heater control system of claim 38, wherein the emissions data comprise levels.

41. The process heater control system of claim 35, wherein the burner stability envelope is computed based on geometry of the at least one burner and geometry of the process heater.

42. The process heater control system of claim 35, wherein the altering of operation of the burner comprises outputting a control signal shutting a fuel control valve to prevent fuel from flowing to the burner.

43. The process heater control system of claim 35, wherein the altering of operation of the burner comprises outputting a control signal changing the air/fuel ratio at the burner.

44. The process heater control system of claim 35, the time-varying signal breaching the boundary when the time-varying signal becomes within a predefined threshold range of the boundary.

45. The process heater control system of claim 35, the time-varying signal breaching the boundary when the time-varying signal reaches the boundary.

46. The process heater control system of claim 35, the time-varying signal including a future value corresponding to a future time and interpolated from the sensed current operating parameters under the assumption that the operating state data will change at a predictable rate until the future time, and the process heater stabilizer including further computer readable instructions that alter operation of the burner in response to indication that the future value of the time-varying signal will breach the predefined threshold value with respect to one or more of the maxima and minima values.

47. The process heater control system of claim 35, the sensed current operating parameters including scanned flame data from a flame scanner located within the process heater and scanning a flame produced by the burner.

48. The process heater control system of claim 47, wherein:

the burner stability envelope is further defined by a time-varying spectral signature at which a burner within the combustion heater likely enters an unstable state; and the comparing the time-varying signal including comparing an oscillation in time-varying spectral signal of the scanned flame data to the time-varying spectral signature.

49. The process heater control system of claim 35, wherein the at least one hardware processor is further directed to:

receive a process heater control requesting to change an operation of the process heater;

generate a predicted time-varying signal based on expected operating parameters if the process heater control is implemented;

compare the predicted time-varying signal against the burner stability envelope; and override the process heater control in response to the predicted signal breaching the stability window.

50. The process heater control system of claim 35, wherein the sensed current operating parameters comprise NOx emissions data.

51. The process heater control system of claim 50, wherein the stability window is defined by global adiabatic flame temperature (AFT) and local AFT.

52. The process heater control system of claim 50, wherein the at least one hardware processor is further directed to calculate the local AFT at a burner zone, or at each burner based on the NOx emissions data.

53. The process heater control system of claim 50, wherein the stability window comprises stable conditions at global AFT below 2500° F.

54. The process heater control system of claim 35, wherein the at least one hardware processor is further directed to generate a fired-systems model correlating measured NOx emissions to local AFT at a burner, or burner zones within the process heater.

55. The process heater control system of claim 35, generating the fired-systems model comprises:

capturing historical data, computational fluid dynamics (CFD) data, or field reference data regarding NOx emissions at the process heater and correlated operating parameters; and generating the fired-systems model by applying flue gas and air entrainment models to the captured historical data, computational fluid dynamics (CFD) data, or field reference data.

56. The process heater control system of claim 55, wherein the flue gas and air entrainment models comprise the Zeldovich equation.

* * * * *